US005597679A

United States Patent [19]

Yoshioka

[11] Patent Number: 5,597,679

[45] Date of Patent: Jan. 28, 1997

[54] SILVER HALIDE COLOR PHOTOGRAPHIC LIGHT-SENSITIVE MATERIAL

[75] Inventor: Yasuhiro Yoshioka, Kanagawa, Japan

[73] Assignee: Fuji Photo Film Co., Ltd., Kanagawa, Japan

[21] Appl. No.: 425,065

[22] Filed: Apr. 19, 1995

[30] Foreign Application Priority Data

May 11, 1994 [JP] Japan ..... 6-121719

[51] Int. Cl.[6] ..... G03C 1/46

[52] U.S. Cl. ..... 430/503; 430/557; 430/558; 430/553; 430/543; 430/549

[58] Field of Search ..... 430/503, 558, 430/557, 553, 543, 549

[56] References Cited

U.S. PATENT DOCUMENTS

| | | | |
|---|---|---|---|
| 4,992,360 | 2/1991 | Tsuruata et al. | 430/557 |
| 5,023,169 | 6/1991 | Hirabayashi et al. | 430/557 |
| 5,258,271 | 11/1993 | Haijima et al. | 430/557 |
| 5,273,868 | 12/1993 | Sakurazawa et al. | 430/557 |

FOREIGN PATENT DOCUMENTS

| | | |
|---|---|---|
| 0571959 | 12/1993 | European Pat. Off. . |
| 50-132926 | 10/1975 | Japan . |
| 2296241 | 12/1990 | Japan . |
| 6-11808 | 1/1994 | Japan . |

*Primary Examiner*—Geraldine Letscher
*Attorney, Agent, or Firm*—Birch, Stewart, Kolasch & Birch, LLP

[57] ABSTRACT

A silver halide color photographic light-sensitive material is disclosed which comprises a support having thereon, in any order, at least one yellow generating light-sensitive silver halide emulsion layer, at least one magenta generating light-sensitive silver halide emulsion layer, and at least one cyan generating light-sensitive silver halide emulsion layer, wherein at least one of the magenta generating light-sensitive silver halide emulsion layer contains at least one dye-forming coupler represented by a specific formula (M-I), and at least one of the yellow generating light-sensitive silver halide emulsion layer contains at least one dye-forming coupler represented by a specific forrmula (Y-I). This material can be used, for example, as a material suitable for quick developing material.

(M-I)

(Y-I)

20 Claims, No Drawings

SILVER HALIDE COLOR PHOTOGRAPHIC LIGHT-SENSITIVE MATERIAL

BACKGROUND OF THE INVENTION

1. Field of the Invention

The present invention relates to a silver halide color photographic light-sensitive material, and particularly, to material having an excellent color developable property, a color reproducing property, and an improved finishing stability against variation in the compositions of processing solutions. The present invention also relates to a method for forming color images with such a silver halide color photographic light-sensitive material.

2. Description of the Related Art

In the most common method for forming color images by using a silver halide color photographic light-sensitive material, silver halides are exposed to function as an oxidizing agent, and then an aromatic primary amine color developing agent oxidized by the oxidizing agent and a coupler are reacted to form dyes such as indophenol, indoaniline, indamine, azomethine, phenoxazine, and phenazine. In this method, color images are reproduced by a substrative color process wherein three kinds off dyes for yellow, magenta and cyan are generated In different amounts to form color images.

Conventionally, a 5-pyrazolone coupler has been generally used as a magenta coupler. However, the 5-pyrazolone magenta coupler has a secondary absorbing band in the vicinity of 430 nm. Thus, it has a problem of insufficient color reproduction. To improve color reproduction, pyrazoloazole couplers having an excellent absorbing property have been developed to improve color reproducing properties. For example, the 1H-pyrazolo[5,1-c]-1,2,4-triazole magenta coupler disclosed in U.S. Pat. No. 3,725,067,and the 1H-pyrazolo[1,5-b]-1,2,4-triazole magenta coupler disclosed in JP-B-2-44,051 have excellent absorbing properties. Among them, the 1H-pyrazolo[1,5-b]-1,2,4-triazole magenta is excellent in a color developable property, and fastness of dye images, as well. Especially, couplers wherein a branched alkyl group is introduced into a pyrazolotriazole ring, as described in JP-A-61-65,245 and U.S. Pat. No. 4,882,266, are couplers having improved stability against variable factors in processing, and improved fastness of color images. However, the couplers still have a problem of an unsatisfactory color developable property. The 1H-pyrazolo[1,5-b]-1,2,4-triazole magenta coupler having both of a branched alkyl group at 6- position and a phenyl group at 2-position, which is described in EP-0,571,959 A2,is an excellent coupler having an improved color developable property. However, this coupler has a drawback that, especially when subjected to a quick processing, a tint of magenta is migrated into yellow images, resulting in increased color amalgamation.

Meanwhile, as yellow couplers, a pivaloyl coupler and a benzoyl coupler have been conventionally used. Although the pivaloyl coupler provides excellent image fastness, it has the problems that the molecular extinction coefficient of generated dye molecules is small and that it has low activity as a coupler. Accordingly, a larger amount of the coupler must be used,and thus problem of cost occurs. Also, it is difficult to make a yellow color developable layer thinner. Thus, quicker processing, and reduction of replenishing liquids cannot be achieved.

To increase the extinction coefficient of a dye molecule to be generated, an acylacetoanilide coupler having a cyclic acyl group having 3–5 members (EP-0,447,969 A1), and a marondianilide coupler having a cyclic structure (EP-0,482,552 A1) have been proposed. Also, many attempts have been made to increase activity of couplers. One of the attempts is to increase activity of a coupler by increasing hydrophilicity of the coupler. For example, JP-A-50-132,926, JP-A-62-206,549, and JP-A-63-291,056 disclose couplers into which oxazolidine-2,4-dione-3-yl, or 1,2,4-triazolidine-3,5-dione-4-yl is introduced as a removable group. Also, JP-A-3-126,939, JP-A-3-126,940, and JP-A-3- 126,941 disclose couplers into which imidazolidine-2,4-dion-3-yl is introduced. Meanwhile, studies have been made of yellow couplers to improve an absorption property of generated dyes so as to improve a color reproducing property. The above-mentioned acylacetoanilide coupler having a cyclic acyl group having 3–5 members and the marondianilide coupler having a cyclic configuration are also excellent in the absorption property of dyes. To improve the hue of pivaloyl couplers, the methods have been proposed in which a specific group such as an alkoxy group is introduced into the ortho-position of an anilide ring, as described in JP-A-52-115,219 and JP-A-63-123,047. Also, it has been attempted to improve the color developable property of those couplers, as described in JP-A-3-125,140,JP-A-3-125,141, and JP-A-6-11,808. The color developable property can be improved by increasing hydrohilicity. However, it will increase interaction with a silver halide emulsion agent. Thus, when the light-sensitive material is used after storage for a long period of time, or it is processed with processing solutions whose compositions have been varied, fogging and variation in the gradation occur, bringing new problems. Also, the degree of color amalgamation (wherein a tint of yellow is introduced into magenta images) during processing increases depending on the types of magenta couplers. Especially, when the processing temperature, the concentration of a developing agent and/or pH of a color developing solution is increased, and/or the layers of a light-sensitive material is made thinner for quicker processing, the above-described problems become more serious.

SUMMARY OF THE INVENTION

Accordingly, a first object of the present invention is to provide a silver halide color photographic light-sensitive material providing excellent color reproducing properties by using a 1H-pyrazolo[1,5-b]-1,2,4-triazole magenta coupler having an excellent hue and by preventing color amalgamation due to processing.

A second object of the present invention is to provide a silver halide color photographic light-sensitive material which can maintain its stable photographic properties even after storage for a prolonged period time.

A third object of the present invention is to provide a silver halide color photographic light-sensitive material which is suitable for quicker developing processing.

A fourth object of the present invention is to provide a silver halide color photographic light-sensitive material, whose photographic properties do not deteriorate even when the layers of the light-sensitive material are made thinner.

Also, a further object of the present invention is to provide a method for forming color images with the above-described light-sensitive material.

The above-described objects have been accomplished by silver halide color photographic light-sensitive material and method for forming images with the light-sensitive material, according to the present invention.

The main aspects of the invention are as follows:

[1]. A silver halide color photographic light-sensitive material comprising a support having thereon, in any order, at least one yellow color developable light-sensitive silver halide emulsion layer, at least one magenta color developable light-sensitive silver halide emulsion layer, and at least one cyan color developable light-sensitive silver halide emulsion layer, wherein each of these emulsion layers has a different light-sensitive wavelength region, and wherein at least one of the magenta color developable light-sensitive silver halide emulsion layer contains at least one dye-forming coupler represented by formula (M-I), and at least one of the yellow color developable light-sensitive silver halide emulsion layer contains at least one dye-forming coupler represented by formula (Y-I),

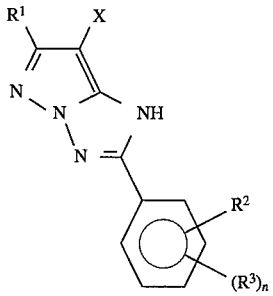

(M-I)

wherein $R^1$ is a group represented by the following formula (Q-1), (Q-2) or (Q-3):

$$-C(R^4)(R^5)-R^6 \quad \text{(Q-1)}$$

wherein $R^4$ is an alkyl, cycloalkyl, aryl or heterocyclic group, $R^5$ and $R^6$ are independently substituents, and $R^4$, $R^5$ and $R^6$ may be linked to each other to form a single ring having 5–7 members or a condensed ring having 5–7 members, $$-CH(R^7)-R^8 \quad \text{(Q-2)}$$

wherein $R^7$ is an alkyl, cycloalkyl, aryl or heterocyclic group, $R^8$ represents a substituent, and $R^7$ and $R^8$ may be linked to each other to form a single ring having 5–7 members or a condensed ring having 5–7 members,

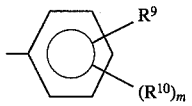

(Q-3)

wherein $R^9$ and $R^{10}$ are independently substituents, and m is an integer of 0–4, provided that a plurality of $R^{10}$ may be the same or different when m is not less than 2, $R^2$ and $R^3$ are independently substituents, n is an integer of 0–4, and X is a halogen atom or a group which is removable by a coupling reaction with an oxidized developing agent,

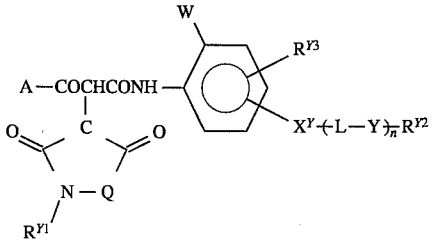

(Y-I)

wherein A is a tertiary alkyl, tertiary cycloalkyl, or indolinyl group, W is a halogen atom, an alkoxy, aryloxy, or alkyl group, $X^Y$ is a group $-NR^{Y11}CO-$ or $-NR^{Y11}SO_2$, L is an alkylene group, Y is a divalent group selected from the group consisting of —O—, —COO—, $-SO_2$ and $-PO(OR^{Y12})O-$, n is 0 or 1, and Q is a divalent group selected from the group consisting of $-CR^{Y4}R^{Y5}$, $-NR^{Y6}-$ and —CO—, wherein $R^{Y1}$ and $R^{Y6}$ are independently hydrogen atoms or alkyl groups, $R^{Y2}$ is an alkyl, cycloalkyl or aryl group, $R^{Y3}$ is a hydrogen atom or a monovalent group which may be substituted on a benzene ring, $R^{Y11}$ and $R^{Y12}$ are alkyl, cycloalkyl or aryl groups, $R^{Y4}$ and $R^{Y5}$ are independently hydrogen atoms, alkyl or alkoxy groups, provided that the total number of carbon atoms in the groups $R^{Y1}$, $R^{Y4}$, $R^{Y5}$ and $R^{Y6}$ is not greater than 4.

[2]. The silver halide color photographic light-sensitive material according to [1], wherein $R^1$ in formula (M-I) is a group represented by one of formulae (Q-1) and (Q-3).

[3]. The silver halide color photographic light-sensitive material according to [1], wherein the dye-forming coupler represented by formula (M-I) is a coupler represented by formula (M-II):

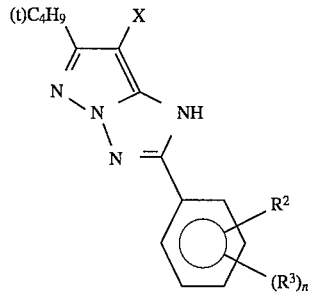

(M-II)

wherein $R^2$, $R^3$, n and X have the same meanings as defined in formula (M-I) in claim 1.

[4]. The silver halide color photographic light-sensitive material according to [1], wherein $R^{Y1}$ in formula (Y-1) is a hydrogen atom, and Q is a methylene group.

[5]. The silver halide color photographic light-sensitive material according to [1], wherein $R^{Y1}$ in formula (Y-I) is hydrogen.

[6]. The silver halide color photographic light-sensitive material according to [1], wherein n is 0,$R^{Y2}$ is a linear alkyl group, and X is a group $-NR^{Y11}CO-$, in formula (Y-I).

[7]. The silver halide color photographic light-sensitive material according to [1], wherein the cyan generating sensitive silver halide emulsion layer contains a dye-forming coupler represented by formula (C-I),

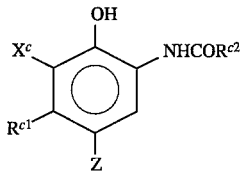

(C-I)

wherein $R^{C1}$ is an alkyl group having 2–4 carbon atoms, $R^{C2}$ is a linear or branched alkyl group having 11–31 carbon atoms, $X^c$ is a hydrogen atom or a group which may be substituted on a benzene ring, and Z is a group which is removable by a coupling reaction with an oxidized developing agent.

[8]. The silver halide color photographic light-sensitive material according to [1], wherein gelatin is used and the total amount of gelatin is not greater than 7.2 g/m$^2$.

[9]. A method for forming a color image, comprising:

exposing the silver halide color photographic light-sensitive material according to [1] in a scanning exposure manner in which each picture element is exposed for a time shorter than $10^{-4}$ seconds, and color developing the silver halide color photographic light-sensitive material.

DETAILED DESCRIPTION OF THE INVENTION AND PREFERRED EMBODIMENTS

First, the compound represented by formula (M-I) will be described in detail.

As described above, $R^1$ is selected from the group consisting of formulae (Q-1), (Q-2) and (Q-3).

Preferred examples of $R^2$ include alkyl (preferably, C1–C32 [The symbol "Cp–Cq" means having p-q carbon atoms.] linear or branched alkyl such as methyl, ethyl, propyl, isopropyl, butyl, t-butyl, 1-octyl and tridecyl), cycloalkyl (preferably, C3–C32 cycloalkyl such as cyclopropyl, cyclopentyl and cyclohexyl), alkenyl (preferably, C2–C32 alkenyl such as vinyl, allyl and 3-butene-1-yl), aryl (preferably, C6–C32 aryl such as phenyl, 1-naphthyl and 2-naphthyl), a heterocyclic ring (preferably, C1–C32 heterocyclic rings having 5–8 members such as 2-thienyl, 4-pyridyl, 2-furyl, 2-pyrimidinyl, 1-pyridyl, 2-benzothiazolyl, 1-imidazolyl, 1-pyrazolyl and benzotriazol-2-yl), cyano, a halogen atom (such as fluorine, chlorine and bromine), hydroxyl, nitro, carboxyl, alkoxy (preferably, C1–C32 alkoxy such as methoxy, ethoxy, 1-butoxy, 2-butoxy, isopropoxy, t-butoxy and dodecyloxy), cycloalkyloxy (preferably, C3–C32 cycloalkyloxy such as cyclopentyloxy and cyclohexyloxy), aryloxy (preferably, C6–C32 aryloxy such as phenoxy and 2-naphthoxy), heterocyclic oxy (preferably C1–C32 heterocyclic oxy such as 1-phenyltetrazol-5-oxy, 2-tetrahydropyranyloxy and 2-furiloxy), silyloxy (preferably, C1–C32 silyloxy such as trimethylsilyloxy, t-butyl dimethylsilyloxy and diphenyl methylsilyloxy), acyloxy (preferably, C2–C32 acyloxy such as acetoxy, pivaloyloxy, benzoyloxy and dodecanoyloxy), alkoxycarbonyloxy (preferably, C2–C32 alkoxycarbonyloxy such as ethoxycarbonyloxy and t-butoxycarbonyloxy), cycloalkyloxycarbonyloxy (preferably, C4–32 cycloalkyloxycarbonyloxy such as cyclohexyloxycarbonyloxy), aryloxycarbonyloxy (preferably, C7–C32 aryloxycarbonyloxy such as phenoxycarbonyloxy), carbamoyloxy (preferably, C1–C32 carbamoyloxy such as N,N-dimethylcarbamoyloxy and N-butylcarbamoyloxy), sulfamoyloxy (preferably, C1–C32 sulfamoyloxy such as N,N-diethylsulfamoyloxy and N-propylsulfamoyloxy), alkanesulfonyloxy (preferably, C1–C32 alkanesulfonyloxy such as methanesulfonyloxy and hexadecanesulfonyloxy), allenesulfonyloxy (preferably, C6–C32 allenesulfonyloxy such as benzenesulfonyloxy), acyl (preferably, C1–C32 acyl such as formyl, acetyl, pivaloyl, benzoyl and tetradecanoyl), alkoxycarbonyl (preferably, C2–C32 alkoxycarbonyl such as methoxycarbonyl, ethoxycarbonyl and octadecyloxycarbonyl), cycloalkyloxycarbonyl (preferably, C2–C32 cycloalkyloxycarbonyl such as cyclohexyloxycarbonyl), aryloxycarbonyl (preferably, C7–C32 aryloxycarbonyl such as phenoxycarbonyl), carbamoyl (preferably, C1–C32 carbamoyl such as carbamoyl, N,N-dibutylcarbamoyl, N-ethyl-N-octylcarbamoyl and N-propylcarbamoyl), amino (preferably, amino groups having 32 or less carbon atoms such as amino, methylamino, N,N-dioctylamino, tetradecylamino and octadecylamino), anilino (preferably, C6–C32 anilino such as anilino and N-methylanilino), heterocyclic amino (preferably, C1–C32 heterocyclic amino such as 4-pyridyl amino), carbonamide (preferably, C2–C32 carbonamide such as acetamide, benzamide and tetradecanamide), ureido (preferably, C1–C32 ureido such as ureido, N,N-dimethyl ureido, N-phenylureido), imide (preferably, imide groups having 10 or less carbon atoms such as N-succinimide and N-phthalimide), alkoxycarbonylamino (preferably, C2–C32 alkoxycarbonylamino such as methoxycarbonylamino, ethoxycarbonylamino, t-butoxycarbonylamino, and octadecyloxycarbonylamino), aryloxycarbonylamino (preferably, C7–C32 aryloxycarbonylamino such as phenoxycarbonylamino), sulfonamide (preferably, C1–C32 sulfonamide such as methanesulfonamide, butanesulfonamide, benzenesulfonamide and hexadecanesulfonamide), sulfamoylamino (preferably, C1–C32 sulfamoylamino such as N,N-dipropylsulfamoylamino, N-ethyl-N-dodecylsulfamoylamino), azo (preferably, C1–C32 azo such as phenylazo), alkylthio (preferably, C1–C32 alkylthio such as ethylthio and octylthio), arylthio (preferably, C6–C32 arylthio such as phenylthio), heterocyclic thio (preferably, C1–C32 heterocyclic thio such as 2-benzothiazolylthio, 2-pyridylthio and 1-phenyltetrazolylthio), alkylsufinyl (preferably, C1–C32 alkylsulfinyl such as dodecanesulfinyl), arylsulfinyl (preferably, C6–C32 arylsulfinyl such as benzenesulfinyl), alkanesulfonyl (preferably, C1–C32 alkanesulfonyl such as methanesulfonyl and octanesulfonyl), arylsulfonyl (preferably, C6–C32 arylsulfonyl such as benzenesulfonyl and 1-naphthalenesulfonyl), sulfamoyl (preferably, sulfamoyl groups having 32 or less carbon atoms such as sulfamoyl, N,N-dipropylsulfamoyl, N-ethyl-N-dodecylsulfamoyl), sulfo, and phosphonyl groups (preferably, C1–C32 phosphonyl such as phenoxyphosphonyl, octyloxyphosphonyl and phenylphosphonyl).

$R^3$ represents the same groups as defined by $R^2$.

In formula (Q-1), $R^4$ preferably represents a C1–C32 linear or branched alkyl or cycloalkyl, or C6–C32 aryl, or heterocyclic group. Specific examples of these groups are the same as those illustrated for the alkyl and aryl represented by $R^2$. $R^5$ and $R^6$ represent the same groups as defined by $R^2$. Two or more groups of $R^4$, $R^5$ and $R^6$ may be linked to each other to form a hydrocarbon ring or a heterocyclic ring (a single ring or a condensed ring) having 5–7 members.

In formula (Q-2), $R^7$ represents the same groups as defined by $R^4$ in formula (Q-1). $R^8$ represents the same groups as defined by $R^2$. $R^7$ and $R^8$ may be linked to each other to form a hydrocarbon ring or a heterocyclic ring (a single ring or a condensed ring) having 5–7 members.

In formula (Q-3), $R^9$ and $R^{10}$ represent the same groups as defined by $R^2$.

X represents a hydrogen atom, or a group which is removable upon a reaction with an oxidized developing agent. Specifically, X represents a halogen atom, an alkoxy, aryloxy, acyloxy, carbamoyloxy, sulfonyloxy, carbonamide, sulfonamide, carbamoylamino, heterocyclic, arylazo, alkylthio, arylthio, or heterocyclic thio group. The preferable scope and specific examples of these groups are identical to those described in relation to the groups defined by $R^2$. In some cases, X may be a bis-type coupler in which a bi-molecular 4 equivalent coupler is bound via aldehyde or ketone. Also, X may be a group suitable for use in photography such as a development accelerator, development inhibitor, silver removal accelerator or leuco dye, or a precursor thereof.

The groups represented by $R^1$, $R^2$, $R^3$, and X may have a substituent, examples of which include a halogen atom, and alkyl, cycloalkyl, alkenyl, aryl, heterocyclic, cyano, hydroxyl, nitro, alkoxy, aryloxy, heterocyclic oxy, silyloxy, acyloxy, alkoxycarbonyloxy, cycloalkyloxy-carbonyloxy, aryloxycarbonyloxy, carbamoyloxy, sulfamoyloxy, alkanesulfonyloxy, arylsulfonyloxy, carboxyl, acyl, alkoxycarbonyl, cycloalkyloxycarbonyl, aryloxycarbonyl, carbamoyl, amino, anilino, heterocyclic amino, carbonamide, alkoxycarbonylamino, aryloxycarbonylamino, ureido, sulfonamide, sulfamoylamino, imide, alkylthio, arylthio, heterocyclic thio, sulfinyl, sulfo, alkanesulfonyl, arylsulfonyl, sulfamoyl, and phosphonyl groups.

The compound represented by formula (M-I) may form a dimer, oligomers, or polymers, through substituent $R^1$, $R^2$, $R^3$, or X.

Hereafter, reference will be made to a particularly preferable range of the compounds represented by formula (M-I).

When $R^1$ is (Q-1), $R^4$ is preferably alkyl. $R^5$ and $R^6$ are preferably alkyl, cycloalkyl, aryl, hydroxyl, alkoxy, aryloxy, amino, anilino, carbonamide, ureido, sulfonamide, sulfamoylamino, imide, alkylthio, or arylthio groups. Among them, alkyl, cycloalkyl, and aryl are more preferable. Alkyl is most preferable.

When $R^1$ is formula (Q-2), $R^7$ is preferably an alkyl, cycloalkyl, or aryl group. More preferably, $R^7$ is secondary or tertiary alkyl, or cycloalkyl. $R^8$ is preferably alkyl, cycloalkyl, or aryl, with alkyl and cycloalkyl being more preferred.

When $R^1$ is formula (Q-3), $R^9$ and $R^{10}$ are preferably halogen atoms, alkyl, cycloalkyl, aryl, alkoxy, aryloxy, acyl, alkoxycarbonyl, cycloalkyloxycarbonyl, aryloxycarbonyl, carbamoyl, amino, anilino, carbonamide, alkoxycarbonylamino, aryloxycarbonylamino, ureido, sulfonamide, sulfamoylamino, imide, alkylthio, arylthio, heterocyclic thio, sulfinyl, alkanesulfonyl, arylsulfonyl, sulfamoyl, or phosphonyl groups. Among them, more preferred are halogen atoms, alkyl, cycloalkyl, aryl, alkoxy, aryloxy, amino, anilino, carbonamide, ureido, sulfonamide, sulfamoylamino, alkylthio, and arylthio groups. Alkyl, cycloalkyl, aryl, alkoxy, aryloxy, alkylthio, and arylthio groups are most preferred. m is preferably in the range from 0 to 3.More preferably, m is 1 or 2.$R^9$ is preferably substituted at the ortho- position of phenyl.

$R^1$ is preferably a group represented by formula (Q-1) or (Q-3), among formulae (Q-1)–(Q-3). More preferably, $R^1$ is a group represented by formula (Q-1). Particularly, it is preferred that $R^4$, $R^5$, and $R^6$ in formula (Q-1) are alkyl. Most preferably, $R^1$ is t-butyl. Hereinafter, preferable examples of the group represented by $R^1$ are given, which should not be construed as limiting the present invention.

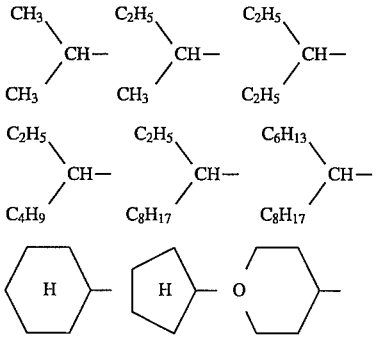

-continued

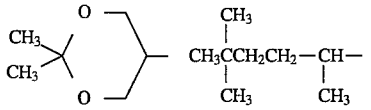

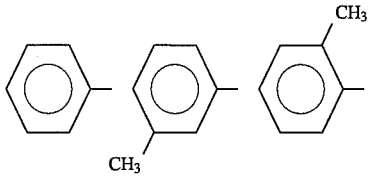

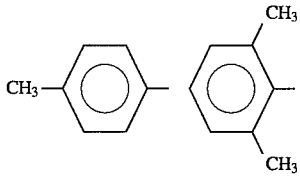

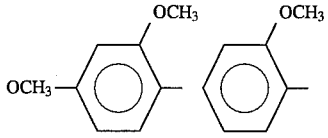

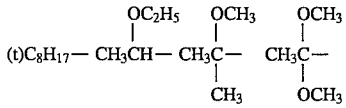

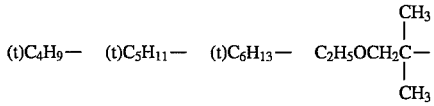

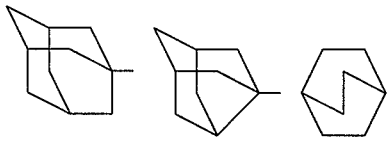

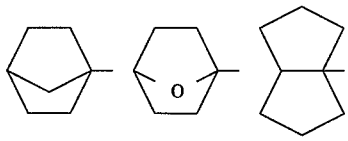

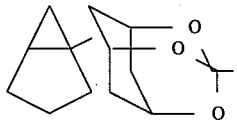

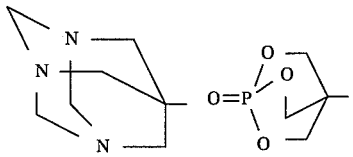

-continued

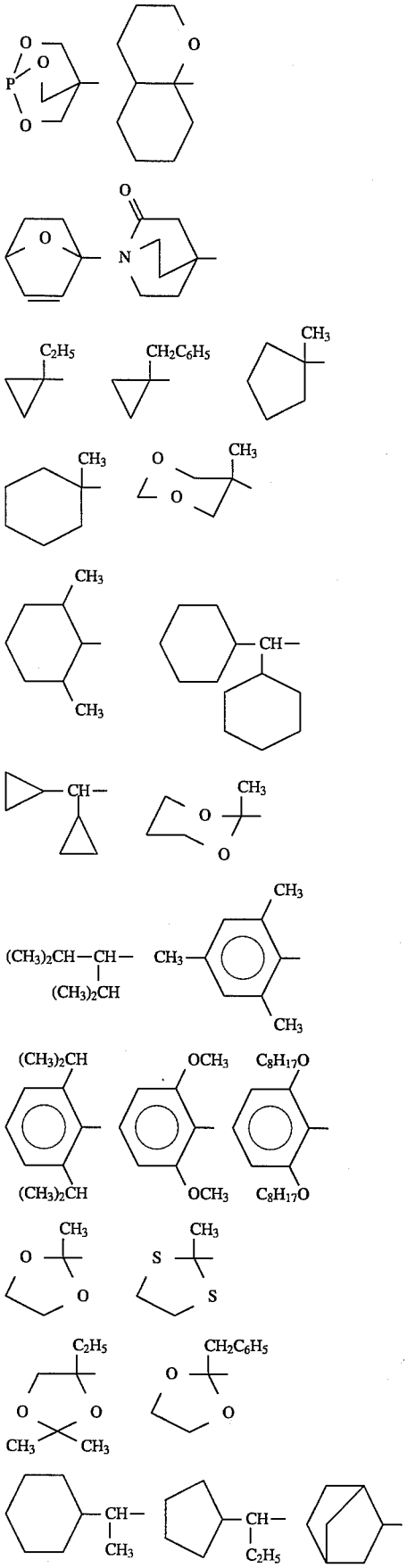

-continued

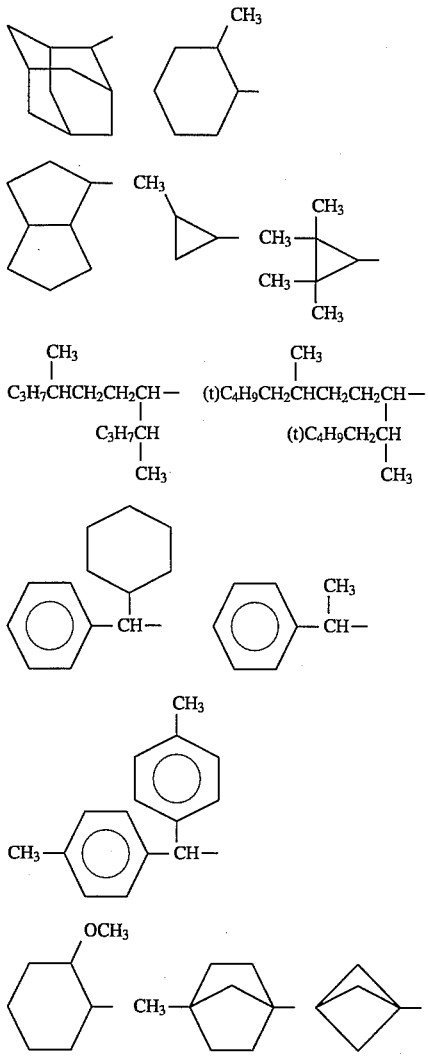

Preferred examples of $R^2$ include alkoxy, aryloxy, acyloxy, alkoxycarbonyloxy, cycloalkyloxycarbonyloxy, aryloxycarbonyloxy, carbamoyloxy, sulfamoyloxy, alkanesulfonyloxy, arylsulfonyloxy, acyl, alkoxycarbonyl, cycloalkyloxycarbonyl, aryloxycarbonyl, carbamoyl, amino, anilino, carbonamide, alkoxycarbonylamino, aryloxycarbonylamino, ureido, sulfonamide, sulfamoylamino, imide, alkylthio, arylthio, heterocyclic thio, alkanesulfonyl, arylsulfonyloxy, and sulfamoyl groups. Among them, more preferred are alkoxy, aryloxy, acyl, alkoxycarbonyl, cycloalkyloxy-carbonyl, aryloxycarbonyl, carbamoyl, amino, anilino, carbonamide, alkoxycarbonylamino, aryloxycarbonylamino, ureido, sulfonamide, sulfamoylamino, imide, alkylthio, arylthio, and sulfamoyl groups. $R^2$ is preferably substituted at a meta- or para- position with respect to the carbon atom which is linked to the pyrazolotriazole ring, with the para- position being more preferred.

Preferable examples of $R^3$ include fluorine, chlorine, bromine atoms, and alkyl, cycloalkyl, aryl, heterocyclic, cyano, hydroxyl, nitro, alkoxy, aryloxy, carboxyl, acyl, alkoxycarbonyl, cycloalkyloxycarbonyl, aryloxycarbonyl, carbamoyl, amino, anilino, carbonamide, alkoxycarbonylamino, aryloxycarbonylamino, ureido, sulfonamide, sulfamoylamino, imide, alkylthio, arylthio, heterocyclic thio, sulfinyl, sulfo, alkanesulfonyl, arylsulfonyloxy, sulfamoyl, and phosphonyl groups. n is preferably in the range from 0 to 3. More preferably, n is 0 or 1.

Preferable examples of X include hydrogen, chlorine, bromine atoms, and aryloxy, alkylthio, arylthio, heterocyclic thio, and heterocyclic groups. More preferably, X is chlorine or aryloxy, with chlorine being most preferred. Hereinafter, preferable examples of X will be given, which should not be construed as limiting the invention.

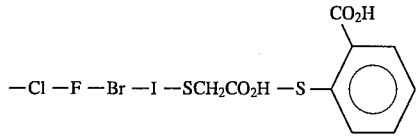

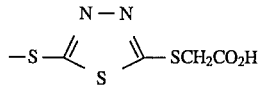

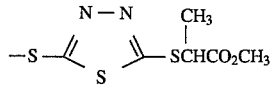

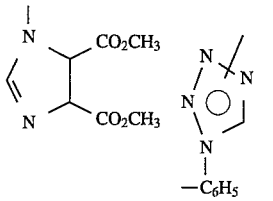

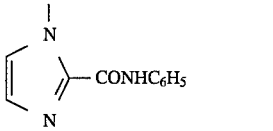

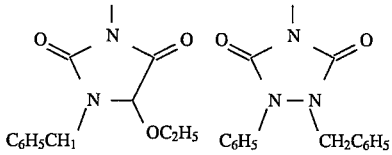

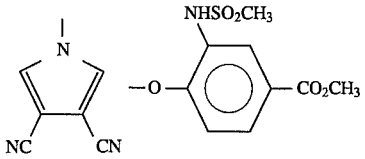

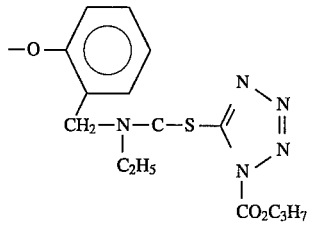

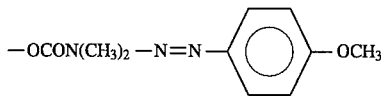

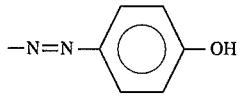

-continued

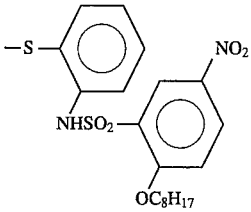

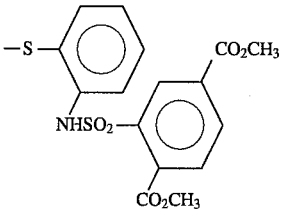

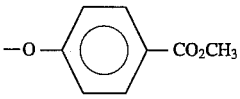

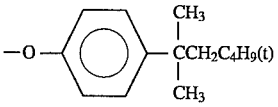

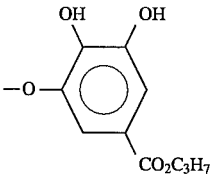

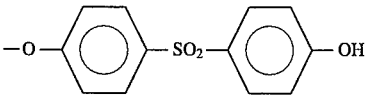

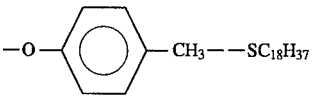

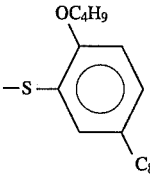

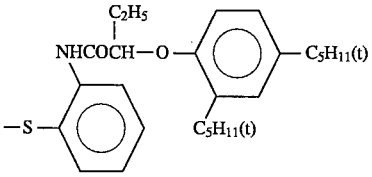

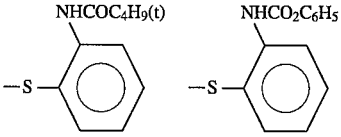

-continued

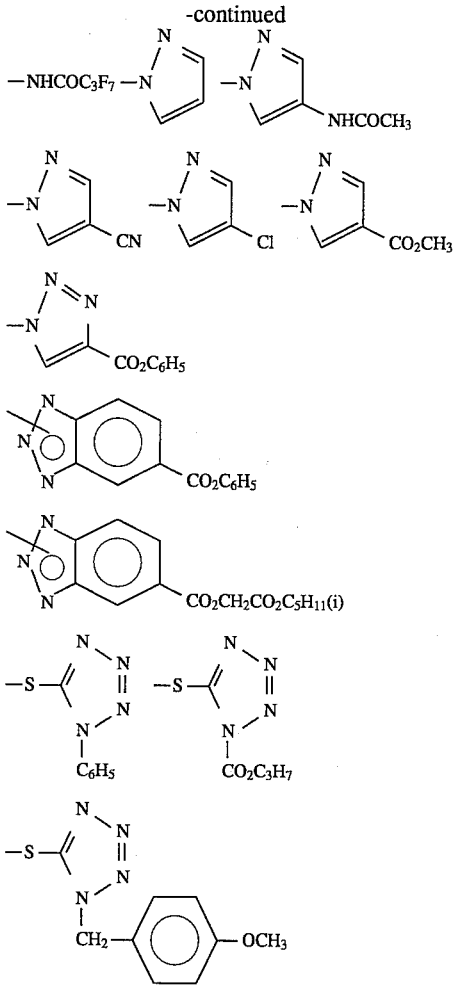

Among the compounds of (M-I), compounds represented by (M-II), and particularly compounds of formula (M-III), are preferred in view of advantageous effects of the present invention.

(M-II)

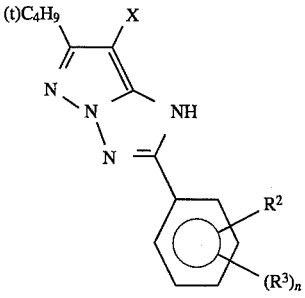

In formula (M-II), $R^2$, $R^3$, n and X have the same meanings as defined in formula (M-I).

(M-III)

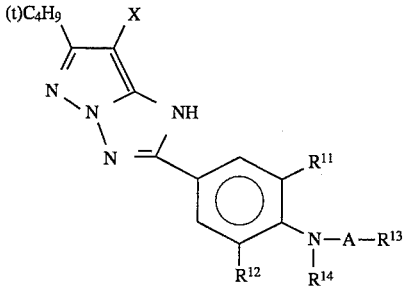

In formula (M-III), $R^{11}$ and $R^{12}$ are hydrogen atoms or substituents, A is —CO— or —$SO_2$, $R^{13}$ is an alkyl, aryl, alkoxy, alkylamino or anilino group, $R^{14}$ is a hydrogen atom, or an alkyl, aryl, acyl, alkanesulfonyl or arylsulfonyl group. X is a hydrogen atom or a group which is removable by a coupling reaction with a hydrogen atom or an oxidized developing agent. $R^{13}$ and $R^{14}$ may be linked to each other to form the same ring having 5–7 members as described above.

In formula (M-III), $R^{11}$ and $R^{12}$ are independently preferably hydrogen, fluorine, chlorine or bromine atoms, or alkyl, cycloalkyl, aryl, heterocyclic, cyano, hydroxyl, nitro, alkoxy, aryloxy, carboxyl, acyl, alkoxycarbonyl, cycloalkyloxycarbonyl, aryloxycarbonyl, carbamoyl, amino, anilino, carbonamide, alkoxycarbonylamino, aryloxycarbonylamino, ureido, sulfonamide, sulfamoylamino, imide, alkylthio, arylthio, heterocyclic thio, sulfinyl, sulfo, alkanesulfonyl, arylsulfonyloxy, sulfamoyl, or phosphonyl groups. $R^{13}$ is preferably an alkyl or aryl group. $R^{14}$ is preferably hydrogen or alkyl. A is preferably —CO—. X is preferably a hydrogen, chlorine, bromine atom, or an aryloxy, alkylthio, arylthio, heterocyclic thio, or heterocyclic group. More preferably, X is chlorine or aryloxy, with chlorine being most preferred.

Next, specific examples of the pyrazolotriazole magenta couplers represented by formula (M-I) which can be used in the present invention will be given, which should not be construed as limiting the invention.

M-1
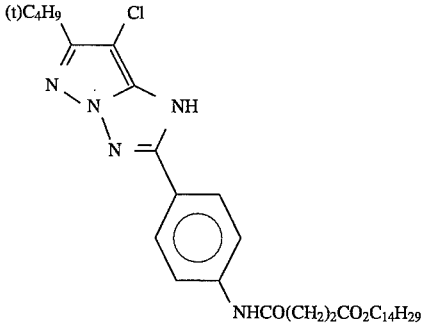
M-2
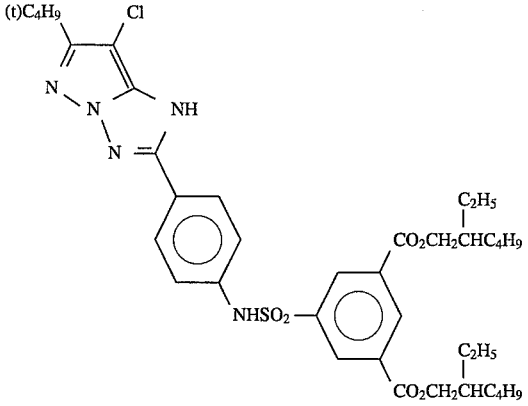
M-3
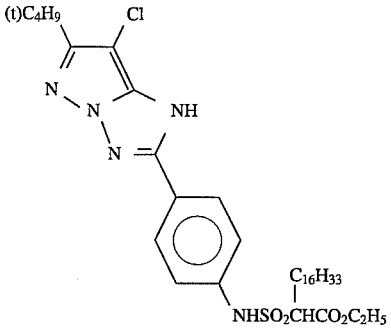
M-4
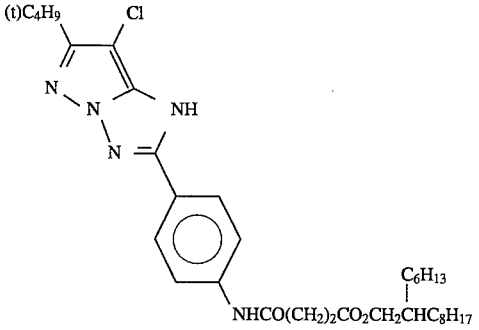

-continued
M-5
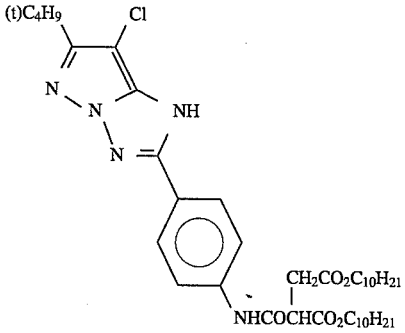
M-6
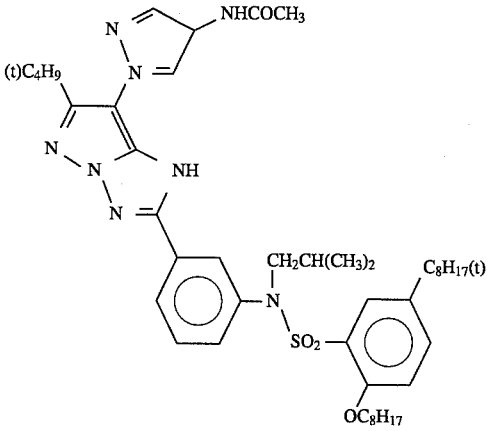
M-7
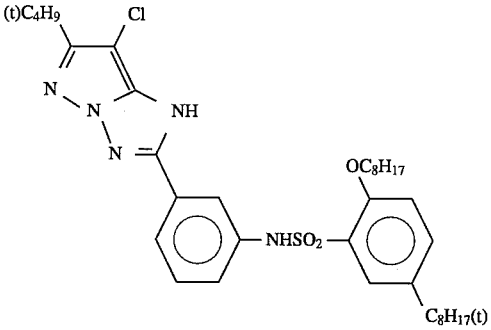
M-8
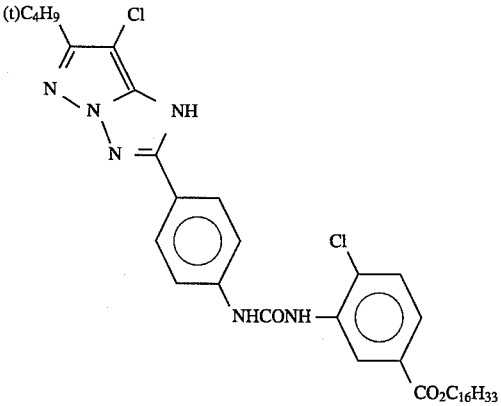

-continued
M-9
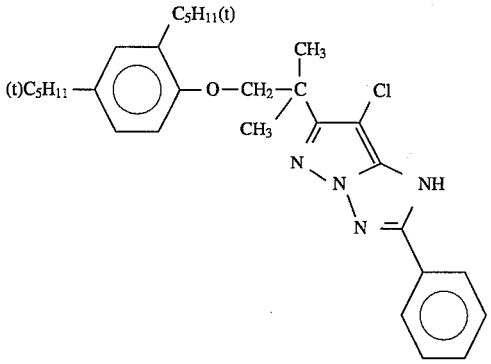
M-10
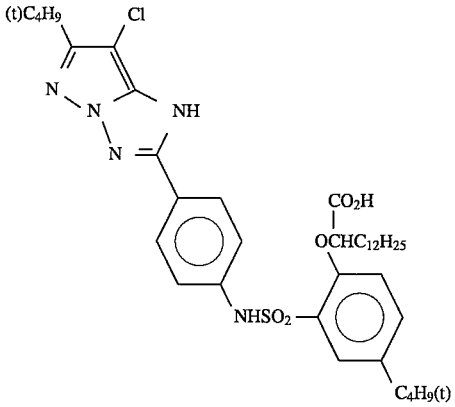
M-11
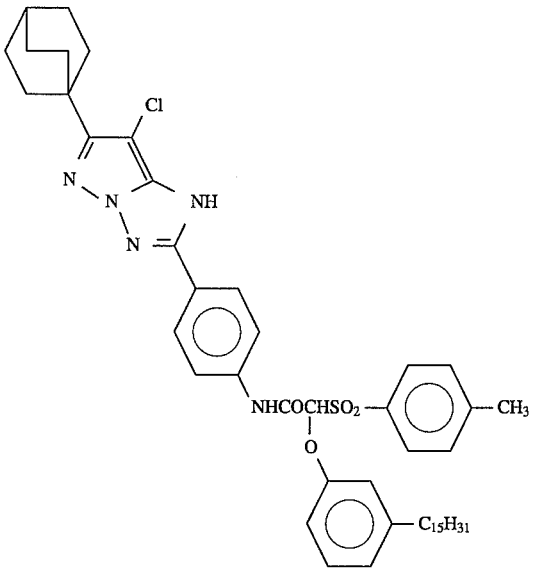
M-12
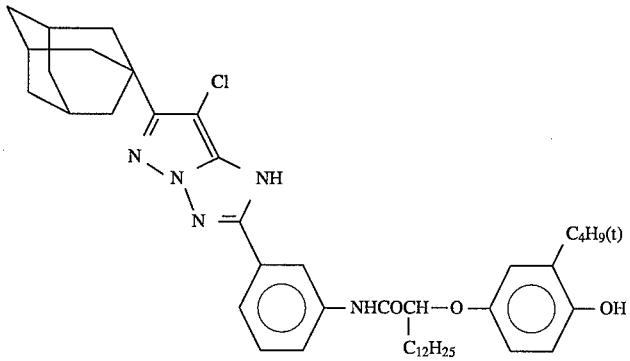

-continued
M-13
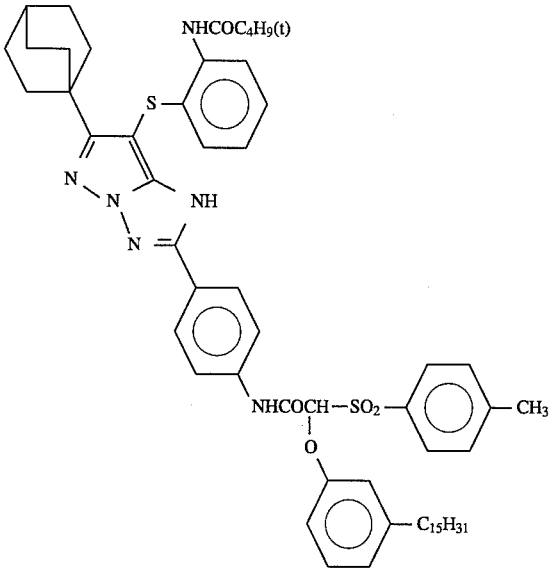
M-14
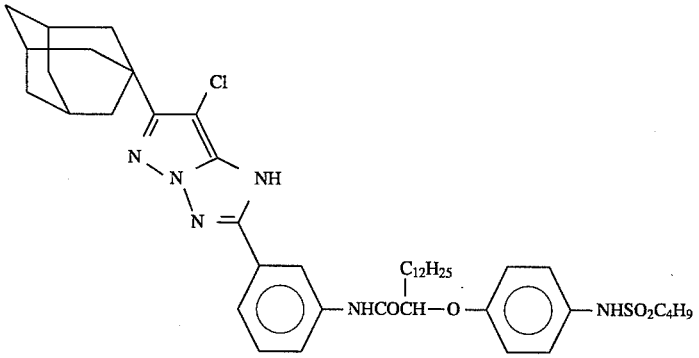
M-15
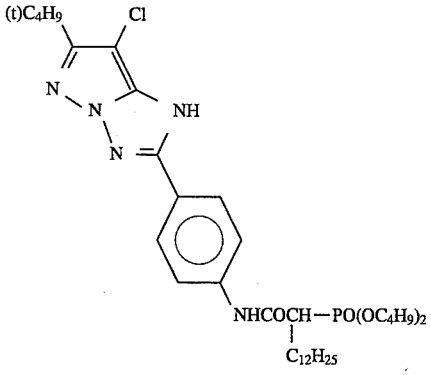

-continued
M-16
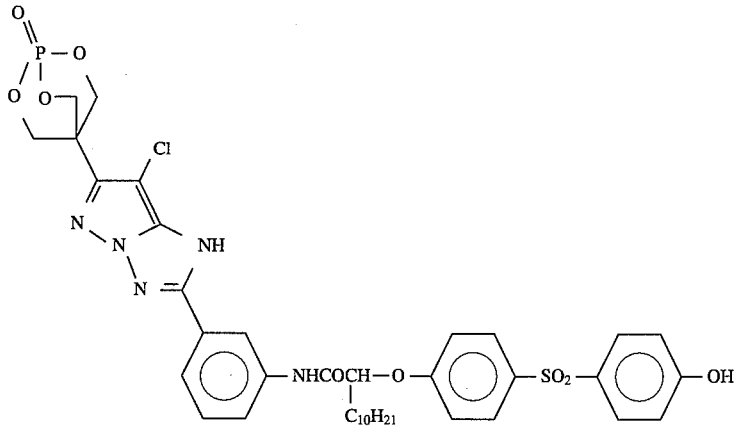
M-17
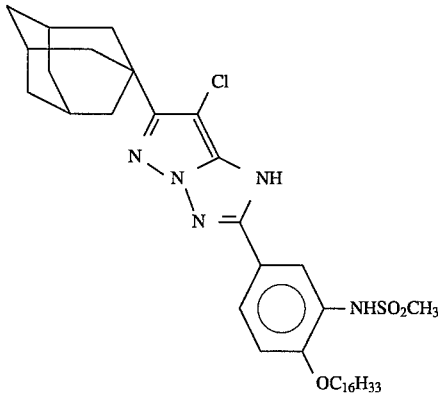
M-18
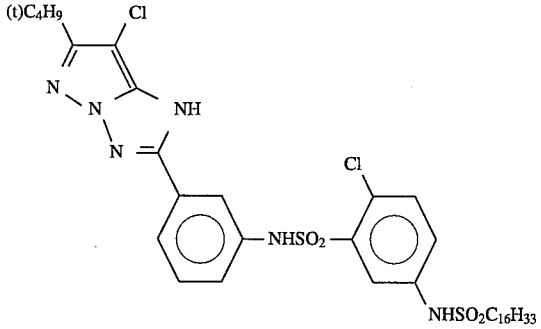
M-19
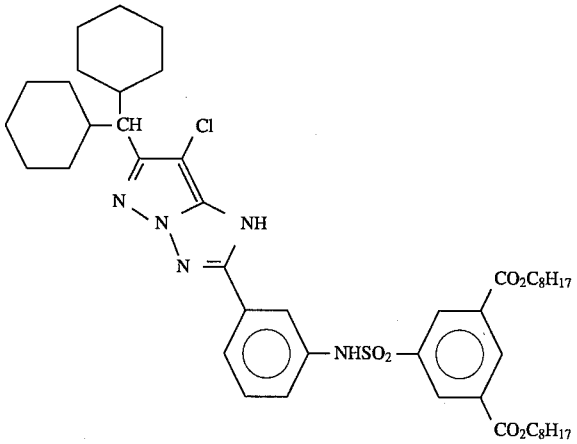

-continued
M-20
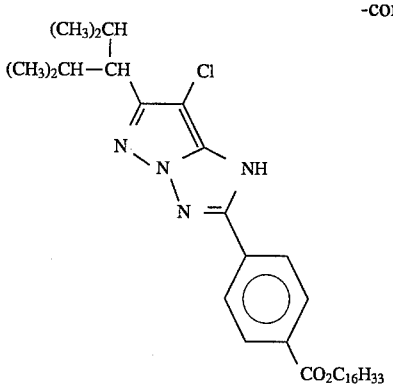
M-21
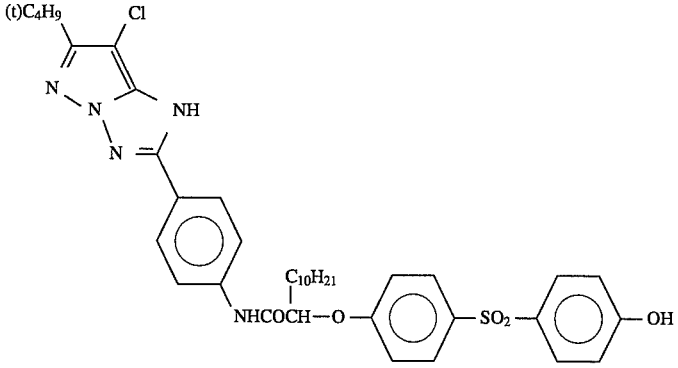
M-22
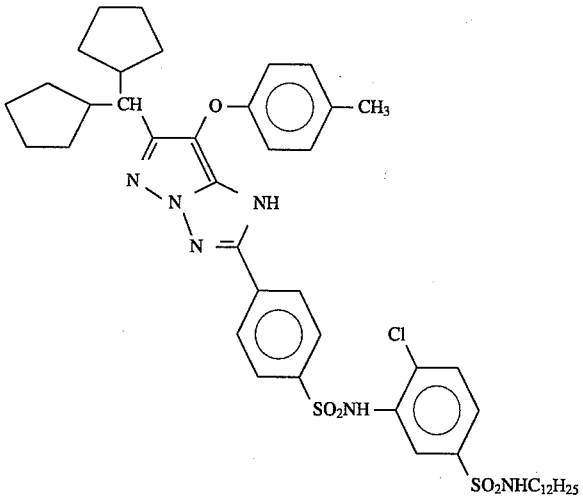
M-23
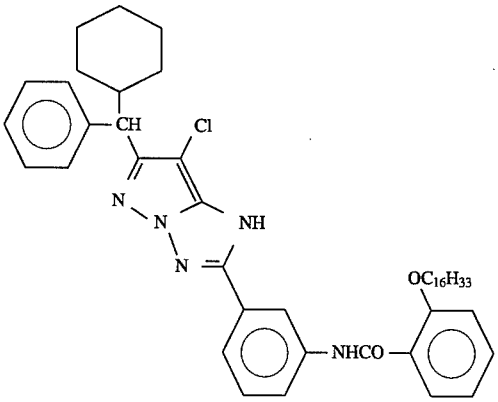

-continued
M-24
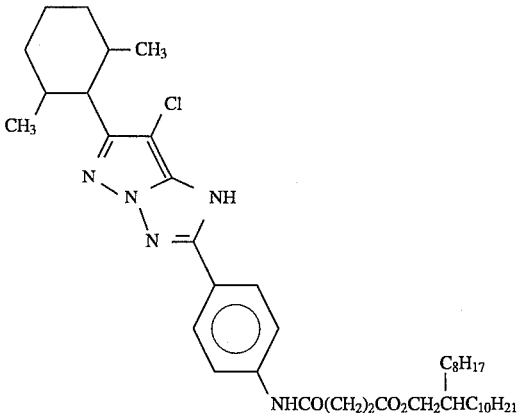
M-25
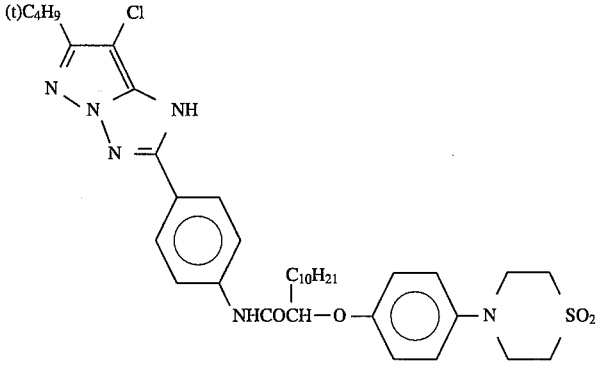
M-26
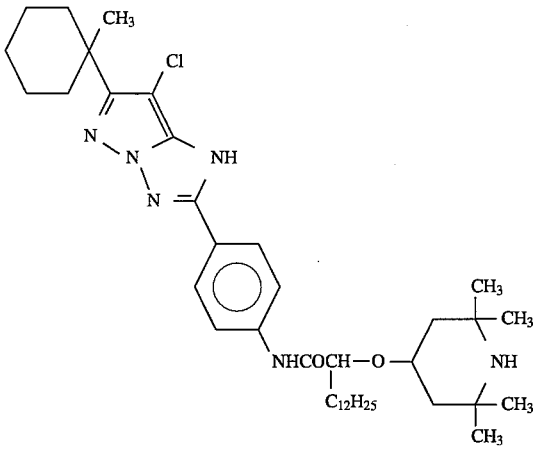
M-27
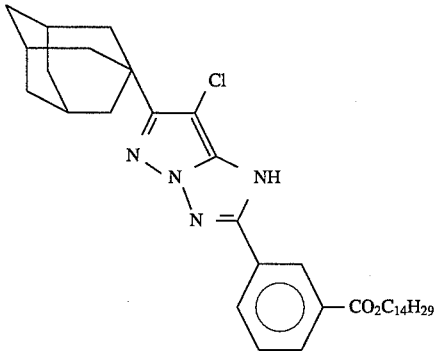

-continued
M-28
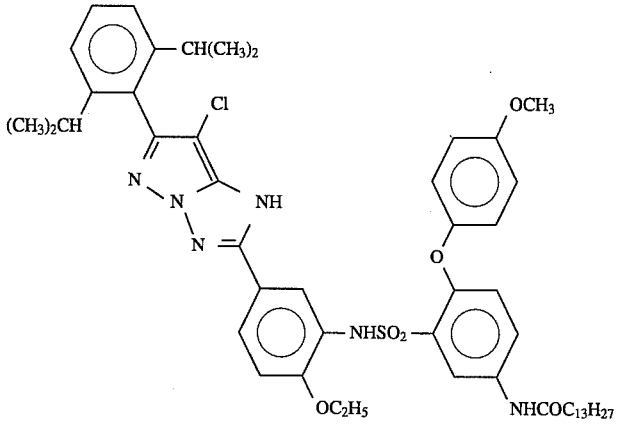
M-29
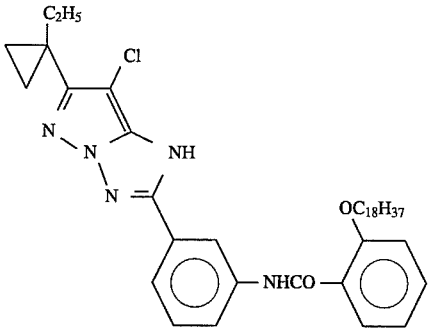
M-30
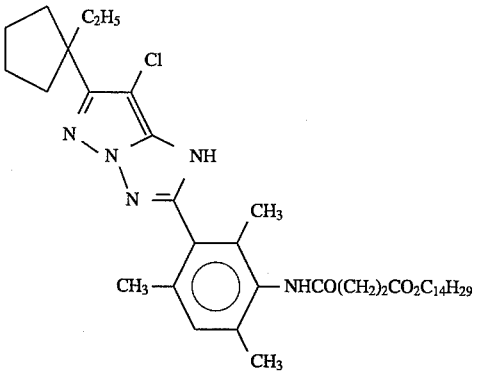
M-31
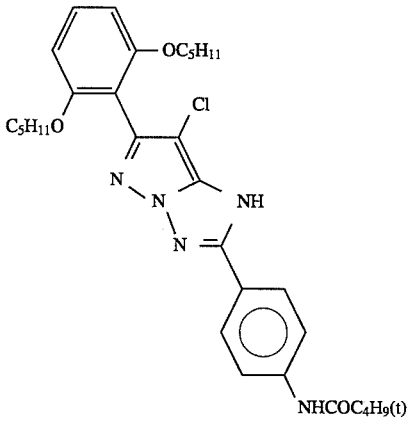

-continued
M-32
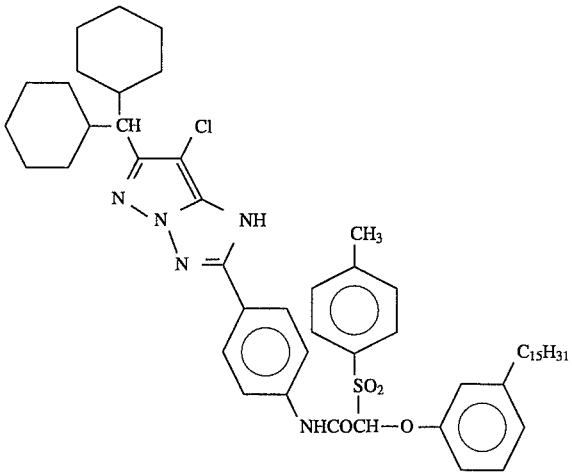
M-33
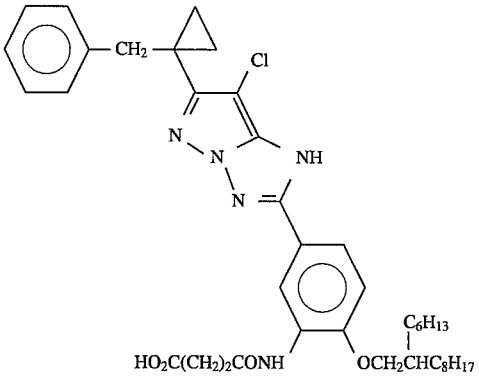
(M-34)
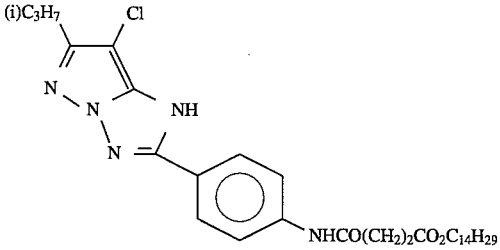
M-(35)
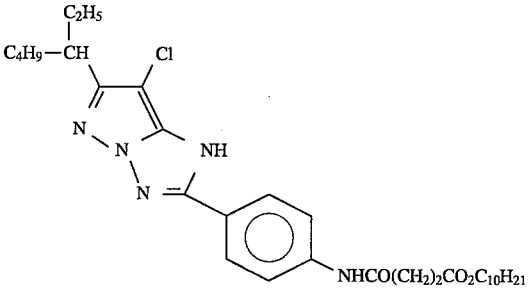

-continued
(M-36)
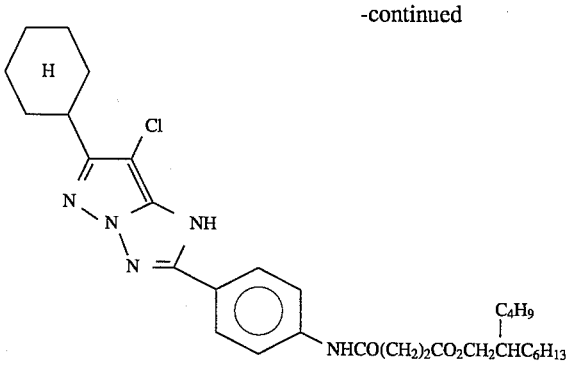
(M-37)
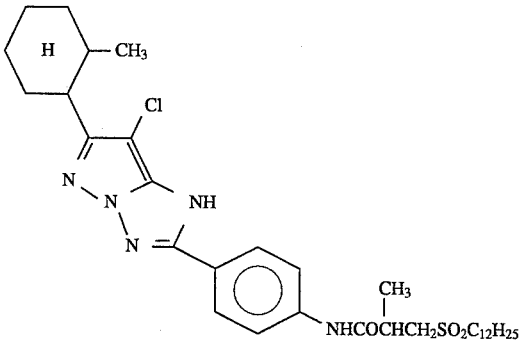
(M-38)
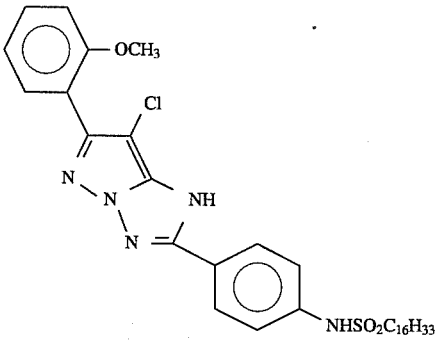
(M-39)
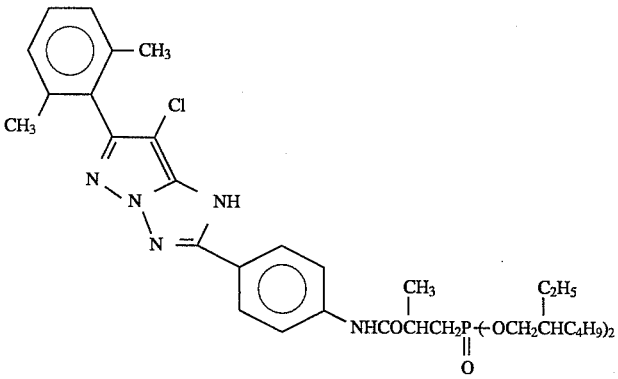
(M-40)
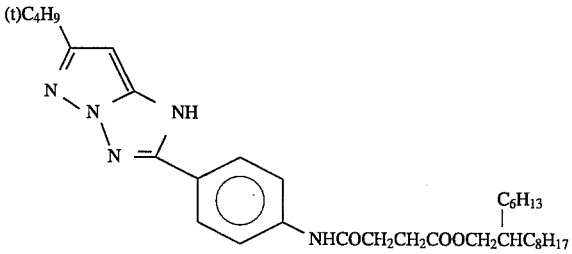

-continued
(M-41)
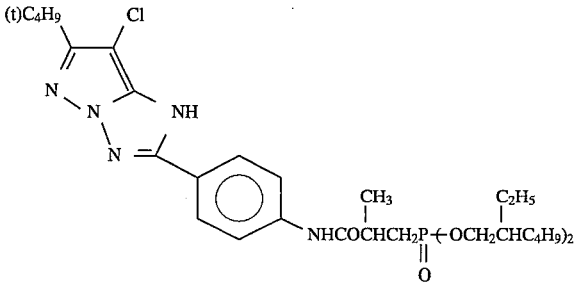
(M-42)
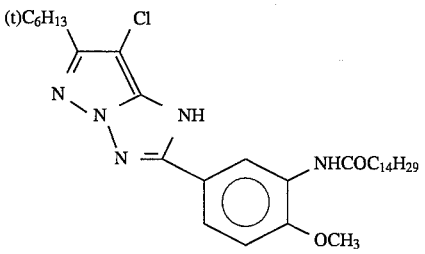
(M-43)
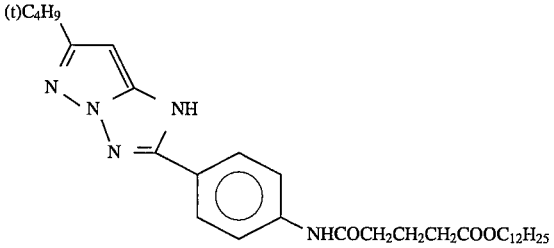
(M-44)
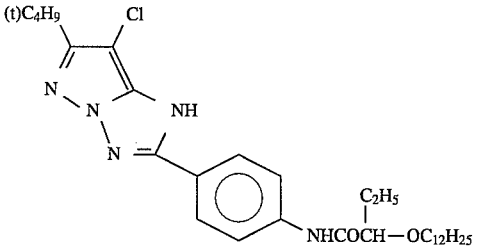
(M-45)
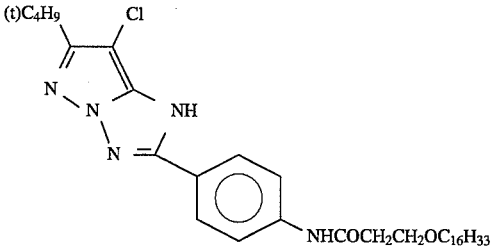
(M-46)
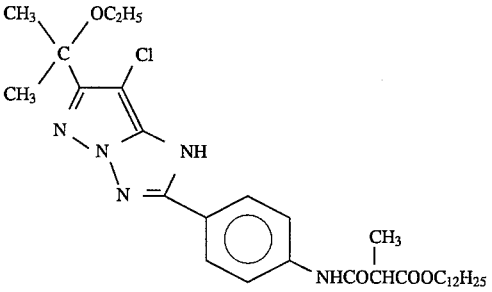

-continued

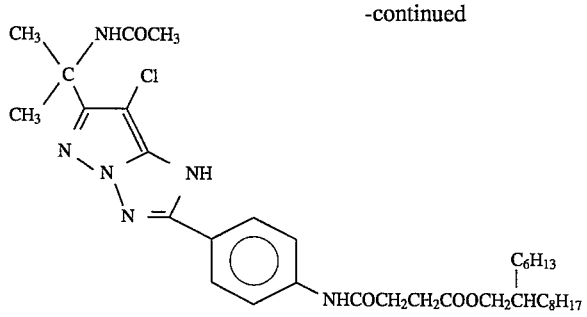

(M-47)

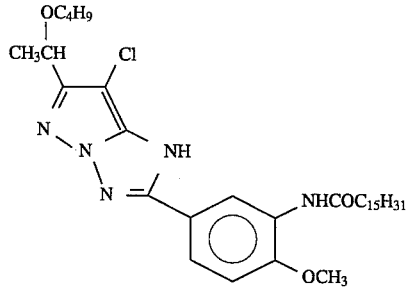

(M-48)

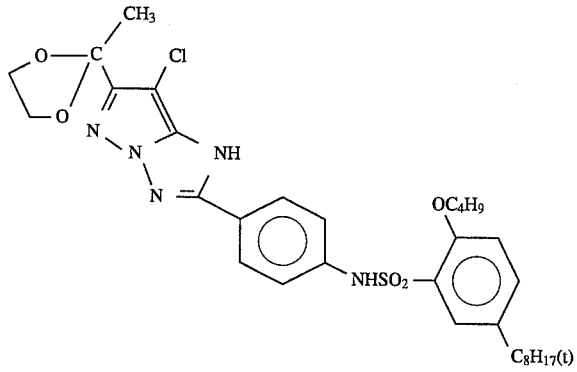

(M-49)

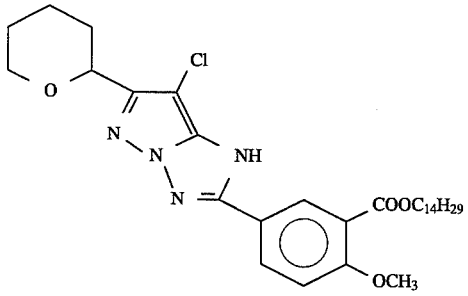

(M-50)

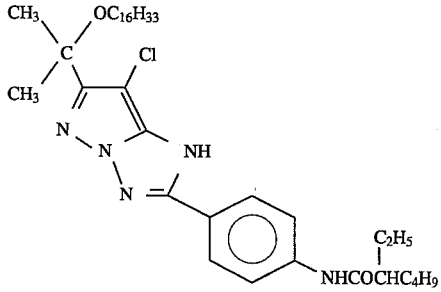

(M-51)

The coupler represented by formula (Y-I) will be described below.

A is a tertiary alkyl, tertiary cycloalkyl or an indolinyl group. When A is an tertiary alkyl group, it is preferably a tertiary alkyl having 4–20 carbon atoms. Examples thereof include t-butyl, t-amyl, t-hexyl, t-octyl and t-dodecyl. Among them, a tertiary alkyl group having 4–6 carbon atoms is more preferred. t-Butyl is most preferred.

When A is a tertiary cycloalkyl group, a cycloalkyl group having 4–20 carbon atoms is preferred. A bicyclo or tricyclo ring may be formed. Examples of such groups include 1-methylcyclohexyl, 1-ethylcyclopentyl, 1-methylcyclopropyl, 1-ethylcycloropyl, 1-benzylcyclopropyl, norbornyl, 2,2,2-bicyclooctyl, and adamantyl. Also, one or more hereto atoms of O, N, S, or P may be contained in the ring. Examples of such groups include 5-methyl-1,3-dioxane-5-yl, [2,2,5]-trimethyl-1,3-dioxane-5-yl, and 3-ethyloxolane-3-yl. More preferable examples of a tertiary cycloalkyl group include 1-alkylcyclopropane-1-yl, 1-alkylcyclopentane-1-yl, alkylcyclohexyane-1-yl, and 5-alkyl-1,3-dioxane-5-yl. Among them, 1-alkylcyclopropnne-1-yl are most preferred.

When A is an indolinyl group, the indoline ring is an indoline ring which has no substituent or has a substituent. Examples of the substituent include a halogen atom, and alkyl, alkoxy, acyl, alkoxycarbonyl, acylamino, carbamoyl, sulfamoyl, carbamoyl substituted by alkyl or aryl, cyano, amino, nitro, and sulfonyl groups.

Preferable examples of the substituent include fluorine, chlorine, bromine atoms, cyano and sulfonyl groups. Among them, an unsubstituted indolinyl group is particularly preferable as A.

W represents a halogen atom, an alkoxy, aryloxy, or alkyl group. Preferably, W is a chlorine atom, an alkoxy, or aryloxy group, with a chlorine atom being particularly preferred.

$X^Y$ is a group —$NR^{Y11}CO$— or a group —$NR^{Y11}SO2_2$, wherein $R^{Y11}$ is a hydrogen atom, or an alkyl or aryl group. Preferably, $R^{Y11}$ is a hydrogen atom and an alkyl group. When $R^{Y11}$ is an alkyl group, it is preferably an alkyl group having 1–20 carbon atoms, preferably 1–8 carbon atoms.

Most preferably, $X^Y$ is a group —NHCO—.

L is an alkylene group. A linear or branched alkylene group having 1–20 carbon atoms is preferred. A linear or branched alkylene group having 1–30 carbon atoms is more preferred.

Y is a divalent linking group selected from —O—, —COO—, F-$SO_2$ and —$PO(OR^{Y12})O$—, wherein $R^{Y12}$ is a substituted or unsubstituted alkyl, cycloalkyl, or aryl group.

n is an integer of 0 or 1. From the viewpoint of economy, n=0 is preferred. From the viewpoint of solubility of couplers, and stability of dispersed materials, n=1 is preferred. Especially, it is more preferred that Y is a group —O— or a group —$PO(OR^{Y12})O$—.

Q is a divalent group selected from —$CR^{Y4}R^{Y5}$—, —$NR^{Y6}$—, and —CO—, wherein $R^{Y4}$ and $R^{Y5}$ independently represent hydrogen atoms, alkyl, or alkoxy groups. Among them a hydrogen atom, an alkyl group having 3 or less carbon atoms, and an alkoxy group having 4 or less carbon atoms are preferred. $R^{Y6}$ represents a hydrogen atom or an alkyl group. An alkyl group having 4 or less carbon atoms is preferred.

Preferably, Q is the group —$CR^{Y4}R^{Y5}$.

$R^{Y1}$ represents a hydrogen atom or an alkyl group having 4 or less carbon atoms. When $R^{Y1}$ is an alkyl group, it is preferably an alkyl group having 3 or less carbon atoms, and particularly preferably a methyl group.

It is more preferred that $R^{Y1}$ is an hydrogen atom. In this case, it is preferred that $R^{Y4}$ and $R^{Y5}$ are both alkyl groups. Most preferably $R^{Y4}$ and $R^{Y5}$ are both methyl groups.

$R^{Y2}$ represents an alkyl group, a cycloalkyl group, or an aryl group. When $R^{Y2}$ is an alkyl group, $R^{Y2}$ is preferably a linear or branched alkyl group which has 1–33 carbon atoms, more preferably 9–33 carbon atoms, and particularly preferably 9–23 carbon atoms. From the viewpoint of color developable performance, $R^{Y2}$ is preferably a linear alkyl group having 11–19 carbon atoms. From the viewpoint of image fastness, it is more preferred that $R^{Y2}$ is a branched alkyl group having 13–23 carbon atoms.

When $R^{Y2}$ is a cycloalkyl group or an aryl group, it preferably has 6–22 carbon atoms, and may have a substituent on the ring. Preferable examples of the substituent include a halogen atom, an alkyl group and an alkoxy group.

When Y is a group —O—, it is preferred that $R^{Y2}$ is an aryl group. When Y is a group —$PO(OR^{Y12})O$—, it is preferred that $R^{Y2}$ is an alkyl group or a cycloalkyl group. Also, when Y is a group —$SO_2$— or a group —CO—, it is preferred that $R^{Y2}$ is a linear alkyl group.

$R^{Y3}$ represent a hydrogen atom or a monovalent group which can be substituted on a benzene ring. Examples of the group include a halogen atom, an alkyl group, an alkoxy group, a sulfonyl group, and a substituted or unsubstituted sulfamoyl group. $R^{Y3}$ is preferably a hydrogen atom, a halogen atom, or an alkoxy group, and more preferably a hydrogen atom or a chlorine atom. A hydrogen atom is most preferred.

Although the total number of carbon atoms in the substituents represented by $R^{Y1}$, $R^{Y4}$, $R^{Y5}$ and $R^{Y6}$ is 4 or less, the total number is preferably 3 or less, and more preferably 2 or less.

The couplers of the present invention can be synthesized by known methods disclosed, for example, JP-A-50-132, 926, EP 447, 969B, and EP 482,552B.

Examples of the yellow couplers represented by formula (Y-I) will be given below, which should not be construed as limiting the present invention.

TABLE 1

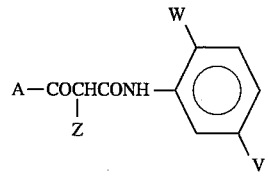

| | A | Z | W | V |
|---|---|---|---|---|
| Y-1 | $(t)C_4H_9$— | 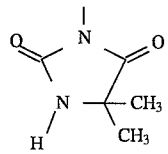 | Cl | $NHCOC_{17}H_{35}(n)$ |

TABLE 1-continued
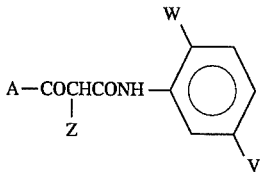
| | A | Z | W | V |
|---|---|---|---|---|
| Y-2 | " | " | " | $NHCOCH(CH_3)CH_2CH_2CH(CH_3)CH_2C(CH_3)_3$ |
| Y-3 | " | " | " | 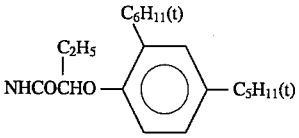 |
| Y-4 | " | " | " | $NHCOCH(C_6H_{13})C_8H_{17}$ |
TABLE 2
| | A | Z | W | V |
|---|---|---|---|---|
| Y-5 | $(t)C_4H_9-$ | 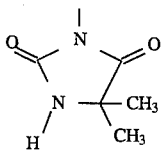 | Cl | $NHCOCH(CH_3)COOC_{14}H_{29}$ |
| Y-6 | " | " | " | $NHCOCH(CH_3)CH_2SO_2C_{12}H_{25}$ |
| Y-7 | " | " | " | $NHCOCH(CH_3)CH_2P(=O)(OCH_2CH(C_2H_5)C_4H_9)_2$ |
| Y-8 | " | " | $OCH_3$ | $NHCOC_{15}H_{31}(n)$ |
| Y-9 | " | " | " | 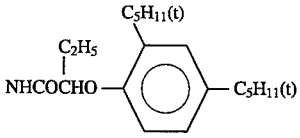 |
| Y-10 | " | 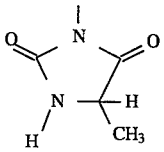 | Cl | 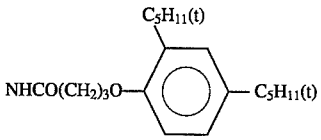 |

TABLE 3
| | A | Z | W | V |
|---|---|---|---|---|
| Y-11 | (t)$C_4H_9$— | 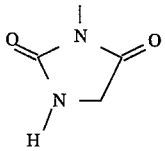 | Cl | $NHCOC_{15}H_{31}$(n) |
| Y-12 | " | 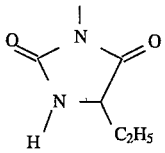 | " | $NHCOCHC_8H_{17}$ ($C_6H_{13}$) |
| Y-13 | " | 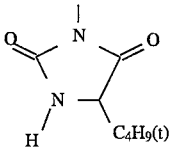 | $OCH_3$ | $NHCOCH_2CH_2OC_{12}H_{25}$ |
| Y-14 | " | 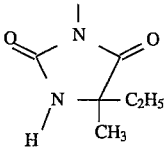 | " | $NHCOCH_2CH_2COOC_{12}H_{25}$ |
| Y-15 | " | 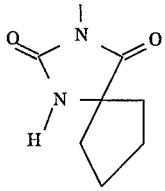 | Cl | $NHCOC_{15}H_{31}$(n) |
TABLE 4
| | A | Z | W | V |
|---|---|---|---|---|
| Y-16 | (t)$C_4H_9$— | 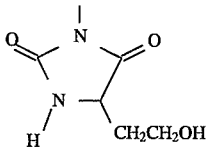 | Cl | 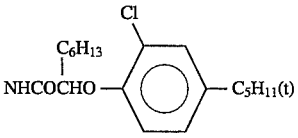 |
| Y-17 | " | 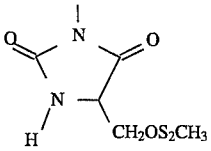 | $OCH_3$ | $NHCOCHCHC_{10}H_{21}$ ($C_8H_{17}$) |
| Y-18 | " | 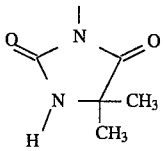 | F | 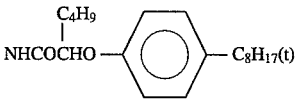 |
| Y-19 | " | " | $CH_3$ | $NHCOCH_{13}H_{27}$(n) |

TABLE 4-continued
| | A | Z | W | V |
|---|---|---|---|---|
| Y-20 | " | 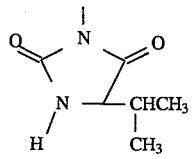 | $OCH_3$ | $CH_3$<br>\|<br>$CH_2CH_2CHCH_2C(CH_3)_3$<br>\|<br>$NHCOCHCHCH_2C(CH_3)_3$<br>\|<br>$CH_3$ |
TABLE 5
| | A | Z | W | V |
|---|---|---|---|---|
| Y-21 | $(t)C_4H_9-$ | 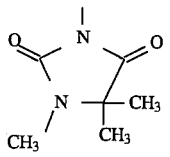 | Cl | $NHCOC_{17}H_{35}(n)$ |
| Y-22 | " | 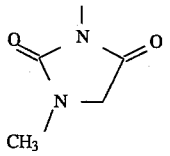 | " | $C_7H_{15}$<br>\|<br>$NHCOCHC_9H_{19}$ |
| Y-23 | " | 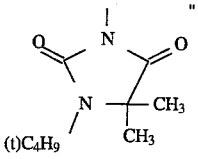 | " | $NHCOC_{15}H_{31}(n)$ |
| Y-24 | " | 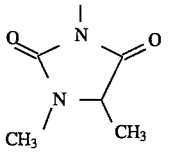 | Cl | $C_5H_{11}(t)$<br>$C_2H_5$<br>\|<br>$NHCOCHO-$ 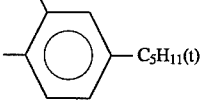 $-C_5H_{11}(t)$ |
| Y-25 | " | 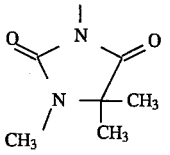 | $OCH_3$ | $C_2H_5$<br>\|<br>$NHCOCHOC_{12}H_{25}(n)$ |
TABLE 6
| | A | Z | W | V |
|---|---|---|---|---|
| Y-26 | $(t)C_4H_9-$ | 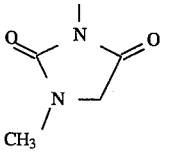 | $OCH_3$ | $C_6H_{13}$<br>\|<br>$NHCOCHC_8H_{17}$ |

TABLE 6-continued
| | A | Z | W | V |
|---|---|---|---|---|
| Y-27 | " | 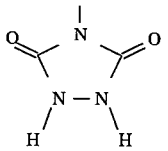 | " | $NHCOC_{17}H_{35}(n)$ |
| Y-28 | " | 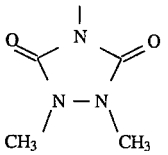 | " | $NHCO\overset{C_4H_9}{\overset{\vert}{C}}HC_6H_{13}$ |
| Y-29 | " | 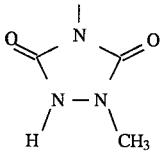 | Cl | $NHCOC_{17}H_{35}(n)$ |
| Y-30 | " | 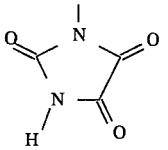 | $OCH_3$ | $NHCO\overset{CH_2CH_2\overset{CH_3}{\overset{\vert}{C}}HCH_2C(CH_3)_3}{\overset{\vert}{C}}HCH_2C(CH_3)_3$ ($CH_3$) |
TABLE 7
| | A | Z | W | V |
|---|---|---|---|---|
| Y-31 | $(t)C_4H_9-$ | 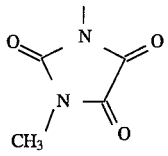 | Cl | $NHCOC_{15}H_{31}(n)$ |
| Y-32 | " | 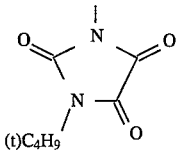 | " | 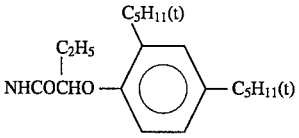 |
| Y-33 | 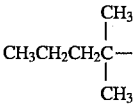 | 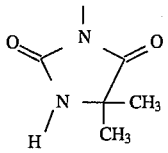 | Cl | $NHCO\overset{C_4H_9}{\overset{\vert}{C}}HC_6H_{13}$ |
| Y-34 | 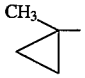 | " | " | 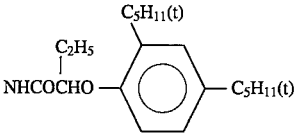 |

TABLE 7-continued
| | A | Z | W | V |
|---|---|---|---|---|
| Y-35 | " | " | " | $CH_3$<br>\|<br>$CH_2CH_2CHCH_2C(CH_3)_3$<br>\|<br>$NHCOCHCHCH_2C(CH_3)_3$<br>\|<br>$CH_3$ |
TABLE 8
| | A | Z | W | V |
|---|---|---|---|---|
| Y-36 | 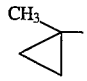 | 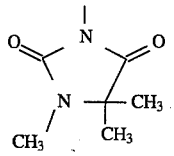 | Cl | $NHCOC_{15}H_{31}(n)$ |
| Y-37 | 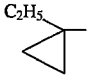 | 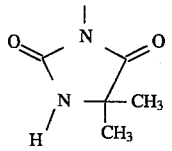 | $CH_3$ | $C_6H_{13}$<br>\|<br>$NHCOCHC_8H_{17}$ |
| Y-38 | " | 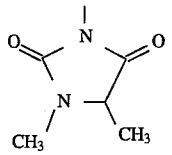 | Cl | 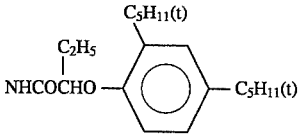 |
| Y-39 | " | 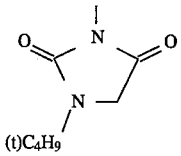 | " | $NHCOC_{17}H_{35}(n)$ |
| Y-40 | 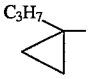 | 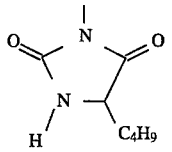 | " | $NHCOC_{15}H_{31}(n)$ |
TABLE 9
| | A | Z | W | V |
|---|---|---|---|---|
| Y-41 | 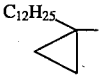 | 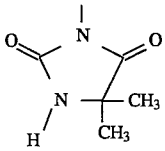 | Cl | $C_2H_5$<br>\|<br>$NHCOCHC_4H_9$ |

TABLE 9-continued
| | A | Z | W | V |
|---|---|---|---|---|
| Y-42 | 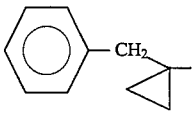 | " | " | $CH_3$ \| $CH_2CH_2CHCH_2C(CH_3)_3$ \| $NHCOCHCHCH_2C(CH_3)_3$ \| $CH_3$ |
| Y-43 | " | 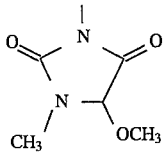 | " | $NHCOCH_2CH_2CH_2O$ — H |
| Y-44 | " | 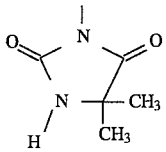 | $OC_6H_5$ | $NHCOC_{15}H_{31}(n)$ |
| Y-45 | 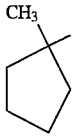 | " | Cl | $NHCOC_{17}H_{35}(n)$ |
TABLE 10
| | A | Z | W | V |
|---|---|---|---|---|
| Y-46 | 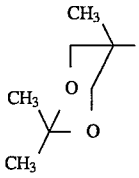 | 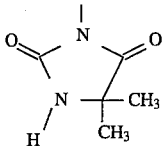 | $OCH_3$ | $NHCOC_{17}H_{35}(n)$ |
| Y-47 | 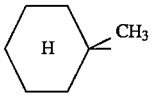 | 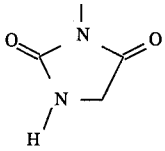 | $OCH_3$ | $NHCOC_{17}H_{35}(n)$ |
| Y-48 | $(t)C_4H_9$ — | 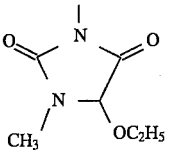 | Cl | $NHCOC_{15}H_{31}(n)$ |
| Y-49 | 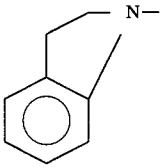 | 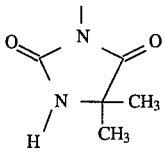 | $OCH_3$ | $NHCOC_{13}H_{27}(n)$ |
| Y-50 | " | " | Cl | $NHCOC_{19}H_{39}(n)$ |

TABLE 11
| | A | Z | W | V |
|---|---|---|---|---|
| Y-51 | 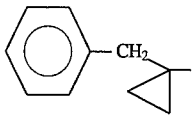 | 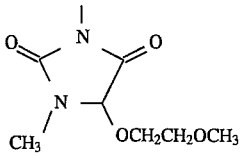 | Cl | $CH_3$<br>\|<br>$CH_2CH_2CHCH_2C(CH_3)_3$<br>\|<br>$NHCOCHCH_2C(CH_3)_3$<br>\|<br>$CH_3$ |
| Y-52 | $(t)C_4H_9-$ | " | " | $NHCOC_{15}H_{31}(n)$ |
| Y-53 | " | 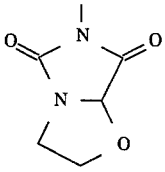 | " | $NHCOC_{15}H_{31}(n)$ |
| Y-54 | " | 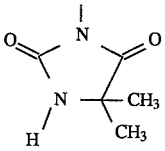 | " | $NHSO_2C_{16}H_{33}$ |
| Y-55 | " | " | " | $CH_3$<br>\|<br>$-NCOC_{15}H_{31}(n)$ |
TABLE 12
| | A | Z | W | V |
|---|---|---|---|---|
| Y-56 | $(t)C_4H_9-$ | 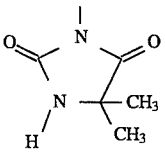 | Cl | $CH_3$<br>$CH$<br>$CH_2$ $CH_3$<br>\|<br>$-NCOC_{13}H_{27}(n)$ |
| Y-57 | " | 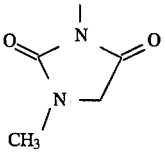 | " | $CH_3$ $C_8H_{17}$<br>\| \|<br>$-NCO-CHC_6H_{13}(n)$ |
| Y-58 | " | 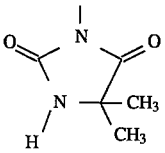 | " | $CH_3$<br>\|<br>$-NSO_2C_{12}H_{25}(n)$ |
| Y-59 | 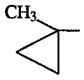 | 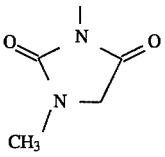 | Cl | $CH_3$<br>\|<br>$-NCOC_{17}H_{25}(n)$ |

TABLE 12-continued
| | A | Z | W | V |
|---|---|---|---|---|
| Y-60 | $C_2H_5$ 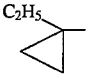 | 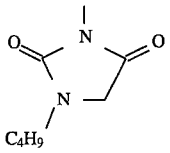 | " | $-NCOC_{13}H_{27}(n)$ 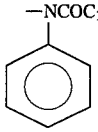 |
TABLE 13
| | A | Z | W | V |
|---|---|---|---|---|
| Y-61 | $(t)C_4H_9-$ | 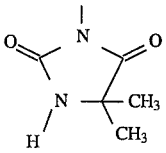 | $OCH_3$ | $NHSO_2C_{12}H_{25}$ |
| Y-62 | " | " | " | 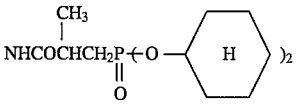 |
| Y-63 | " | " | Cl | 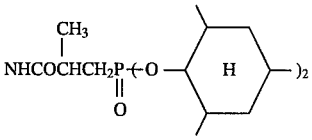 |
| Y-64 | " | " | $OC_4H_9$ | $NHCOCH_2CH_2CH_2OC_{12}H_{25}$ |
TABLE 14
| | A | Z | W | V |
|---|---|---|---|---|
| Y-65 | $(t)C_4H_9-$ | 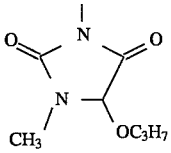 | Cl | $NHCOC_{21}H_{43}(n)$ |
| Y-66 | " | 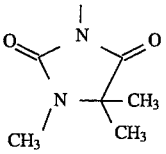 | " | 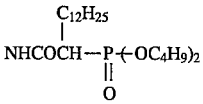 |
| Y-67 | $CH_3$ 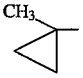 | 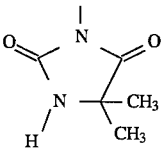 | " | 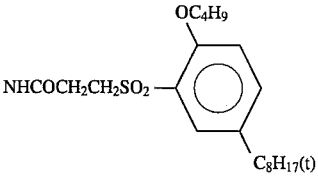 |

Y-68

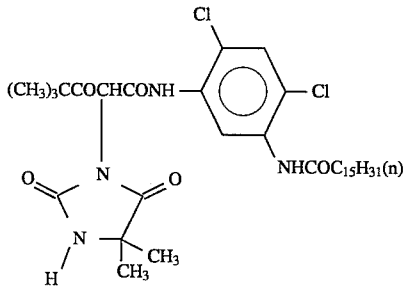

Y-69

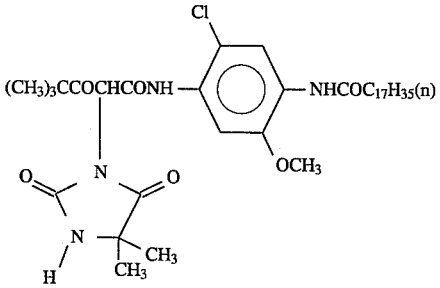

Y-70

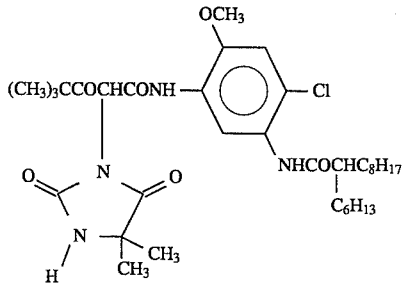

Y-71

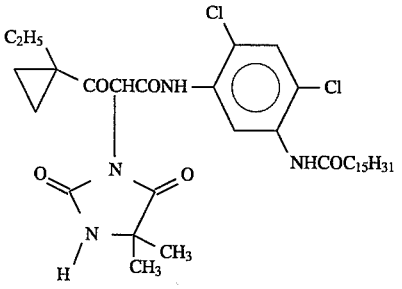

Y-72

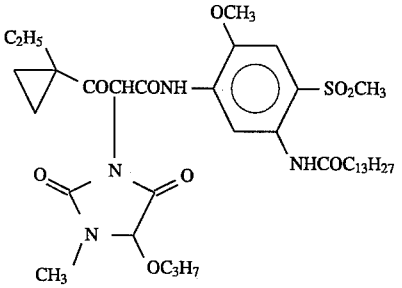

-continued

Y-73

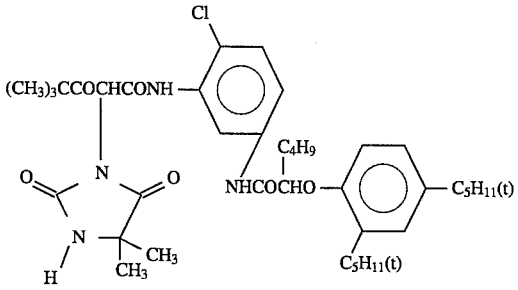

Y-74

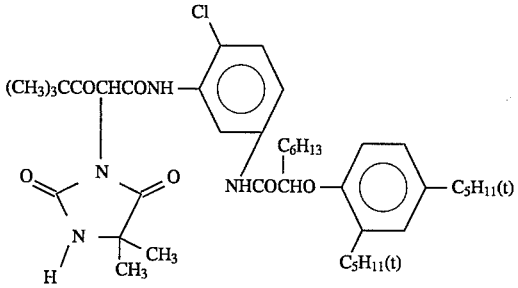

Y-75

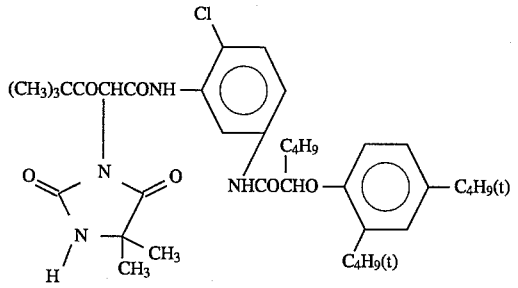

Y-76

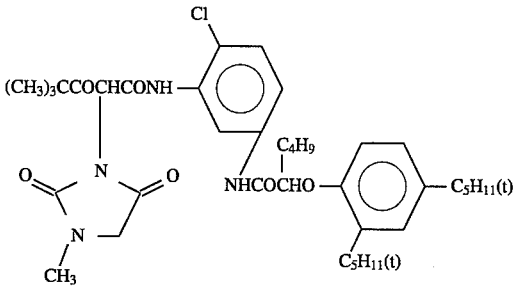

The couplers used in the present invention and represented by formula (C-I) will be described below in detail.

In formula (C-1), $R^1$ represents an alkyl group having 2–4 carbon atoms while $R^2$ represents an alkyl group.

$X^c$ represents a hydrogen atom or a group which may be substituted on a benzene ring, and Z represents a group which is removable by a coupling reaction with an oxidized developing agent.

In formula (C-1), $R^{C1}$ represents an alkyl group having 2–4 carbon atoms. Specific examples thereof include ethyl, n-propyl, isopropyl, n-butyl, sec-butyl, isobutyl, and tertbutyl groups. Among them, ethyl, n-propyl, and n-butyl groups are preferred. An ethyl group is particularly preferred.

$R^{C2}$ is a linear or branched alkyl group having carbon atoms. Among them, a linear or branched alkyl group having 12–23 carbon atoms is preferred. A linear alkyl group having 13–23 carbon atoms is more preferred. A linear alkyl group having 15, 17, 19 or 21 carbon atoms is particularly preferred.

$X^c$ is a group which can be substituted on a benzene ring. Examples of the group include a hydrogen atom, a halogen atom, an alkyl group, an alkoxy group, an acyloxy group, and an acylamino group. Among them a halogen atom is preferred and a chlorine atom is most preferred.

Z is a group which is removable by a coupling reaction with an oxidized developing agent. Examples of the group include a halogen atom, an alkoxy group, an aryloxy group, an acyloxy group, an aryl thio group, an alkyl thio group, and a heterocyclic ring group. Preferably, Z is a halogen atom, an alkoxy group, an aryloxy group. Among them a halogen atom is more preferred and a chlorine atom is most preferred.

Specific examples of the cyan couplers according to the present invention will be given below, which should not be construed as limiting the present invention.

(C-1)

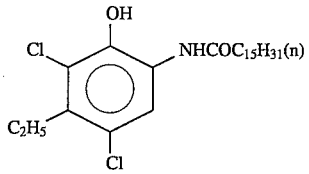

(C-2)

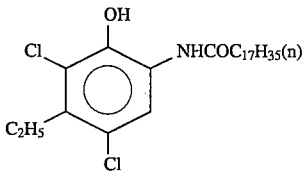

(C-3)

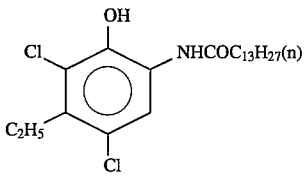

(C-4)

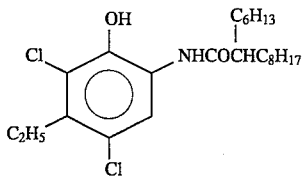

(C-5)

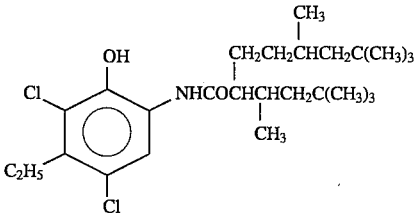

-continued (C-6)

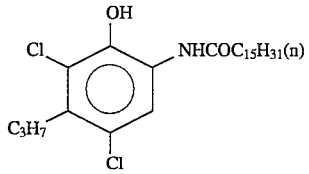

(C-7)

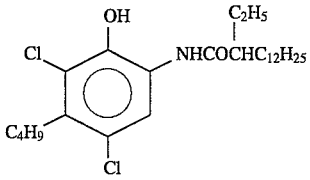

(C-8)

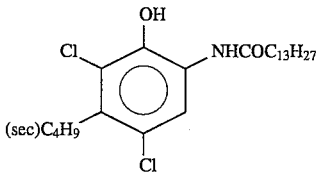

(C-9)

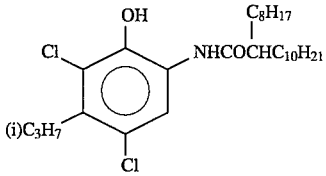

(C-10)

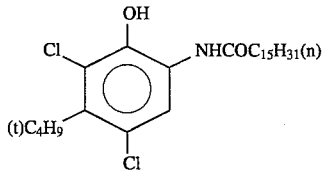

(C-11)

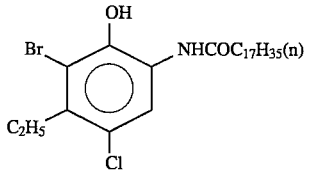

(C-12)

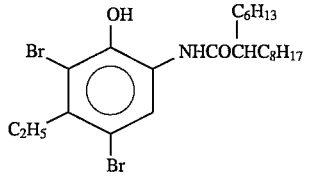

(C-13)

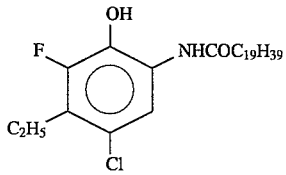

-continued (C-14)

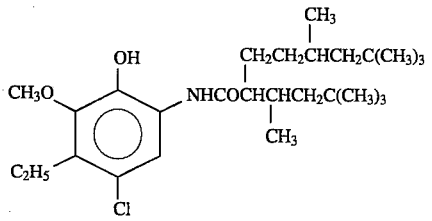

(C-15)

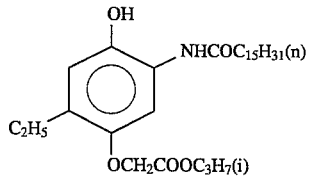

(C-16)

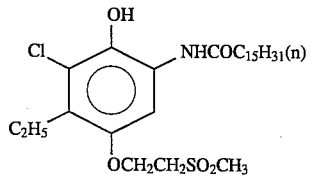

(C-17)

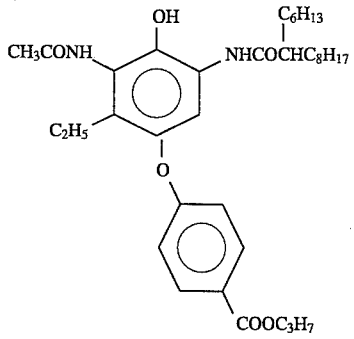

(C-18)

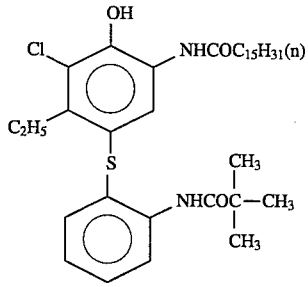

(C-19)

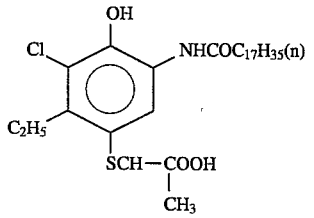

(C-20)

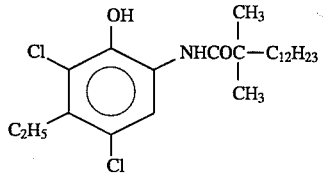

-continued (C-21)

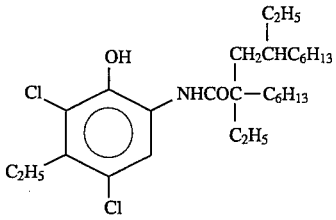

(C-22)

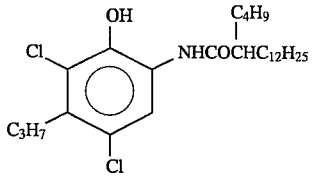

(C-23)

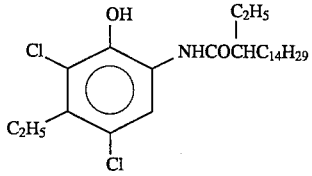

(C-24)

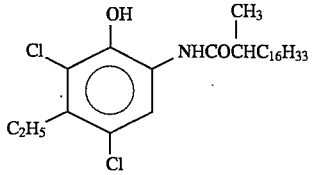

When a magenta coupler represented by formula (M-I) and a yellow coupler of the present invention represented by (Y-I), which are to be used in the invention, are applied to a silver halide color photographic light-sensitive material, at least one layer containing the magenta coupler and at least one layer containing the yellow coupler are formed on a support. The couplers to be used in the present invention can be incorporated into any hydrophilic colloid layer on the support. However, it is preferred that the magenta coupler is used in a green sensitive silver halide emulsion layer, and the yellow coupler is used in a blue sensitive silver halide emulsion layer.

The magenta coupler to be used in the invention and represented by formula (M-I) is preferably incorporated into a silver halide color photographic light-sensitive material in an amount of 0.01 to 10 mmol/$m^2$, more preferably 0.02 to 3 mmol/$m^2$, and most preferably 0.05 to 15 mmol/$m^2$. Each of the amount of the yellow coupler represented by formula (Y-1) and the cyan coupler represented by formula (C-I) is preferably from 0.01 to 10 mmol/$^2$, more preferably From 0 05 to 5 mmol/$m^2$, and most preferably from 0.1 to 2.0 mmol/$^2$. Each of the couplers represented formulae (M-1), (Y-1) and (C-1) may be used in combination of two or more species. Couplers other than the couplers defined in the present invention may be combined with the couplers defined in the present invention. In this case, it is preferred that the latter coupler is used in an amount of 50 mol % or more.

Silver halide emulsion is preferably incorporated into the silver halide emulsion layer containing the coupler according to the present invention in an amount 0.5–50 time, more preferably, 1–20 times, and most preferably, 2–10 times by mole of the coupler.

The above-mentioned couplers may be incorporated into the hydrophilic colloid layer by various known methods. In general, the coupler may be added to the layer by an oil-in-water dispersing method which is known as an oil protecting method. In this method, a coupler is dissolved in a mixture of an organic solvent having a high boiling point such as an ester of phosphoric acid or phthalic acid and an auxiliary solvent having a low boiling point, and the resulting mixture is then dispersed in an aqueous gelatin solution containing a surfactant. In another method, water or an aqueous gelatin solution is added to a coupler solution containing a surfactant, and it, through phase inversion, turns to an oil-in-water dispersed material. When an alkaline soluble couplers is used, a method called Fischer dispersing method can be used. To remove an organic solvent having a low boiling point from the resultant dispersed material, distillation, noodle washing, or ultrafiltration is preferably employed.

Moreover, the method disclosed in, for example, EP-0,477,271 B, EP-0,454,775 B, or EP-0,374,837 A can also be used. In such a method, an oil-soluble coupler is dissolved in an alkaline solution together with a water-miscible organic solvent, which is then neutralized in the presence of a surfactant to obtain a finely dispersed material.

In the silver halide color photographic light-sensitive material of the present invention, an organic solvent having a high boiling point is used in an amount of 0.2–10.0 times, preferably 0.5–8.0 times, and more preferably 1.0–6.0 times by weight of a magenta coupler. The organic solvent is used in an amount of 0–5.0 times, preferably 0–2.0 times, more preferably 0–1.0 times, and most preferably 0.05–0.5 times by weight of a yellow coupler. Also, it is used in an amount of 0–5.0 times, preferably 0.1–2.0 times, and more preferably 0.2–1.0 times by weight of a cyan coupler.

In the silver halide color photographic light-sensitive material according to the present invention, gelatin is preferably used as a hydrophilic binder. The amount of gelatin is from 5 to 20 g/m$^2$, preferably not greater than 7.2 g/m$^2$, more preferably not greater than 6.9 g/m$^2$, and particularly preferably not greater than 6.5 g/m$^2$.

The color photographic light-sensitive materials according to the present invention can be made by applying onto a support a structure comprising at least one yellow color developing silver halide emulsion layer, at least one magenta color developing silver halide emulsion layer, and at least one cyan color developable silver halide emulsion layer. For popular color printing papers, colors can be reproduced by a subtractive color process, if incorporated are color couplers capable of forming dyes having the relation of a color complementary to light sensitive to the silver halide emulsion. In such color printing papers for popular use, silver halide emulsion particles may be spectrally sensitized by using blue sensitive, green sensitive, red sensitive spectral sensitizing dyes in order of the above-described color developable layers, and may be super-posed on a support in the above-described order. However, the light-sensitive layers may be superposed in other order than the above. In other words, in a certain case, it is preferable for quick processing that a light-sensitive layer containing silver halide particles having a largest average particle size is used as a top layer. In another case, the lowermost layer is preferably a magenta color developable sensitive layer in view of the storability while being exposed to light.

Light-sensitive layers and color hues to be developed do not necessarily correspond to each other as described above. At least one infrared sensitive silver halide emulsion layer may also be used.

No limitation is imposed on the material of the support used in the present invention as long as a photographic emulsion layer can be applied thereon. Examples of the support include glass, papers, and plastic films. A reflective support is particularly preferred.

The term "reflective support" used herein means a support which enhances reflectivity, thereby sharpening die images formed on a silver halide emulsion layer. Examples of the reflective support include supports which are laminated with a hydrophobic resin in which a dispersion light reflective material such as titanium oxide, zinc oxide, calcium carbide, or calcium sulfate is dispersed; and supports made of a hydrophobic resin containing a light reflective material. Specific examples of the supports include a paper support laminated with polyethylene, a paper support laminated with polyethylene terephthalate, a synthetic paper support containing polypropylene, a transparent support having a reflective layer or containing a reflective material. Examples of the transparent support include glass plates, polyester films such as polyethylene terephthalate, cellulose triacetate, and cellulose nitrate films, polyamide films, polycarbonate films, polystyrene films, and vinyl chloride resins. Preferable examples of the reflective supports used in the present invention are paper supports, both sides of which are laminated with a layer of waterproof resin, with at least one of the resin layer containing fine particles of a white pigment.

The term "waterproof resin" used for the reflective support in this invention means a resin having a water absorption rate of not greater than 0.5% by weight, preferably not greater than 0.1% by weight. Examples of the resin include polyolefin such as polyethylene, polypropylene, and a polymer containing polyethylene, vinyl polymer and copolymers thereof(polystyrene, polyacrylate, and copolymers thereof), polyester (polyethylene terephthalate, polyethylene isophthalate, etc.), and copolymers thereof. Among them, polyethylene and polyester are particularly preferred.

High density polyethylenes, low density polyethylenes, and linear low density polyethylenes may be used singly or in combination. The melt flow rates (hereinafter referred to as "MFR") of these polyethylene resins before processing are preferably in the range of 1.2 g/10 minutes to 12 g/10 minutes when measured under the condition No. 4 in Table 1 of JIS K 7210.The "MFR of polyolefin before processing" means the MFR of the resin before mixing a bluing agent and a white pigment.

As a polyester, there is preferably used polyester synthesized by condensation polymerization of dicarboxylic acid and diol. Preferable examples of dicarboxylic acid include terephthalic acid, isophthalic acid, and naphthalene dicarboxylic acid. Preferable examples of diol include ethylene glycol, butylene glycol, nenopentyl glycol, triethylene glycol, butanediol, hexylene glycol, a bisphenol A ethylene oxide additive(2,2-bis(4-(2-hydroxyethyloxy)phenyl)propane), and 1,4-dihydroxymethyl cyclohexane.

Also, it is possible to use various polyesters which are obtained by condensation polymerization of dicarboxylic acids which may be used singly or as a mixture, and diols which may also be used singly or as a mixture. Preferably, at least one of the dicarboxylic acids is terephthalic acid. It is also preferable to use a mixture of terephthalic acid and isophthalic acid (ratio=9:1–2:8) or a mixture of terephthalic acid and naphthalene dicarboxylic acid (ratio=9:1–2:8). When diol is used, ethylene glycol or a mixture of diols containing ethylene glycol is preferred. These polymers preferably have a molecular weight of 30000–50000.

It is also preferable to use a plurality of polyester species having different compositions as a mixture. Moreover, a mixture of any of these polyester and other resin is also preferably used. Resins to be mixed with the polyesters can be selected from a wide variety of resins, provided that the resins can be extruded at a temperature of 270°–350° C. Examples of the resins include polyolefins such as polyethylene and polypropylene; polyethers such as polyethylene glycol, polyoxymethylene and polyoxypropylene; polyurethane of a polyester type, polyetherpolyurethane, polycarbonate, and polystyrene. A single or plural species of resins may be mixed with the polyester. For example, 6% by weight of polyethylene and 4% by weight of polypropylene are mixed with 90% by weight of polyethylene terephthalate. The mixture ratio of polyester to another resins varies depending on the species of resins to be mixed. When polyolefin is used, the mixture ratio of polyester to another resin is preferably in the range of 100:0–80:20 by weight. When the mixture ratio is out of this range, physical properties of a resultant resin drastically become bad. In the case of resins other than polyolefins, they may be mixed with polyesters so that the ratio of the polyesters to the other resins falls in the range of 100:0–50:50.

The mixture ratio of the above-described waterproof resin to a white pigment is in the range from 98:2–30:70 (waterproof resin: white pigment), preferably 95:5–50:50, and more preferably 90:10–60:40.If the amount of the white pigment is less than 2% by weight, it does not sufficiently contribute to pure whiteness. If the amount of the white pigment exceeds 70% by weight, it cannot provide a sufficient surface flatness when it is incorporated in the support for a photographic film. In this case, it is impossible to obtain a support, for a photographic film, having excellent gloss.

The waterproof resin preferably has a thickness of 2–200 μm, and more preferably 5–80 μm. When the thickness exceeds 200 μm, problems regarding physical properties occur, such as generation of cracks due to the increased brittleness of the resin. When the resin becomes thinner than 2 μm, the waterproofness, which is the essential property of the resin, decreases. Further, it becomes difficult to simultaneously satisfy pure whiteness and surface flatness. Also, it becomes so soft that satisfactory physical properties cannot be obtained.

The resin or resin composition laminated on the side of the support opposite the side on which light-sensitive layers are formed preferably has a thickness of 5–100 μm, and more preferably, 10–50 μm. When the thickness exceeds this range, problems regarding physical properties occur, such as generation of cracks due to the increased brittleness of the resin. When the thickness of the resin becomes below the range, the waterproofness, which is the essential property of the resin coating, decreases, and it becomes so soft that satisfactory physical properties cannot be obtained.

In some cases, it is preferred for cost and readiness in manufacture that the reflective support which may be used in the present invention has two or more different waterproof resin layers on the side on which light-sensitive layers are formed. It is preferred that, among the waterproof resin layers, each of which contains different amounts of white pigments, the waterproof resin layer closest to the support includes a smaller amount of white pigment compared to at least one waterproof resin layer located above the above-mentioned waterproof resin layer. More preferably, the reflective supports which may be used the present invention have a structure such that a waterproof resin layer closest to light-sensitive layers includes the largest amount of a white pigment among waterproof resin layers containing different amounts of white pigments; or a structure which includes at least three water proof resin layers and in which one intermediate waterproof resin layer between the waterproof resin layer closest to light-sensitive layers and the waterproof resin layer closest to the support contains the highest amount of the white pigment.

A white pigment is preferably mixed into each waterproof resin layer in an amount of 0–70% by weight, preferably 0–50% by weight, and more preferably 0–40% by weight. In the waterproof resin layer containing the largest amount of white pigment, white pigment is mixed in an amount of 9–70% by weight, preferably 15–50% by weight, and more preferably 20–40% by weight. When the content of white pigment is less than 9% by weight, sharpness becomes low. When the content of white pigment exceeds 70% by weight, cracks may be produced in the layers of a film after extrusion.

Also, it is preferred that each of the waterproof resin coating layers has a thickness of 0.5–50 μm. For example, in the case where two waterproof resin coating layers are formed, it is preferred that each layer has a thickness of 0.5–50 μm and the overall thickness of these layers falls in the above-described range (2–200 μm). In the case where three waterproof resin layers are formed, it is preferred that the uppermost layer has a thickness of 0.5–10 μm, the intermediate layer has a thickness of 5–50 μm, and the lowermost layer (which is closest to the support) has a thickness of 0.5–10 μm. When the uppermost layer and the lowermost layer have thicknesses of 0.5 μm or less, die lip lines are produced more often due to the action of a white pigment. When the thickness of the uppermost and lowermost layers, especially, the thickness of the uppermost layer exceeds 10 μm, sharpness deteriorates.

Fine particles of a white pigment are preferably dispersed in the reflective layer uniformly without forming clusters of particles. The degree of distribution of the particles can be determined by measuring the ratio (Ri, %) of the total area occupied by the particles of the white pigment within a unit area, wherein the area occupied by the particles is determined based on the projected areas of the particles on the unit area. The ratio Ri will be referred to as the area occupying ratio. The variation coefficient of the area occupying ratio can be obtained as a ratio of the standard deviation (s) of the area occupying ratio Ri to the average value (R) of the area occupying ratio Ri, i.e., S/r. In the present invention, the variation coefficient of the area occupying ratio is preferably not greater than 0.15,more preferably not greater than 0.12,and particularly preferably not greater than 0.08.

In the present invention, it is preferable to use a support with a surface providing a diffuse reflection of second kind. The diffuse reflection of second kind can be obtained by forming concave and convex portions in a mirror-like surface to divide the surface into a plurality of fine mirror surfaces facing toward different directions, thereby dispersing the directions of reflection of the finely divided surfaces (mirrors). In the surface having the diffusion reflection of second kind, concave and convex portions are formed so that its average three-dimensional roughness with respect to the central plane falls in the range of 0.1–2 μm, and preferably 0.1–1.2 μm. The frequency of the concave and convex portions preferably falls in the range of 0.1–2000 cycles/mm, more preferably in the range of 50–600 cycles/mm when the concave and convex portions having a roughness not less than 0.1 μm are measured. The detail of such a support is described in JP-A-2-239,244.

Preferably, the silver halide grains in the present invention are particles of silver chloride, silver chlorobromide, silver iodobromide, or silver chloroiodide which contains 95% or more by mole of silver chloride. In the present invention, it is preferable to use silver chloride or silver chlorobromide which is virtually free from silver iodide in order to accelerate a development process. The term "virtually free from silver iodide" means that the silver iodide content is 1 mol % or less, and preferably 0.2 mol % or less. In some cases, silver halide-rich grains containing 0.01 to 3 mol % of silver iodide as disclosed in JP-A-3-84,545 may be preferably used in the emulsion surface in order to enhance sensitivity at high intensity of illumination, sensitivity of spectral sensitization, or stability of light-sensitive materials over time. Although the halogen composition of the emulsion may differ from grain to grain, use of an emulsion having an identical composition for every grain will easily make the performance of each grain uniform. Particles of the silver halide emulsion may have a uniform structure in which all parts of the grain have the same composition; a multilayer structure in which the core part of the grain and one or more shells which embrace the core have different halogen compositions; or a structure which has non-lamellar phases, inside or near the surface of the grain, having halogen compositions different from the remaining part (in the case where such phases are near the surface of a grain, a phases having a different composition are bound onto the edges, corners or other parts of the grain). In order to obtain high sensitivity, the above latter two grain-structures are more advantageous than the uniform structure. The two latter structures are also advisable in view of pressure resistivity. When a silver halide grain has either one of these hereto-structures, the boundary between the phases having different halogen-compositions may be a clear-cut border, or may be an unclear border as a result of formation of mixed crystals based on the difference in composition. Alternatively, the structure may intentionally be varied continuously.

In the present invention, when a silver chloride-rich emulsion is used, the silver halide grain preferably has a structure in which silver bromide is localized in a lamellar, as described above, or in a non-lamellar manner inside the grain and/or on the surface of the grain. Preferably, the composition of the phase in which silver bromide is localized contains at least 10 mol % and preferably more than 20 mol % of silver bromide. The silver bromide content of the phase in which silver bromide is localized (which hereinafter may be referred to as a localized phase) can be determined by X-ray diffraction (see, for example, "Structural Analysis—New Experimental Chemistry vol. 6" edited by the Japanese Chemical Society, published by Maruzen). Such a phase may be present inside the grain, at an edge or corner of the grain, or on the surface of the grain. A preferable example of the structure is one in which silver bromide is epitaxially grown at a corner of the grain.

It is also effective to elevate the amount of silver chloride contained in a silver halide emulsion in an attempt for reducing the amount of a developer to be replenished. For this purpose, it is preferable to use emulsions of approximately pure silver chloride, such as those containing 98 to 100 mol % of silver chloride.

It is preferable that the average grain size (the arithmetic mean of the values of the diameter of a circle which has an area equivalent to the projected area of the grain) of silver halide grains contained in the silver halide emulsion of the present invention is from 0.1 μm to 2 μm.

The distribution of the size of the grains is preferably a so-called monodispersion, which has a variation coefficient (a factor obtained by dividing the standard deviation of the grain size distribution by the average grain size) of not more than 20%, preferably not more than 15%, and particularly preferably not more than 10%. In order to obtain a wide latitude, it is preferable that emulsions of monodispersion as described above are blended in the same layer, or that they are applied as multi-layers.

Particles of the silver halides in the photographic emulsions may have various configurations including regular crystal forms such as cubic, tetradecahedral, and octahedral; irregular crystal forms such as spheres and plates; and composites of them. The grains may be a mixture of various crystal forms. In the present invention, it is preferable that not less than 50%, more preferably not less than 70%, and most preferably not less than 904 of the grains have a regular crystal form. Alternatively, preferred are emulsions which contain tabular silver halide grains having an average aspect ratio (diameter of a circle/thickness) of not less than 5 and preferably not less than 8,in an amount over 50% of the total grains when measured from the projected area, the tabular grains.

The silver chloride (bromide) emulsions used in the invention can be prepared by the methods described, for example, by "Chemie et Physique Photographique" by P. Glafkides, published by Paul Montel, 1967; "Photographic Emulsion Chemistry", by G. F. Duffin, published by Focal Press, 1966; and "Making and Coating Photographic Emulsion" by V. L. Zelikman et el., Focal Press, 1964.That is, any of the acid method, neutral method, and the ammonia method may be used. A soluble silver salt and a soluble halogen salt may be reacted by a unilateral mixing method, simultaneously mixing method, or by a combination of these methods. A method of forming grains in a silver ion-rich atmosphere (a so-called reverse mixing method) may also be used. A so-called controlled double jet method, which is a variety of the simultaneously mixing method, may be used in which pAg in a liquid phase where silver halide is produced is maintained constant. By this method, it is possible to obtain an emulsion of silver halide grains having an approximately uniform grain size and a regular crystal form.

The localized phase of silver halide grains and the matrix of the phase in the present invention preferably contain hereto-metal ions or their complex ions. Preferable metal ions or metal complexes are selected from ions and complexes of the metals of the groups VIII and IIb in the periodic table, lead ions, and thallium ions. The localized phases mainly contain ions or complex ions of iridium, rhodium, iron, etc., and the matrix contains ions or complex ions of osmium, iridium, rhodium, platinum, ruthenium, palladium, cobalt, nickel, and iron. The kinds of metal ions and their concentrations may be varied between localized phases and the matrix. Plural kinds of metals may be used. Preferably, iron and irldium compounds are incorporated in phases in which silver bromide is localized.

The compounds capable of donating these metal ions may be incorporated into localized phases of silver halide grains and/or the remaining phase of the grains (matrices), by dissolving them in a dispersing solution such as an aqueous gelatin solution, aqueous halide solution, aqueous silver salt solution, or other aqueous solutions; or alternatively by addition of silver halide fine grains in which the metal ions are incorporated beforehand, followed by dissolving the fine grains.

Metal ions which may be used in the present invention are incorporated into grains of the emulsion, before, during, or immediately after the formation of the grains. The timing of incorporation will be decided, depending on parts in which the metal ions are to be incorporated.

The silver halide emulsion according to the present invention is generally subjected to chemical sensitization and spectral sensitization. Chemical sensitization includes sensitization using a chalcogen sensitizer (specifically, sulfur sensitization by typically adding an unstable sulfur compound, selenium sensitization using selenium, and tellurium sensitization using tellurium are mentioned), noble metal sensitization typified by gold sensitization, and reduction sensitization. They may be used singly or in combination. As for the compounds which are used in chemical sensitization, those described in JP-A-62-215,272, from page 18,lower right column to page 22,upper right column are preferably used.

The advantageous effects of the structure of the light-sensitive material of the present invention are more remarkable than the case where a silver chloride-rich emulsion which has been sensitized with gold is used.

The silver halide emulsion used in the invention may optionally contain various compounds or precursors thereof in order to inhibit fogging during the manufacturing process, storage, or photographic treatment, or to stabilize the photographic performance. Specific examples of preferable compounds are those described in the above-mentioned JP-A-62-215,272, from page 39 to page 72. Moreover, 5-arylamino-1,2,3,4-thiatriazole (the aryl residue has at least one electron withdrawing group) described in European Patent No. 0447647 is also preferably used.

Spectral sensitization is performed for the purpose of imparting, to each emulsion layer of the light-sensitive material, spectral sensitivity in a desired range of wave length of light.

Examples of spectral sensitizing dyes used in the light-sensitive material of the invention for effecting spectral sensitization of the blue, green and red regions include those described in "Heterocyclic Compounds—Cyanine Dyes and related Compounds" by F. M. Harmer (published by John Wiley & Sons (New York, London), 1964). Specific description of the preferred compounds and spectral sensitization is given in the above-mentioned JP-A-62-215,272, page 22, right upper column to page 38.With regard to red sensitive spectral sensitizing dyes for silver chloride-rich grains of a silver halide emulsion, those described in JP-A-3-123,340 are very preferable from the viewpoints of stability, intensity of adsorption, temperature dependency of exposure, etc.

In the light-sensitive materials according to the present invention, in order to effectively carry out spectral sensitization in the infrared region, use may be made of sensitizing dyes described in JP-A-3-15,049, page 12, upper left column to page 21, lower left column; JP-A-3-20,730, page 4, lower left column to page 15, lower left column, European Patent No. 0,420,011,page 4, line 21 to page 6, line 54,European Patent No. 0,420,012, page 4, line 12 to page 10, line 33, European Patent No. 0,443,466, and U.S. Pat. No. 4,975, 362.

In order to incorporate these spectral sensitizing dyes into a silver halide emulsion, they may be directly dispersed into an emulsion; or they may be first dissolved in a single solvent of water, methanol, ethanol, propanol, methyl cellosolve, 2,2,3,3-tetrafluoropropanol, etc. or in a mixture of two or more of them, and then the resultant solution may be added to an emulsion. Alternatively, the dyes may be added to an aqueous solution in which an acid or a base co-exists as described in JP-B-44-23,389, JP-B-44-27,555, JP-B-57-22089, etc.; or may be added to an aqueous solution or a colloidal dispersion by incorporation of a surfactant as described in U.S. Pat. Nos. 3,822,135 and 4,006,025, and subsequently, the resultant aqueous solution or dispersion may be added to an emulsion. It is also possible to dissolve the dyes in a solvent which is substantially immiscible with water such as phenoxyethanol, disperse the resultant solution in water or hydrophilic colloid, and then add it to an emulsion. As described in JP-A-53-102,733 and JP-A-58-105,141, a dispersion obtained by directly dispersing the dyes in a hydrophilic colloid may be added to an emulsion. The dyes may be added to an emulsion at any stage during the preparation of the emulsion which is known to be an advantageous stage. Specifically, the dyes may be added to an emulsion before or during the formation of grains of silver halide emulsion, during a period from immediately after the formation of grains of silver halide emulsion to just before a washing step, before or during chemical sensitization, during a period from immediately after the chemical sensitization to Just before the emulsion is solidified, or during the preparation off a coating liquid. Generally, the spectral sensitizing dyes are added to an emulsion after completion of chemical sensitization and before coating. However, it is possible to add them at the same time of addition of a chemical sensitizer as described in U.S. Pat. Nos. 3,628,969 and 4,225,666 to perform spectral sensitization and chemical sensitization simultaneously, or to add them prior to chemical sensitization as described in JP-A-58-113,928. Moreover, spectral sensitization may be initiated by adding the spectral sensitizing dyes before silver halide grains are completely precipitated. It is also possible to add a spectral sensitizing dye in divided amounts as described in U.S. Pat No. 4,225,666, i.e., to add a part of the dye prior to chemical sensitization and add the remainder after chemical sensitization. Thus, the spectral sensitizing dye can be added at any stage during the formation of silver halide grains as in a manner described in U.S. Pat. No. 4,183,756, etc. It is particularly preferable that the sensitizing dyes are added before the washing step for an emulsion or before chemical sensitization.

The amounts of spectral sensitizing dyes to be added fall in a wide range depending on the case. Preferably, the amount of the dyes is $0.5\times10^{-6}$ mol to $1.0\times10^{-2}$ mol per mol of silver halide, and more preferably, $1.0\times10^{-6}$ mol to $5.0\times10^{-3}$ mol per mol of silver halide.

In the present invention, when a sensitizing dye having spectral sensitivity in a range from red to infrared is used, it is preferred that a compound described in JP-A-2-157,749. from page 13, lower right column to page 22, lower right column is additionally used. Use of such a compound specifically enhances storability of light-sensitive materials, stability in processing, and effects of color sensitization. Particularly, combination use of the compounds of formulas (IV), (V), and (VI) in the publication is preferred. They are used in amounts from $0.5\times10^{-5}$ mol to $5.0\times10^{-2}$ mol per mol of silver halide, and more preferably, $5.0\times10^{-5}$ mol to $5.0\times10^{-3}$ mol per mol of silver halide. Good results can be obtained when they are used from 0.1 to 10,000 fold, preferably from 0.5 to 5,000 fold, per mol of a sensitizing dye.

When the light-sensitive materials of the invention are used as printing materials, they may be used not only in a printing system using an ordinary negative film printer, but also in a digital scanning exposure system in which used is monochromatic high density light generated from a gas laser; light emission diode semiconductor laser; or a second harmonics generator (SHG) using a combination of a semiconductor laser or a solid state laser using a semiconductor laser as a excitation light source and non-linear optical crystal. In order to make the system compact and inexpensive, it is preferable to use a semiconductive laser; or a second harmonics generator (SHG) based on a combination of a semiconductor laser or a solid state laser with a non-linear optical crystal. For designing a compact and inexpensive apparatus which has a long life and high stability, a semiconductor laser is preferably used. At least one light source for exposure is preferably a semiconductor laser.

When a light source for scanning exposure is used, the maximum spectral sensitivity of the light-sensitive materials of the present invention can arbitrarily be set depending on the wave length of the light source to be used for performing scanning exposure. In an SHG light source in which a solid state laser using a semiconductor laser as an excitation light source or a semiconductor laser is used in combination with a non-linear optical crystal, the oscillation wave length of laser can be halved. Thus blue light and green light are obtained. Therefore, it is possible to obtain maximal spectral sensitivities of the light-sensitive materials in ordinary three regions of blue, green and red. When a semiconductor laser is used as a light source in an attempt to make an inexpensive, highly stable, and compact apparatus, it is preferred that at least two layers have their maximal spectral sensitivities in the range of not less than 670 nm. This is because inexpensive and stable semiconductor lasers of III-V group which are presently available have an oscillation wave range only in the range from red to infrared. However, in laboratories, oscillation of semiconductors of II-VI group in green and blue ranges has been confirmed. Therefore, it is foreseeable that the semiconductor laser could be supplied stably and used inexpensively if manufacturing technology for semiconductor laser advances. In such a case, requirements that at least two layers have maximal spectral sensitivities in the range of not less than 670 nm will have less significance.

In scanning exposure, the period during which silver halide contained in a light-sensitive material is exposed is a period required for exposing a certain very small area. The very small area is called a pixel, and is generally taken as a minimum unit in which the quantity of light can be controlled by digital data. Accordingly, the size of the pixel affects the period of exposure per pixel. The size of a pixel depends on the density of pixels which, realistically, is in the range from 50 to 2,000 dpi. When exposure time is defined as a period for exposing a pixel having a density of 400 dpi, the exposure time is preferably not more than $10^{-4}$ seconds, and more preferably not more than $10^{-6}$ seconds.

The light-sensitive materials of the invention may optionally contain, sin hydrophilic colloidal layers, water-soluble dyes (particularly, oxonole dye and cyanine dye) which can be discolored during processing and which are described in European Patent No. 0337490A2, page 27 to page 76, in order to prevent irradiation or halation or to enhance safelight immunity.

Among the water-soluble dyes, some cause color separation or deteriorate safelight immunity when used in an increased amount. Preferable examples of dyes which can be used and which do not aggravate color separation include water soluble dyes described in EP 0,539,978A1, JP-A-5-127325 and JP-A-5-127324.

In the present invention, it is possible to use a colored layer which can be discolored, during processing, in combination with the compound of the present invention which is dispersed as solid fine particles. The colored layer to be used may contact an emulsion layer directly or indirectly through an intermediate layer containing color amalgamation preventing agents such as gelatin and hydroquinone. The colored layer is preferably provided as a lower layer (on the side of a support) with respect to the emulsion layer which develops the same primary color as the color of the colored layer. It is possible to provide colored layers independently, each corresponding to respective primary colors. Alternatively, one layer selected from them may be provided. In addition, it is possible to provide a colored layer subjected to coloring so as to match a plurality of primary colors. About the optical reflection density of the colored layer it is preferred that at the wavelength which provides the highest optical density in a range of wave lengths used for exposure (a visible light region from 400 nm to 700 nm for an ordinary printer exposure, and the wavelength of the light generated from the light source in the case of scanning exposure) the optical density is within the range of 0.2 to 3.0, more preferably 0.5 to 2.5, and particularly preferably 0.8 to 2.0.

The colored layer described above may be formed by a known method. For example, there are mentioned a method in which dyes described in JP-A-2-282,244, from page 3,upper right column to page 8 or anionic dyes are mordanted in a cationic polymer, a method in which dyes are adsorbed onto fine grains of silver halide or the like and fixed in the layer, and a method in which colloidal silver described in JP-A-1-239,544 is used. The method of mordanting anionic dyes in a cationic polymer is described in JP-A-2-84,637, pages 18 to 26. U.S. Pat. Nos. 2,688,601 and 3,459,563 disclose a method of preparing a colloidal silver for use as a light absorber. Among them, preferred are the methods of incoporating fine particle dyes and of using colloidal silver.

A binder or protective colloid used in the light-sensitive material according to the invention is preferably gelatin. However, hydrophilic colloids other than gelatin may also be used solely or in combination with gelatin. Gelatin is preferably a low calcium gelatin, which contains not more than 800 ppm, more preferably not more than 200 ppm, of calcium. In order to prevent various fungi and microorganisms, which deteriorate picture images, from propagating in hydrophilic layers, it is preferred that mildewproof agents as described in JP-A-63-271,247 are added.

When the light-sensitive materials of the present invention are subjected to exposure with a printer, it is preferred that a band-stop filter described in U.S. Pat. No. 4,880,726 is used. With the filter, color amalgamation of light is eliminated, thereby remarkably enhancing color reproduction.

The exposed light-sensitive materials can be developed by an ordinary color developing process. In order to achieve a rapid processing, the color photographic light-sensitive materials according to the present invention may be subjected to a bleaching-fixing process after a color-developing process has been completed. Especially in the case where a silver chloride-rich emulsion is used, the pH of a bleach-fix bath is preferably not more than about 6.5, and more preferably not more than about 6 for accelerating desilvering.

The patent application publication listed below disclose preferable examples of silver halide emulsions and other materials (such as additives) used in light-sensitive materials of the invention, structures of photographic layers (such as arrangement of layers), methods of processing the sensitive materials, and additives used for processing. Among them, those described in European Patent Application No. 0,355,660 A2 (JP-A-2-139,544) are particularly preferred.

TABLE 15

| Photographic constituents, and the like | JP-A-62-215272 | JP-A-2-33144 | EPO No. 355,66OA2 |
|---|---|---|---|
| Silver halide emulsions | Page 10, right upper column, line 6 to page 12, left lower column line 5, and page 12, right lower column, 4th line from the last line to page 13, left upper column, line 17 | Page 28, right upper column, line 16 to page 29, right lower column, line 11, and page 30, line 2 to line 5 | Page 45, line 53 to page 46, line 3, and page 47, line 20 to line 22 |
| Silver halide solvents | Page 12, left lower column, line 6 to line 14, and page 13, left upper column, 3rd line from the last line to page 18, left lower column, the last line | — | — |
| Chemical sensitizers | Page 12, left lower column, 3rd line from the last line to right lower column, 5th line from the last line, and page 18, right lower column, line 1 to page 22, right upper column, 9th line from the last line | Page 29, right lowe column, line 12 to the last line | Page 47, line 4 to line 9 |
| Spectral sensitizers (Spectral sensitizing methods) | Page 22, right upper column, 8th line from the last line to page 38, the last line | Page 30, left upper column, line 1 to line 13 | Page 47, line 10 to line 15 |
| Emulsion stabilizers | Page 39, left upper column line 1 to page 72, right upper column, the last line | Page, 30, left upper column, line 14 to right upper column, line 1 | Page 47, line 16 to line 19 |
| Development accelerators | Page 72, left lower column, line 1 to page 91, right upper column, line 3 | — | — |

TABLE 16

| Photographic constituents, and the like | JP-A-62-215272 | JP-A-2-33144 | EPO No. 355,66OA2 |
|---|---|---|---|
| Color couplers (Cyan, magenta, yellow couplers) | Page 91, right upper column, line 4 to page 121, left upper column, line 6 | Page 3, right upper column, line 14 to page 18, left upper column, the last line and page 30 right upper column, line 6 to page 35 right lower column, line 11 | Page 4, line 15 to line 27, page 5, line 30 to page 28, the last line, page 45, line 29 to line 31, and page 47, line 23 to page 63, line 50 |
| Color increasing agents | Page 121, left upper column, line 7 to page 125, right upper column, line 1 | — | — |
| UV absorbers | Page 125, right upper column, line 2 to page 127, left lower column, the last line | Page 37, right lower column, line 14 to page 38, left upper column, line 11 | Page 65, line 22 to line 31 |
| Anti-fading agents (image stabilizers) | Page 127 right lower column, line 1 to page 137, left | Page 36, right upper column, line 12 to page 37, left upper | Page 4, line 30 to page 5, line 23, page 29, line 1 to |

TABLE 16-continued

| Photographic constituents, and the like | JP-A-62-215272 | JP-A-2-33144 | EPO No. 355,66OA2 |
|---|---|---|---|
| | lower column, line 8 | column, line 19 | page 45, line 25, page 45, line 33 to line 40, and page 65, line 2 to line 21 |
| High B.P. and/or low B.P. organic solvents | Page 137, left lower column, line 9 to page 144, right upper column, the last line | Page 35, right lower column, line 14 to page 36, left upper column, 4th line from the last line | Page 64, line 1 to line 51 |
| Method of dispersing photographic additives | Page 144, left lower column, line 1 to page 146, right upper column, line 7 | Page 27, right lower column, line 10 to page 28, left upper column, the last line, and page 35, right lower column, line 12, to page 36, right upper column, line 7 | Page 63, line 51 to page 64, line 56 |

TABLE 17

| Photographic constituents, and the like | JP-A-62-215272 | JP-A-2-33144 | EPO No. 355,66OA2 |
|---|---|---|---|
| Hardening agents | Page 146 right upper column, line 8 to page 155, left lower column, line 4 | — | — |
| Developing agent precursors | Page 155, left lower column, line 5 to page 155, right lower column, line 2 | — | — |
| Development inhibitor releasing compounds | Page 155, right lower column, line 3 to line 9 | — | — |
| Supports | Page 155, right lower column, line 19 to page 156, left upper column, line 14 | Page 38, right upper column, line 18 to page 39, left upper column, line 3 | Page 66, line 29 to page 67, line 13 |
| Constitution of sensitive material layers | Page 156, left upper column, line 15 to page 156, right lower column, line 14 | Page 28, right upper column, line 1 to line 15 | Page 45, line 41 to line 52 |
| Dyes | Page 156, right lower column, line 15 to page 184, right lower column, the last line | Page 38, left upper column, line 12 to right upper column, line 7 | Page 66, line 18 to line 22 |
| Color mixing inhibitors | Page 185, left upper column, line 1 to page 188, right lower column, line 3 | Page 36, right upper column, line 8 to line 11 | Page 64, line 57 to line 65, line 1 |
| Gradation adjusting agents | Page 188, right lower column, line 4 to line 8 | — | — |

TABLE 18

| Photographic constituents, and the like | JP-A-62-215272 | JP-A-2-33144 | EPO No. 355,66OA2 |
|---|---|---|---|
| Antistain agents | Page 188, right lower column, line 9 to page 193, right lower column, line 10 | Page 37, left upper column, the last line to right lower column, line 13 | Page 65, line 32 page 66, line 17 |
| Surfactants | Page 201, left lower | Page 18, right upper | — |

TABLE 18-continued

| Photographic constituents, and the like | JP-A-62-215272 | JP-A-2-33144 | EPO No. 355,66OA2 |
|---|---|---|---|
| | column, line 1 to page 210, right upper column, the last line | column, line 1 to page 24, right lower column, the last line, and page 27, left lower column, 10th line from the last line to right lower column, line 9 | |
| Fluorine-containing compounds (For use as antistatic agents, coating aids, lubricants, antiadhesive agents, etc.) | Page 210, left lower column, line 1 to page 222, left lower column, line 5 | Page 25, left upper column, line 1 to page 27, right lower column, line 9 | — |
| Binders (Hydrophilic colloids) | Page 222, left lower column, line 6 to page 225, left upper column, the last line | Page 38, right upper column, line 8 to line 18 | Page 66, line 23 to line 28 |
| Thickeners | Page 225, right upper column, line 1 to page 227, right upper column, line 2 | — | — |
| Antistatic agents | Page 227, right upper column, line 3 to page 230, left upper column, line 1 | — | — |

TABLE 19

| Photographic constituents, and the like | JP-A-62-215272 | JP-A-2-33144 | EPO No. 355,66OA2. |
|---|---|---|---|
| Polymer latex | Page 230, left upper column, line 2 to page 239, the last line | — | — |
| Matte agents | Page 240, left upper column, line 1 to page 240, right upper column, the last line | — | — |
| Photographic processing methods (processing steps, additives, etc) | Page 3, right upper column, line 7 to page 10, right upper column, line 5 | Page 39, left upper column, line 4 to page 42, left upper column, the last line | Page 67, line 14 to page 69, line 28 |

Note:
The cited portions of JP-A-62-215272 include portions which have been amended by an amendment dated March 16, 1987, which is appended to the end of the published specification.
Further, it is preferable to use, as yellow couplers among the above mentioned color couplers so-called yellow couplers of a short wavelength type, which are disclosed in JP-A-63-231451, JP-A-63-123047, JP-A-63-241547, JP-A-1-173499, JP-A-1-213648 and JP-A-1-250944.

It is preferred that cyan, magenta, and yellow couplers are emulsified and dispersed in an aqueous hydrophilic colloidal solution, after they are incorporated in loadable latex polymers (see, for example, U.S. Pat. No. 4,203,716) in the presence or absence of high boiling point organic solvents listed in the above tables, or after they are dissolved along with polymers which are insoluble in water but soluble in organic solvents.

Preferable examples of the polymers which are insoluble in water but soluble in organic solvents include homopolymers or copolymers described in U.S. Pat. No. 4,857,449, from column 7 to column 15, and WO 88/0723,pages 12 to 30. Specifically, methacrylate or acrylamide polymers, particularly acrylamide polymers, are preferred.

It is preferred that the light-sensitive materials of the present invention contain compounds for improving color image storability as described in European Patent Application No. 0,277,589 A2 together with couplers. Particularly, use in combination with pyrazoloazole couplers, pyrrolotriazole couplers, or acylacetamide yellow couplers is preferred.

In other words, in order to prevent generation of stains due to formation of color developing dyes by reaction, during storage after processing, between a primary developer remaining in a membrane or its oxidation product with a coupler, it is preferred that the compounds described in the above European Patent Application are used singly or in combination, the compounds being capable of chemically binding to a primary developer of aromatic amines remaining after a color developing process so as to produce chemically inert and substantially colorless compounds, or being capable of chemically binding to an oxidation product of a primary developer of aromatic amines remaining after a color developing process so as to produce chemically inert and substantially colorless compounds.

Examples of cyan couplers which can be additionally used in the present invention include phenol type couplers and naphthol type couplers described in the publications in the table above, diphenylimidazole type cyan couplers described in JP-A-2-33,144, 3-hydroxypyridine type cyan couplers described in EP-0,333,185 A2, cyclic active methylene type cyan couplers described in JP-A-64-32,260, pyrrolopyrazole type cyan couplers described in European Patent Application No. 0,456,226 A1,pyrroloimidazole type cyan couplers described in EP-0,484,909, and pyrrolotriazole type cyan couplers described in EP-0,488,248 A1 and EP-0,491,197 A1. Among them, pyrrolotriazole type cyan couplers are particularly preferred.

Examples of magenta couplers which may be additionally used in the invention include 5-pyrazolone magenta couplers described in the publications in the table above. In view of picture image storability and less variation in image quality, preferred are the 5-pyrazolone type magenta couplers from which arylthio groups leave and which are described in WO92/18901, WO 92/18902, and WO 92/18903.

Known pyrazoloazole couplers other than defined in the invention may also be used, among which preferred are pyrazoloazole couplers containing a sulfonamide group in the molecule, as described in JP-A-61-65,246; pyrazoloazole couplers having an alkoxyphenylsulfonamide ballast group, as described in JP-A-61-147,254; and pyrazoloazole couplers having an alkoxy group or aryloxy group at the 6-position described in EP-226,849 A and EP-294,785 A.

As for yellow couplers, known acylacetoanilide couplers other than defined in the invention are preferably used. Among them, preferred are pivaloyl acetoanilide type couplers having a halogen atom or an alkoxy group at the orthoposition of an anilide ring; acylacetanilide type couplers in which the acyl group is a cycloalkane carbonyl group substituted at the 1- position described in EP-0,447,969 A, JP-A-5-107,701,and JP-A-5-113,642; and malondianilide type couplers described in EP-0,482,552 A and EP-0,524,540 A.

The color sensitive materials according to the present invention are preferably processed by the method listed in the above table, or by using the materials and methods described in JP-A-2-207250, from page 26, lower right column, line 1 to page 34, upper right column, line 9, and JP-A-4-97,355, from page 5, upper left column, line 17 to page 18 lower right column, line 20.

EXAMPLES

The present invention will further be described by way of examples, which should not be construed as limiting the present invention.

Example 1

A surface of a paper support, both surfaces of which were laminated with polyethylene, was subjected to a corona discharging treatment, and thereafter a gelatin undercoat layer containing sodium dodecylbenzenesulonate was provided thereon. Furthermore, various photographic constituent layers were formed thereon to prepare a multilayer color printing paper 000 having the layer-structure as described below. The coating solutions were prepared in the following manner.

Preparation of a coating solution for a first layer:

122.0 g of a yellow coupler ExY, 15.4 g of a first color image stabilizer Cpd-1, 7.5 g of a second color image stabilizer Cpd-2,and 16.7 g of a third color image stabilizer Cpd-3 were dissolved in a mixture of a solvent Solv-1 (44 g) and ethyl acetate (180 cc). The mixture was then emulsified and dispersed in 1000 g of 10% aqueous gelatin solution containing 86 ml of 10% sodium dodecylbenzene sulfonate to obtain an emulsion A. Separately, a silver chlorobromide emulsion A (cubic, mixture of large grain emulsion A having an average grain size of 0.88 μm and small grain emulsion A having an average grain size of 0.70 μm (3:7 in molar ratio of silver)) was prepared. The variation coefficients of distribution of the grain sizes were 0.08 for the large grains and 0.10 for the small grains. In grains of both sizes, 0.3 mol % of silver bromide was locally included into a part of the surface of each grain containing silver chloride as a matrix. The below described blue color sensitizing dyes A, B and C were added to large grains of the emulsion A in an amount of $8.0\times10^{-5}$ mol/1 mol of silver, and to small grains of emulsion A in an amount of $1.0\times10^{-4}$ mol/1 mol of silver. A sulfur sensitizer and a gold sensitizer were added for chemical ripening. The above-described emulsion A and the silver chlorobromide emulsion A were mixed and dissolved to prepare a coating solution, for a first layer, which had the following composition. An amount of the applied emulsion was indicated by an amount of silver.

Coating solutions for the second to seventh layers were prepared in a similar manner. A sodium salt of 1-oxy-3,5-dichloro-s-triazine was used as a gelatin setting agent in each layer.

Also, Cpd-12, Cpd-13, Cpd-14 and Cpd-15 were added in each layer so that their total amounts would become 15.0 mg/m$^2$, 60.0 mg/m$^2$, 5.0 mg/m$^2$ and 10.0 mg/m$^2$, respectively.

For silver chlorobromide emulsion in each light-sensitive emulsion layer, the following spectral sensitizing dyes were used:

Blue sensitive emulsion layer:

Sensitizing Dye A

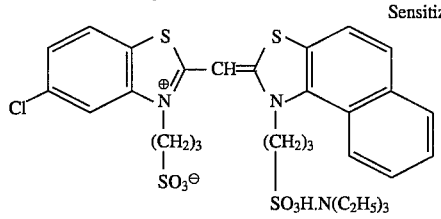

Sensitizing Dye B

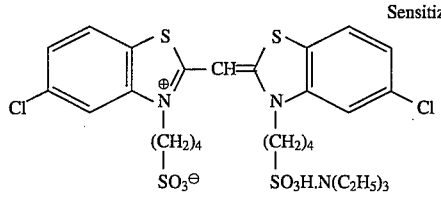

Sensitizing Dye C

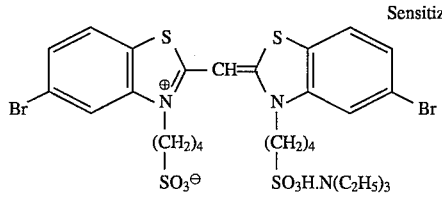

The above compound was added to large grains of emulsion in an amount of $1.4\times10^{-4}$ mol/1 mol of silver halide, and to small grains of emulsion in an amount of $1.7\times10^{-4}$ mol/1 mol of silver halide.

Green sensitive emulsion layer:

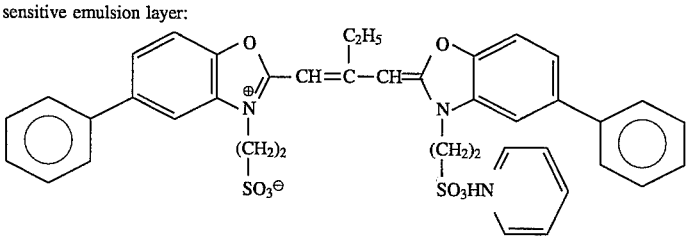

Sensitizing Dye D

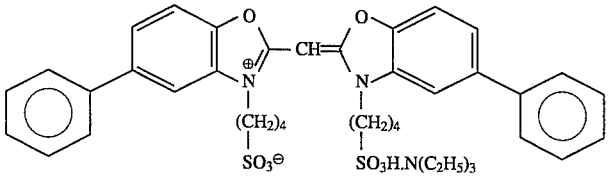

Sensitizing Dye E

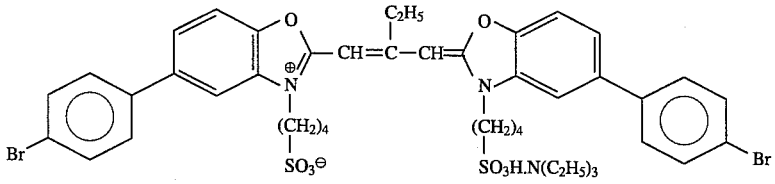

Sensitizing Dye F

The sensitizing dye D was added to large grains of emulsion in an amount of $3.0\times10^{-4}$ mol/1 mol of silver halide, and to small grains of emulsion in an amount of $3.6\times10^{-4}$ mol/1 mol of silver halide. The sensitizing dye E was added to large grains of emulsion in an amount of $4.0\times10^{-5}$ mol/1 mol of silver halide, and to small grains of emulsion in an amount of $7.0\times10^{-5}$ mol/1 mol of silver halide. The sensitizing dye F was added to large grains of emulsion in an amount of $2.0\times10^{-4}$ mol/1 mol of silver halide, and to small grains of emulsion in an amount of $2.8\times10^{-4}$ mol/1 mol of silver halide.

Red sensitive layer:

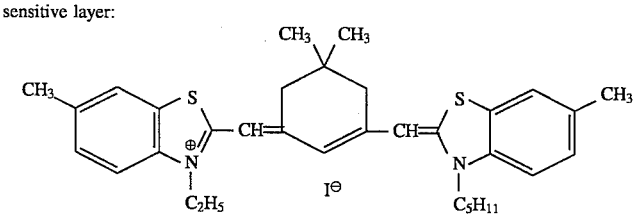

Sensitizing Dye G

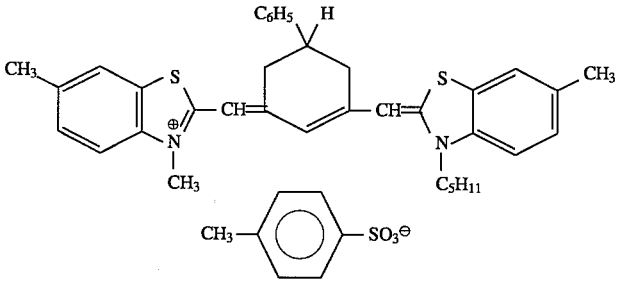

Sensitizing Dye H

The above compound was added to large grains of emulsion in an amount of $5.0\times10^{-5}$ mol/1 mol of silver halide, and to small grains of emulsion in an amount of $8.0\times10^{-5}$ mol/1 mol of slaver halide.

In addition, the following compound was added to the red sensitive emulsion layer in an amount of $2.6\times10^{3}$/1 mol of silver halide.

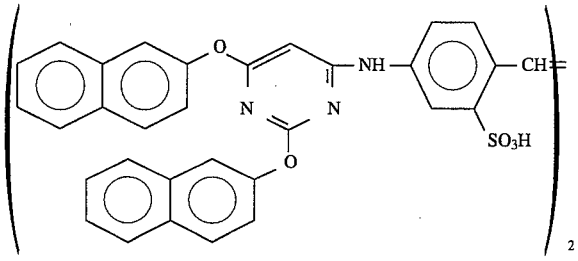

Also, 1-(5-methylureidophenyl)-5-mercaptotetrazole was added to the blue sensitive emulsion layer, the green sensitive emulsion layer, and red sensitive emulsion layer, in amounts of $3.3\times10^{-4}$ mol, $1.0\times10^{-3}$ mol, and $5.9\times10^{-4}$ mol, respectively, with respect to 1 mol of silver halide.

Moreover, they were added in the second, fourth, sixth and seventh layers so that their amounts would become 0.2 mg/m$^2$, 0.2 mg/m$^2$, 0.6 mg/m$^2$ and 0.1 mg/m$^2$, respectively Additionally, 4-hydroxy-6-methyl-1,3,3a, 7-tetrazaindene was added to the blue sensitive emulsion layer and the green sensitive emulsion layer in amounts of $1\times10^{-4}$ mol and $2\times10^{-4}$ mol, respectively, with respect to 1 mol of silver halide.

The below described dye was Further added to the emulsion layer to prevent irradiation (values in the parentheses indicate the amount of dies applied).

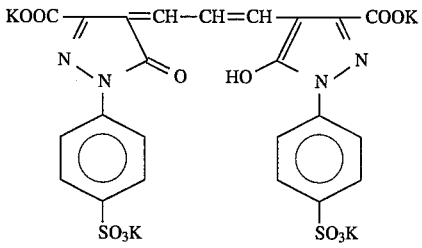

(10 mg/m$^2$)

and

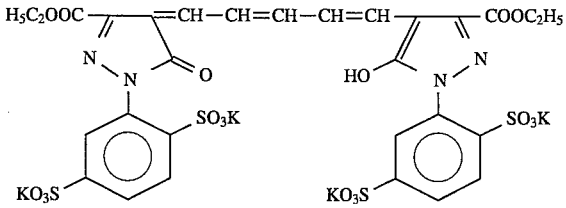

(40 mg/m$^2$)

Structure of the layers

The composition of each layer is shown below, wherein the figures indicate the amounts of coat (g/m$^2$). The amount of silver halide is shown by the amount of silver contained therein.

| Support: | |
|---|---|
| Polyethylene-laminated paper (The polyethylene film on the side of the first layer contained a white pigment ($TiO_2$, 15% by weight) and a blue dye (ultramarine). | |
| First layer (blue sensitive emulsion layer): | |
| The above-described silver chlorobromide A | 0.27 |
| Gelatin | 1.43 |
| Yellow coupler (ExY) | 0.61 |
| Color Image stabilizer (Cpd-1) | 0.08 |

-continued

| | |
|---|---|
| Color Image stabilizer (Cpd-2) | 0.04 |
| Color Image stabilizer (Cpd-3) | 0.08 |
| Solvent (Solv-1) | 0.22 |
| Second layer (color amalgamation preventing layer) | |
| Gelatin | 0.99 |
| Color amalgamation preventing agent (Cpd-4) | 0.10 |
| Solvent (Solv-1) | 0.07 |
| Solvent (Solv-2) | 0.20 |
| Solvent (Solv-3) | 0.15 |
| Solvent (Solv-7) | 0.12 |
| Third layer (green sensitive emulsion layer) | |
| Silver chlorobromide (cubic, a mixture of large grain emulsion B having an average grain size of 0.55 μm and small grain emulsion B having an average grain size of 0.39 μm (1:3 in molar ratio of silver)). The variation coefficients of distribution of the grain sizes were 0.10 for the large grains and 0.08 for the small grains. In grains of both sizes, 0.8 mol % of silver bromide was locally included into a part of the surface of each grain containing silver chloride as a matrix.) | 0.13 |
| Gelatin | 1.35 |
| Magenta coupler (ExM) | 0.12 |
| Ultraviolet absorbing agent (UV-1) | 0.12 |
| Color image stabilizer (Cpd-2) | 0.01 |
| Color image stabilizer (Cpd-5) | 0.01 |
| Color image stabilizer (Cpd-6) | 0.01 |
| Color image stabilizer (Cpd-7) | 0.08 |
| Color image stabilizer (Cpd-8) | 0.01 |

-continued

| | |
|---|---|
| Solvent (Solv-4) | 0.30 |
| Solvent (Solv-5) | 0.15 |
| Fourth layer (color amalgamation preventing layer): | |
| Gelatin | 0.72 |
| Color amalgamation preventing agent (Cpd-4) | 0.07 |
| Solvent (Solv-1) | 0.05 |
| Solvent (Solv-2) | 0.15 |
| Solvent (Solv-3) | 0.12 |
| Solvent (Solv-7) | 0.09 |
| Fifth layer (red sensitive emulsion layer): | |
| Silver chlorobromide (cubic, a mixture of large grain emulsion C having an average grain size of 0.50 μm and small grain emulsion C having an average grain size of 0.41 μm (1:4 in molar ratio of silver)). The variation coefficients of distribution of the grain sizes were 0.09 for the large grains and 0.11 for | 0.18 |

| | |
|---|---|
| the small grains. In grains of both sizes, 0.8 mol % of silver bromide was locally included into a part of the surface of each grain containing silver chloride as a matrix.) | |
| Gelatin | 0.80 |
| Cyan coupler (ExC) | 0.28 |
| Ultraviolet absorbing agent (UV-3) | 0.19 |
| Color image stabilizer (Cpd-1) | 0.24 |
| Color image stabilizer (Cpd-6) | 0.01 |
| Color image stabilizer (Cpd-8) | 0.01 |
| Color image stabilizer (Cpd-9) | 0.04 |
| Color image stabilizer (Cpd-10) | 0.01 |
| Solvent (Solv-1) | 0.01 |
| Solvent (Solv-6) | 0.21 |

| | |
|---|---|
| Sixth layer (Ultraviolet absorbing layer): | |
| Gelatin | 0.64 |
| Ultraviolet absorbing agent (UV-2) | 0.39 |
| Color image stabilizer (Cpd-7) | 0.05 |
| Solvent (Solv-8) | 0.05 |
| Seventh layer (Protection layer): | |
| Gelatin | 1.01 |
| Acrylic modified copolymer of polyvinylalcohol (degree of modification: 17%) | 0.04 |
| Liquid paraffin | 0.02 |
| Surfactant (Cpd-11) | 0.01 |

(ExY) Yellow Coupler

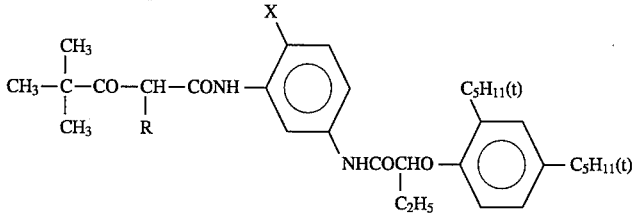

(ExY-1)

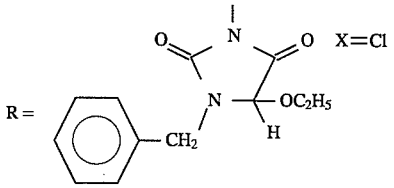

(ExY-2)

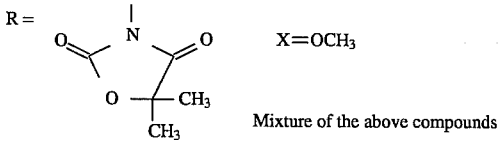

Mixture of the above compounds (ExM) Magenta Coupler
(mole ratio = 1:1)

(ExM-1)

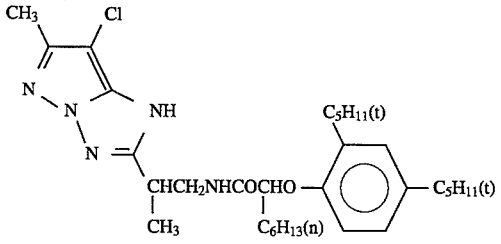

(ExM-2)

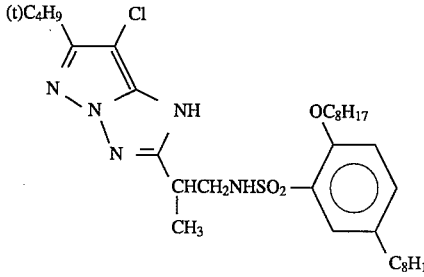

Mixture of the above compounds (mole ratio = 1:1)

-continued
(ExC)
Cyan Coupler
(ExC-1)
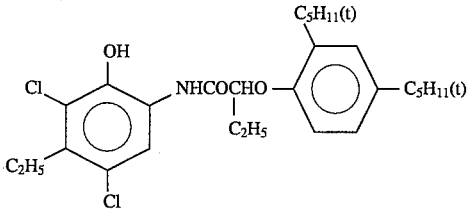
(ExC-2)
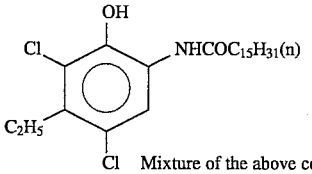
Mixture of the above compounds
(mole ratio = 3:7)
(Cpd-1) Color Image Stabilizer
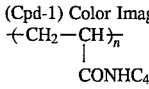
Average molecular weight = 60,000
(Cpd-2) Color Image Stabilizer
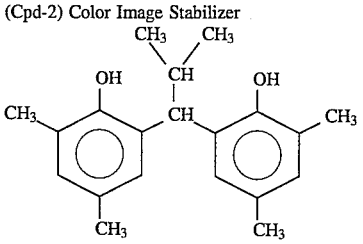
(Cpd-3) Color Image Stabilizer
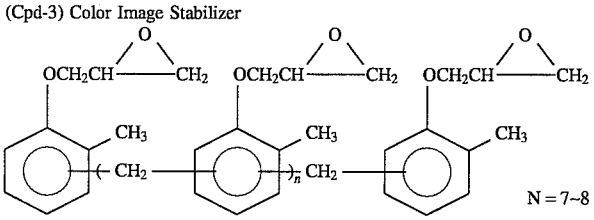
N = 7~8 (average)
(Cpd-4) Color amalgamation preventing Agent
Mixture of
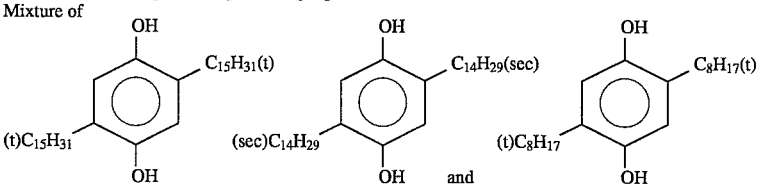
(weight ratio = 1:1:1)
(Cpd-5) Color Image Stabilizer
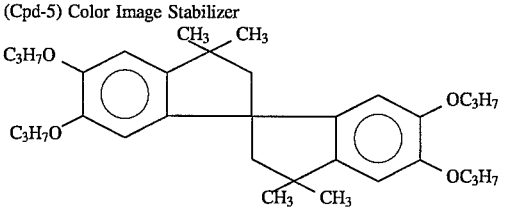

-continued
(Cpd-6) Color Image Stabilizer
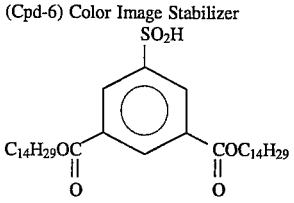
(Cpd-7) Color Image Stabilizer
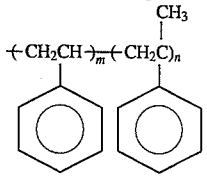
Numerical average molecure weight 600
m/n = 10/90
(Cpd-8) Color Image Stabilizer
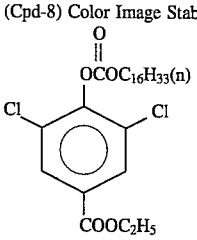
(Cpd-9) Color Image Stabilizer
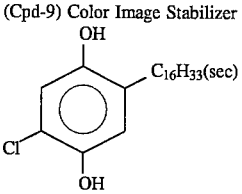
(Cpd-10) Color Image Stabilizer
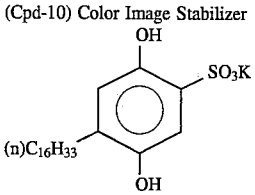
(Cpd-11) Surfactant
Mixture of
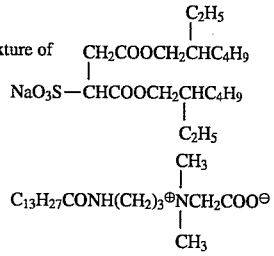
and
(weight ratio = 7:3)
(Cpd-12) Preservative
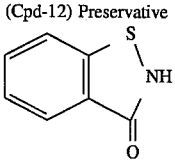

-continued
(Cpd-13) Preservative
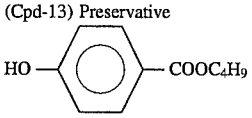
(Cpd-14) Preservative
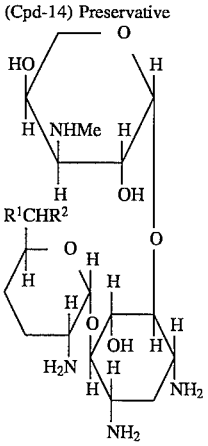
| | $R^1$ | $R^2$ |
|---|---|---|
| a | —Me | —NHMe |
| b | —Me | —$NH_2$ |
| c | —H | —$NH_2$ |
| d | —H | —NHMe |
Mixture of a, b, c and d (weight ratio = 1:1:1:1)
(Cpd-15) Preservative
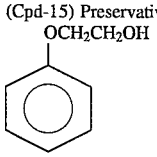
(UV-1) UV-Absorber
(1)
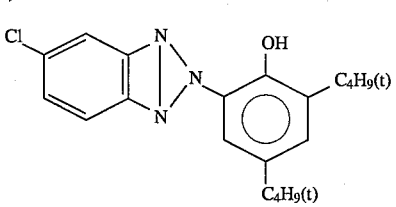
(2)
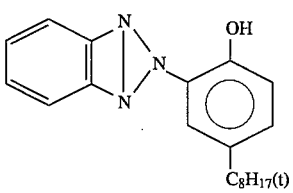
(3)
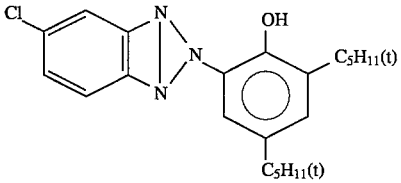
Mixture of (1), (2) and (3) (weight ratio = 1:3:4)

-continued
(UV-2) UV-Absorber
(1)
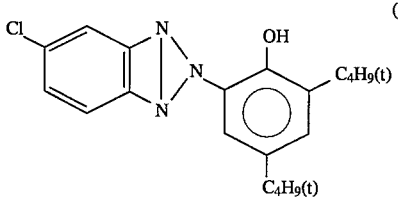
(2)
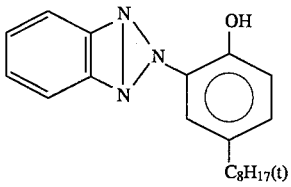
(3)
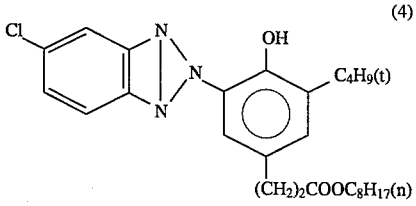
(4)
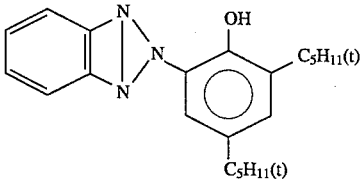
(5)
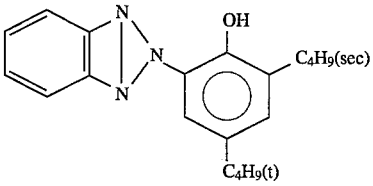
Mixture of (1), (2), (3), (4) and (5)
(weight ratio = 1:2:2:3:1)
(UV-3) UV-Absorber
(1)
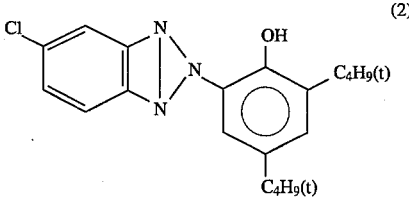
(2)
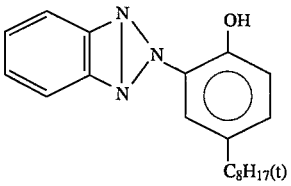
(3)
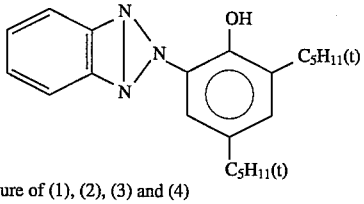
(4)
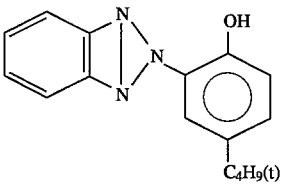
Mixture of (1), (2), (3) and (4)
(weight ratio = 1:3:2:1)
(Solv-1) Solvent
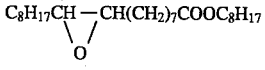
(Solv-2) Solvent
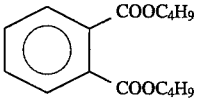
(Solv-3) Solvent
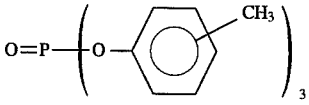
(Solv-3) Solvent
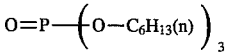

-continued (Solv-5) Solvent

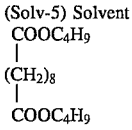

(Solv-6) Solvent

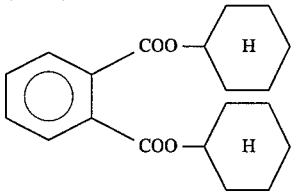

(Solv-7) Solvent

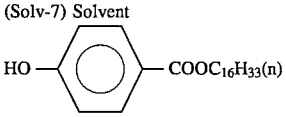

(Solv-8) Solvent

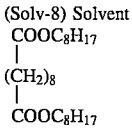

(Solv-9) Solvent

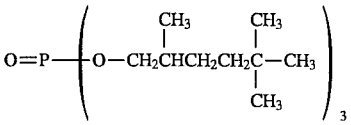

Samples 001–026 were manufactured which were the same as the sample 000, excepting that the magenta coupler in the third layer green-sensitive layer) and the yellow coupler in the first layer (blue-sensitive layer were replaced with each of the couplers shown in the Table A in an amount of equivalent moles. Only the amounts of the coating solutions applied were varied while maintaining their compositions constant so that the maximum color developable concentrations of the first and third layers would become roughly equal to the samples 000.

Subsequently, samples 001A–026A were manufactured which were same as the samples 001–026, excepting that the amount of the coating solution for the second layer (color amalgamation pre.pating layer) was increased to 1.5-fold.

The sample 000 was subjected to exposure using a sensitometer (made by Fuji Photo Film Co, Ltd., model FWH, color temperature of the light source: 3200K), so that about 35% of the applied silver was developed to provide gray.

The above-described samples, each 200 $m^2$, were continuously processed by a paper processor using the following processing steps and the processing solutions.

| Process step | Temperature | Time | Amount of replenishment | Volume of tank |
|---|---|---|---|---|
| Color development | 35° C. | 45 sec. | 161 ml | 10 1 |
| Bleaching/fixing | 35° C. | 45 sec. | 218 ml | 10 1 |
| Rinsing (1) | 35° C. | 30 sec. | — | 5 1 |
| Rinsing (2) | 35° C. | 30 sec. | — | 5 1 |
| Rinsing (3) | 35° C. | 30 sec. | 360 ml | 5 1 |
| Drying | 80° C. | 60 sec. | | |

note: the amount of replenishment is per $m^2$. (Rinsing was performed by 3-tank counterflow from (3) to (1))

The compositions of the processing solutions were as follows:

| | Tank solution | Replenishing solution |
|---|---|---|
| [Color developing solution] | | |
| Water | 800 ml | 800 ml |
| Ethylene diaminetetraacetic acid | 3.0 g | 3.0 g |
| 4,5-Dihydroxybenzene-1,3-disulfonic acid-2 Na | 0.5 g | 0.5 g |
| Triethanolamine | 12.0 g | 12.0 g |
| Potassium chloride | 2.5 g | — |
| Potassium bromide | 0.01 g | — |
| Potassium carbonate | 27.0 g | 27.0 g |
| Fluorescent whitening agent (WHITEX 4, product of Sumitomo Kagaku Co.) | 1.0 g | 2.5 g |
| Sodium sulfite | 0.1 g | 0.2 g |
| Disodium-N,N-bis(sulfonate ethyl) hydroxylamine | 5.0 g | 8.0 g |
| N-ethyl-N-(β-methanesulfonamide ethyl)-3-methyl-4-aminoaniline. 3/2 sulfuric acid.1$H_2O$ | 5.0 g | 7.1 g |
| Total amount after adding water | 1000 ml | 1000 ml |
| pH (at 25° C., adjusted with potassium hydroxide and sulfuric acid) | 10.05 | 10.45 |

[Bleaching/fixing solution (the tank solution and the replenishing solution were the same)]

| | |
|---|---|
| Water | 600 ml |
| Ammonium thiosulfate (700 g/liter) | 100 ml |
| Ammonium sulfite | 40 g |
| Ammonium (ethylenediamine tetraacetate) iron (III) | 55 g |
| Ethylene diamine tetraacetate iron | 5 g |
| Ammonium bromide | 40 g |

-continued

| | |
|---|---|
| Sulfuric acid (67%) | 30 g |
| Total amount after adding water | 1000 ml |
| pH (at 25° C., adjusted with acetic acid and aqueous ammonia | 5.8 |
| [Rinsing solution (the tank solution and the replenishing solution were the same)] | |
| Chlorinated sodium isocyanurate | 0.02 g |
| Deionized water (conductivity: not greater than 5 μs/cm) | 1000 ml |
| pH | 6.5 |

Samples 001–026 and samples 001A–026A were subjected to gradation exposure through a green filter, and were processed using the above-described processing solutions. After processing, optical densities of the samples were measured by using green light and blue light. First, density was measured by using green light, and the amount of light which provided a density of 1.5 was determined. Subsequently, the same measurement was performed by using the above specific amount of blue light to obtain $D_B(D_G=1.5)$. After that, samples exposed with blue light were processed and measured in the same manner. In this case, density was first measured using blue light, and the amount of blue light which provided a density of 1.5 was determined. Subsequently, the same measurement was performed by using the above specific amount of green light to obtain $D_G(D_B=1.5)$. A value obtained by subtracting the value of $D_B(D_G=1.5)$ of sample 001A from the value of $D_B(D_G=1.5)$ sample 001 was defined as $\Delta D_B(D_G=1.5)$. The values of $D_B(D_G=1.5)$ of other samples were also subjected to the same subtraction. The values of $\Delta D_G(D_B=1.5)$ were also measured in the same manner. The values of $\Delta D_B(D_G=1.5)$ and $\Delta D_G(D_B=1.5)$ thus obtained are shown in Table A.

It is generally known that color amalgamation during processing is reduced as the thickness of each color amalgamation prohibiting layer (intermediate layer) increases. Accordingly, the smaller the values of $\Delta D_B(D_G=1.5)$ and $\Delta D_G(D_B=1.5)$ are, the smaller the degree of color amalgamation becomes. As a result, more excellent color reproducing performance is provided.

TABLE A

| Sample No. | Magenta Coupler | Yellow Coupler | $\Delta D_G$ ($D_B$ = 1.5) | $\Delta D_B$ ($D_G$ = 1.5) | |
|---|---|---|---|---|---|
| 001 | ExM-1 | ExY-1 | +0.04 | +0.02 | Cm |
| 002 | ExM-1 | ExY-2 | +0.03 | +0.03 | Cm |
| 003 | ExM-2 | ExY-1 | +0.01 | +0.12 | Cm |
| 004 | ExM-1 | Y-3 | +0.02 | +0.07 | Cm |
| 005 | ExM-1 | Y-21 | +0.03 | +0.05 | Cm |
| 006 | M-1 | ExY-1 | +0.07 | +0.02 | Cm |
| 007 | M-1 | ExY-2 | +0.06 | +0.03 | Cm |
| 008 | M-1 | Y-3 | +0.02 | +0.02 | I |
| 009 | M-1 | Y-21 | +0.02 | +0.02 | I |
| 010 | M-1 | Y-1 | +0.01 | +0.01 | I |
| 011 | M-1 | Y-7 | +0.01 | +0.02 | I |
| 012 | M-1 | Y-8 | +0.01 | +0.01 | I |
| 013 | M-1 | Y-14 | +0.02 | +0.02 | I |
| 014 | M-1 | Y-35 | +0.01 | +0.03 | I |
| 015 | M-1 | Y-39 | +0.01 | +0.02 | I |
| 016 | M-4 | Y-4 | +0.02 | +0.02 | I |
| 017 | M-5 | Y-4 | +0.01 | +0.03 | I |
| 018 | M-44 | Y-4 | +0.02 | +0.02 | I |
| 019 | M-45 | Y-4 | +0.02 | +0.02 | I |
| 020 | M-3 | Y-5 | +0.02 | +0.03 | I |
| 021 | M-7 | Y-6 | +0.02 | +0.03 | I |
| 022 | M-39 | Y-36 | +0.01 | +0.01 | I |
| 023 | M-34 | Y-3 | +0.04 | +0.04 | I |
| 024 | M-37 | Y-3 | +0.03 | +0.03 | I |
| 025 | M-38 | Y-3 | +0.02 | +0.03 | I |
| 026 | M-14 | Y-3 | +0.01 | +0.03 | I |
| 027 | M-1 | Y-73 | +0.01 | +0.01 | I |

TABLE A-continued

| Sample No. | Magenta Coupler | Yellow Coupler | $\Delta D_G$ ($D_B$ = 1.5) | $\Delta D_B$ ($D_G$ = 1.5) | |
|---|---|---|---|---|---|
| 028 | M-1 | Y-74 | +0.01 | +0.01 | I |
| 029 | M-1 | Y-75 | +0.02 | +0.02 | I |
| 030 | M-4 | Y-73 | +0.01 | +0.01 | I |

Cm: Comparative Example
I: The Present invention (the same as in tables below)

As is apparent from samples 001–009 in Table A, when magenta coupler M-1 of the present invention was used in combination with yellow coupler Y-3 or Y-21 of the invention, $\Delta D_B(D_G=1.5)$ and $\Delta D_G(D_B=1.5)$ both became smaller so that the color amalgamation during processing would reduce, compared to the case where the comparative couplers were used in combination. When the magenta coupler of the present invention was used, the color developable performance, color fastness against light, process-dependency were considerably improved compared to the case where the comparative magenta couplers were used. However, when only one of the magenta coupler or yellow coupler was replaced with the coupler of the present invention, the degree of color amalgamation increased in one of the layers. Accordingly, only when the couplers of the present invention are combined with each other, the features of the magenta coupler of the present invention emerge, thereby improving the color reproducing performance.

Example 2

Samples 001–026 and reference samples 001A–026A in Example 1 were stored in a refrigerator at 5° C. for 10 days, while the same samples were stored at 40° C. and 80% RH for 10 days. Subsequently, these samples were exposed and processed in a manner similar to that described in Example 1. The densities of the samples were measured by using blue light and green light. Measured was the amount of increase in fogging density (the lowest color generating density) of each sample which had undergone a storage at 40° C. and 80% RH, compared to that of the corresponding sample stored in a refrigerator. The increases measured are shown in Table B as $\Delta D_{G\ min}$ and $\Delta D_{B\ min}$.

TABLE B

| Sample No. | Magenta Coupler | Yellow Coupler | Magenta Fog $\Delta D_{Gmin}$ | Yellow Fog $\Delta D_{Bmin}$ | |
|---|---|---|---|---|---|
| 001 | ExM-1 | ExY-1 | +0.02 | +0.03 | Cm |
| 002 | ExM-1 | ExY-2 | +0.02 | +0.03 | Cm |
| 003 | ExM-2 | ExY-1 | +0.01 | +0.04 | Cm |
| 004 | ExM-1 | Y-3 | +0.05 | +0.09 | Cm |
| 005 | ExM-1 | Y-21 | +0.04 | +0.07 | Cm |
| 006 | M-1 | ExY-1 | +0.01 | +0.03 | Cm |
| 007 | M-1 | ExY-2 | +0.02 | +0.03 | Cm |
| 008 | M-1 | Y-3 | +0.02 | +0.03 | I |
| 009 | M-1 | Y-21 | +0.01 | +0.02 | I |
| 010 | M-1 | Y-1 | +0.02 | +0.02 | I |
| 011 | M-1 | Y-7 | +0.02 | +0.02 | I |
| 012 | M-I | Y-8 | +0.02 | +0.01 | I |
| 013 | M-1 | Y-14 | +0.02 | +0.02 | I |
| 014 | M-1 | Y-35 | +0.02 | +0.03 | I |
| 015 | M-1 | Y-39 | +0.02 | +0.03 | I |
| 016 | M-4 | Y-4 | +0.01 | +0.02 | I |
| 017 | M-5 | Y-4 | +0.01 | +0.02 | I |
| 018 | M-44 | Y-4 | +0.02 | +0.02 | I |
| 019 | M-45 | Y-4 | +0.02 | +0.02 | I |
| 020 | M-3 | Y-5 | +0.02 | +0.02 | I |
| 021 | M-7 | Y-6 | +0.03 | +0.03 | I |
| 022 | M-39 | Y-36 | +0.02 | +0.03 | I |

TABLE B-continued

| Sample No. | Magenta Coupler | Yellow Coupler | Magenta Fog $\Delta D_{Gmin}$ | Yellow Fog $\Delta D_{Bmin}$ | |
|---|---|---|---|---|---|
| 023 | M-34 | Y-3 | +0.03 | +0.04 | I |
| 024 | M-37 | Y-3 | +0.02 | +0.03 | I |
| 025 | M-38 | Y-3 | +0.03 | +0.03 | I |
| 026 | M-14 | Y-3 | +0.02 | +0.02 | I |

From Table B, it is understood that fogging of yellow and magenta occurred after storage at 40° C. and 80% RH when the yellow coupler of the present invention was used in combination with comparative magenta coupler ExM-1, but that such a problem hardly occurred when the yellow coupler of the present invention was used in combination with the magenta coupler of the present invention.

Example 3

Samples 101–120 were manufactured in the same manner as that described for the sample 000, excepting that the magenta coupler and yellow coupler of sample 000 of Example 1 were replaced with each of couplers shown in Table C in an amount of equivalent moles, and the amount of the coating of the second layer was changed as shown in Table C. These samples were exposed and processed in a manner similar to that used in Example 1,and evaluation for color amalgamation was carried out in a manner similar to that used in Example 1 using reference samples in which the amount of coating of the second layers was 1.5 times.

From Table C, it is understood that the color amalgamation during processing was reduced by a combined use of the yellow coupler of the present invention and the magenta coupler of the present invention. It is also understood that when the yellow coupler of the present invention and the magenta coupler of the present invention were used in combination, the increase of the color amalgamation was considerably small compared to the comparative couplers even if the amount of coating of the second layer was decreased. As described above, the combination of couplers according to the present invention allows a designing of a practical and thin color amalgamation preventing layer, and it therefore is excellent in quick processing and economy.

Example 4

Samples 201–208 were manufactured in a manner identical to that described for the sample 000, excepting that the magenta coupler, yellow coupler and cyan coupler of sample 000 were changed as shown in Table D. Also, as reference samples, samples 201A–208A corresponding to samples 201–208 were manufactured by increasing the amounts of coating for their second layers to 1.5-fold. These samples were exposed to blue light, green light and red light, respectively, and were developed in a manner similar to that described in Example 1.After processing, the values of $\Delta D_G(D_B=1.5)$, $\Delta D_B(D_G=1.5)$, $\Delta D_G(D_R=1.5)$ and $\Delta D_R(D_G=1.5)$ were measured. The results of the measurement are shown in Table D.

TABLE C

| Sample No. | Magenta Coupler | Yellow Coupler | Amount of Coating for Second Layer | $\Delta D_G(D_B = 1.5)$ | $\Delta D_B(D_G = 1.5)$ | |
|---|---|---|---|---|---|---|
| 101 | ExM-1 | ExY-2 | 150% | 0.00 | 0.00 | Cm |
| 102 | ExM-1 | ExY-2 | 120% | +0.02 | +0.01 | Cm |
| 103 | ExM-1 | ExY-2 | 100% | +0.04 | +0.02 | Cm |
| 104 | ExM-1 | ExY-2 | 80% | +0.07 | +0.05 | Cm |
| 105 | ExM-1 | ExY-2 | 60% | +0.13 | +0.09 | Cm |
| 106 | ExM-1 | Y-4 | 150% | 0.00 | 0.00 | Cm |
| 107 | ExM-1 | Y-4 | 120% | +0.01 | +0.03 | Cm |
| 108 | ExM-1 | Y-4 | 100% | +0.02 | +0.07 | Cm |
| 109 | ExM-1 | Y-4 | 80% | +0.04 | +0.09 | Cm |
| 110 | ExM-1 | Y-4 | 60% | +0.08 | +0.13 | Cm |
| 111 | M-4 | ExY-1 | 150% | 0.00 | 0.00 | Cm |
| 112 | M-4 | ExY-1 | 120% | +0.03 | +0.01 | Cm |
| 113 | M-4 | ExY-1 | 100% | +0.06 | +0.02 | Cm |
| 114 | M-4 | ExY-1 | 80% | +0.09 | +0.05 | Cm |
| 115 | M-4 | ExY-1 | 60% | +0.14 | +0.09 | Cm |
| 116 | M-4 | Y-4 | 150% | 0.00 | 0.00 | I |
| 117 | M-4 | Y-4 | 120% | +0.01 | +0.01 | I |
| 118 | M-4 | Y-4 | 100% | +0.02 | +0.02 | I |
| 119 | M-4 | Y-4 | 80% | +0.03 | +0.04 | I |
| 120 | M-4 | Y-4 | 60% | +0.05 | +0.06 | I |

TABLE D

| Sample No. | Magenta coupler | Yellow coupler | Cyan coupler | $\Delta D_G(D_B = 1.5)$ | $\Delta D_B(D_G = 1.5)$ | $\Delta D_G(D_R = 1.5)$ | $\Delta D_R(D_G = 1.5)$ | |
|---|---|---|---|---|---|---|---|---|
| 201 | ExM-1 | ExY-1 | ExC-1 | +0.04 | +0.02 | +0.06 | +0.03 | Cm |
| 202 | ExM-1 | ExY-1 | ExC-1/ExC-2 (40/60)* | +0.04 | +0.02 | +0.04 | +0.03 | Cm |

TABLE D-continued

| Sample No. | Magenta coupler | Yellow coupler | Cyan coupler | $\Delta D_G(D_B = 1.5)$ | $\Delta D_B(D_G = 1.5)$ | $\Delta D_G(D_R = 1.5)$ | $\Delta D_R(D_G = 1.5)$ | |
|---|---|---|---|---|---|---|---|---|
| 203 | ExM-1 | ExY-1 | ExC-1/ExC-2 (20/80) | +0.04 | +0.02 | +0.03 | +0.04 | Cm |
| 204 | ExM-1 | ExY-1 | Exc-2 | +0.04 | +0.01 | +0.02 | +0.04 | Cm |
| 205 | M-1 | Y-1 | ExC-1 | +0.01 | +0.01 | +0.05 | +0.02 | I |
| 206 | M-1 | Y-1 | ExC-1/ExC-2 (40/60) | +0.01 | +0.01 | +0.03 | +0.02 | I |
| 207 | M-1 | Y-1 | ExC-1/ExC-2 (20/80) | +0.01 | +0.01 | +0.02 | +0.02 | I |
| 208 | M-1 | Y-1 | ExC-2 | +0.01 | +0.01 | +0.01 | +0.02 | I |

Mole ratios are shown in ( )

From Table D, it is understood that the yellow coupler and magenta coupler according to the present invention simultaneously reduced the color amalgamation in the respective layers when ExC-2 containing a linear alkyl group as a ballast group was used.

Example 5

Sample 300 corresponding to Sample 100 in Example 1 was manufactured by changing the compositions of the respective layers as follows:

| | |
|---|---|
| Support: | |
| Polyethylene-laminated paper (The polyethylene film on the side of the first layer contained a white pigment ($TiO_2$, 15% by weight) and a blue dye (ultramarine). | |
| First layer (blue sensitive emulsion layer): | |
| The above-described silver chlorobromide A | 0.24 |
| Gelatin | 1.43 |
| Yellow coupler (ExY) | 0.61 |
| Color image stabilizer (Cpd-1) | 0.14 |
| Color image stabilizer (Cpd-2) | 0.04 |
| Color image stabilizer (Cpd-3) | 0.08 |
| Color image stabilizer (Cpd-5) | 0.04 |
| Solvent (Solv-1) | 0.16 |
| Solvent (Solv-9) | 0.08 |
| Second layer (color amalgamation preventing layer) | |
| Gelatin | 0.99 |
| Color amalgamation preventing agent (Cpd-40) | 0.10 |
| Solvent (Solv-1) | 0.07 |
| Solvent (Solv-2) | 0.20 |
| Solvent (Solv-3) | 0.15 |
| Solvent (Solv-7) | 0.12 |
| Third layer (green sensitive emulsion layer) | |
| Silver chlorobromide (cubic, a mixture of large grain emulsion B having an average grain size of 0.55 μm and small grain emulsion B having an average grain size of 0.39 μm (1:3 in molar ratio of silver)). The variation coefficients of distribution of the grain sizes were 0.10 for the large grains and 0.08 for the small grains. In grains of both sizes, 0.8 mol % of silver bromide was locally included into a part of the surface of each grain containing silver chloride as a matrix.) | 0.12 |
| Gelation | 1.40 |
| Magenta coupler (ExM) | 0.12 |
| Ultraviolet absorbing agent (UV-1) | 0.12 |
| Color image stabilizer (Cpd-2) | 0.01 |
| Color image stabilizer (Cpd-5) | 0.01 |
| Color image stabilizer (Cpd-6) | 0.01 |
| Color image stabilizer (Cpd-7) | 0.08 |
| Color image stabilizer (Cpd-8) | 0.01 |
| Solvent (Solv-4) | 0.20 |
| Solvent (Solv-5) | 0.10 |

-continued

| | |
|---|---|
| Fourth layer (color amalgamation preventing layer): | |
| Gelatin | 0.72 |
| Color amalgamation preventing agent (Cpd-4) | 0.07 |
| Solvent (Solv-1) | 0.05 |
| Solvent (Solv-2) | 0.15 |
| Solvent (Solv-3) | 0.12 |
| Solvent (Solv-7) | 0.09 |
| Fifth layer (red sensitive emulsion layer): | |
| Silver chlorobromide (cubic, a mixture of large grain emulsion C having an average grain size of 0.50 μm and small grain emulsion C having an average grain size of 0.41 μm (1:4 in molar ratio of silver)). The variation coefficients of distribution of the grain sizes were 0.09 for the large grains and 0.11 for the small grains. In grains of both sizes, 0.8 mol % of silver bromide was locally included into a part of the surface of each grain containing silver chloride as a matrix.) | 0.18 |
| Gelatin | 0.90 |
| Cyan coupler (ExC) | 0.28 |
| Ultraviolet absorbing agent (UV-3) | 0.19 |
| Color image stabilizer (Cpd-1) | 0.14 |
| Color image stabilizer (Cpd-6) | 0.01 |
| Color image stabilizer (Cpd-8) | 0.01 |
| Color image stabilizer (Cpd-9) | 0.04 |
| Color image stabilizer (Cpd-10) | 0.01 |
| Solvent (Solv-1) | 0.01 |
| Solvent (Solv-6) | 0.18 |
| Sixth layer (Ultraviolet absorbing layer): | |
| Gelatin | 0.64 |
| Ultraviolet absorbing agent (UV-2) | 0.39 |
| Color image stabilizer (Cpd-7) | 0.05 |
| Solvent (Solv-8) | 0.05 |
| Seventh layer (Protection layer): | |
| Gelatin | 1.01 |
| Acrylic modified copolymer of polyvinylalcohol (degree of modification: 17%) | 0.04 |
| Liquid paraffin | 0.02 |
| Surfactant (Cpd-11) | 0.01 |

Samples 301–304 were manufactured in a manner identical to that described for the sample 300, excepting that the yellow and magenta couplers were replaced with the couplers shown in Table E. Also, as reference samples, samples 301A–304A corresponding to samples 301–304 were manufactured by increasing the amounts of coating for their second layers to 1.5-fold. These samples were exposed to blue light and green light, respectively, and were developed by the following developing processes (A, B and C). These processes were the same as those used in Example 1 except the color generating developing step.

Process A: A developing process was carried out for 45 seconds using a color developing solution having the same composition as in Example 1.

Process B: The concentration of the developing agent of the color developing solution was increased to 1.6-fold, as well as the replenishing solution, compared to that of the developing agent used in Example 1,and the processing time was changed to 30 seconds.

Process C: The same color developing solution as in Example 1 was used, but the processing temperature was changed to 45° C. and the processing time was changed to 30 seconds.

Each of processing solution used in these processes was subjected to a running process, using sample 300, until the amount of replenished solution reached the double amount of the tank solution.

The values of $\Delta D_B(D_G=1.5)$ and $\Delta D_G(D_B=1.5)$ of the processed samples were measured in a manner similar to one used in Example 1.The results of the measurement are shown in Table E.

TABLE E

| Sample No. | Magenta Coupler | Yellow Coupler | $\Delta D_G(D_B = 1.5)$ | $\Delta D_B(D_G = 1.5)$ | Treatment | |
|---|---|---|---|---|---|---|
| 301 | ExM-1 | ExY-2 | +0.04 | +0.02 | A | Cm |
| 302 | ExM-1 | Y-8 | +0.02 | +0.06 | A | Cm |
| 303 | M-1 | ExY-2 | +0.06 | +0.03 | A | Cm |
| 304 | M-1 | Y-8 | +0.01 | +0.01 | A | I |
| 301 | ExM-1 | ExY-2 | +0.06 | +0.03 | B | Cm |
| 302 | ExM-1 | Y-8 | +0.03 | +0.09 | B | Cm |
| 303 | M-1 | ExY-2 | +0.10 | +0.05 | B | Cm |
| 304 | M-1 | Y-8 | +0.02 | +0.02 | B | I |
| 301 | ExM-1 | ExY-2 | +0.05 | +0.06 | C | Cm |
| 302 | ExM-1 | Y-8 | +0.03 | +0.12 | C | Cm |
| 303 | M-1 | ExY-2 | +0.08 | +0.06 | C | Cm |
| 304 | M-1 | Y-8 | +0.02 | +0.02 | C | I |

Treatment A: The same as in Example 1
Treatment B: The concentration of the developing agent of the color developing solution was increased to 1.6-fold, as well as the replenishing solution, compared to that of the developing agent used in Example 1, and the processing time was changed to 30 seconds.
Treatment C: The same color develoing as in Example 1 was used, but the processing temperature was changed to 45° C. and the processing time was changed to 30 seconds.

From Table E, it is apparent that the samples containing the yellow coupler and the magenta coupler according to the present invention exhibited less color amalgamation during the process, compared to the comparative samples, even in the case where the processing time was shortened by increasing the concentration of the developing agent and/or raising the processing temperature, and that the light-sensitive materials according to the present invention are suitable for quick processing.

Example 6

Samples 401–425 were manufactured in a manner identical to that described for the sample 300 of Example 5, excepting that the magenta coupler and the amount of gelatin in the third layer, and the magenta coupler and the amount of gelatin in the first layer were changed as shown in Table F. Also, as reference samples, samples 401A–425A corresponding to samples 401–425 were manufactured by increasing the amounts of coating for their second layers to 1.5-fold. These samples were exposed to blue light and green light, respectively, and were developed by the following developing process D.

Process D: The concentration of the developing agent was increased to 1.6-fold, as well as the replenishing solution, compared to that of the developing agent used in Example 5. The processing temperature was changed to 45° C. and the processing time was changed to 20 seconds.

The values of $\Delta D_B(D_G=1.5)$ and $\Delta D_G(D_B=1.5)$ of the processed samples were measured in a manner similar to one used in Example 1.The results of the measurement are shown in Table F.

TABLE F

| | Third Layer | | First Layer | | Total | | | |
|---|---|---|---|---|---|---|---|---|
| Sample No. | Magenta Coupler | Amount of Gelatin | Yellow Coupler | Amount of Gelatin | Amount of Gelatin | $\Delta D_G(D_B = 1.5)$ | $\Delta D_B(D_G = 1.5)$ | |
| 401 | ExM-1 | 1.40 | ExY-1 | 1.43 | 7.09 | +0.04 | +0.03 | Cm |
| 402 | ExM-1 | 1.40 | ExY-1 | 1.23 | 6.89 | +0.06 | +0.03 | Cm |
| 403 | ExM-1 | 1.40 | ExY-1 | 1.03 | 6.69 | +0.09 | +0.04 | Cm |
| 404 | ExM-1 | 1.20 | ExY-1 | 1.43 | 6.89 | +0.04 | +0.05 | Cm |
| 405 | ExM-1 | 1.00 | ExY-1 | 1.43 | 6.69 | +0.04 | +0.07 | Cm |
| 406 | ExM-1 | 1.20 | ExY-1 | 1.23 | 6.69 | +0.06 | +0.05 | Cm |
| 407 | ExM-1 | 1.10 | ExY-1 | 1.13 | 6.49 | +0.07 | +0.06 | Cm |
| 408 | ExM-1 | 1.00 | ExY-1 | 1.03 | 6.29 | +0.09 | +0.08 | Cm |
| 409 | ExM-1 | 1.40 | Y-1 | 1.43 | 7.09 | +0.03 | +0.08 | Cm |
| 410 | ExM-1 | 1.20 | Y-1 | 1.23 | 6.69 | +0.02 | +0.12 | Cm |
| 411 | ExM-1 | 1.00 | Y-1 | 1.03 | 6.29 | +0.02 | +0.17 | Cm |
| 412 | M-1 | 1.40 | ExY-1 | 1.43 | 7.09 | +0.07 | +0.02 | Cm |
| 413 | M-1 | 1.20 | ExY-1 | 1.23 | 6.69 | +0.12 | +0.02 | Cm |
| 414 | M-1 | 1.00 | ExY-1 | 1.03 | 6.29 | +0.19 | +0.02 | Cm |

TABLE F-continued

| Sample No. | Third Layer Magenta Coupler | Third Layer Amount of Gelatin | First Layer Yellow Coupler | First Layer Amount of Gelatin | Total Amount of Gelatin | $\Delta D_G(D_B = 1.5)$ | $\Delta D_B(D_G = 1.5)$ | |
|---|---|---|---|---|---|---|---|---|
| 415 | M-1 | 1.40 | Y-1 | 1.43 | 7.09 | +0.01 | +0.01 | I |
| 416 | M-1 | 1.40 | Y-1 | 1.23 | 6.89 | +0.02 | +0.01 | I |
| 417 | M-1 | 1.40 | Y-1 | 1.03 | 6.69 | +0.03 | +0.01 | I |
| 418 | M-1 | 1.20 | Y-1 | 1.43 | 6.89 | +0.01 | +0.02 | I |
| 419 | M-1 | 1.00 | Y-1 | 1.43 | 6.69 | +0.01 | +0.03 | I |
| 420 | M-1 | 1.30 | Y-1 | 1.33 | 6.89 | +0.02 | +0.02 | I |
| 421 | M-1 | 1.20 | Y-1 | 1.23 | 6.69 | +0.02 | +0.02 | I |
| 422 | M-1 | 1.10 | Y-1 | 1.13 | 6.49 | +0.03 | +0.03 | I |
| 423 | M-1 | 1.00 | Y-1 | 1.03 | 6.29 | +0.04 | +0.04 | I |
| 424 | ExM-1 | 1.60 | ExY-1 | 1.63 | 7.49 | +0.02 | +0.01 | Cm |
| 425 | M-1 | 1.60 | Y-1 | 1.63 | 7.49 | +0.01 | +0.01 | I |

From Table F, it is understood that in the case where the comparative couplers were used in combination, higher color amalgamation occurred as the amounts of gelatin in the first layer or the third layer was decreased. By constant, in the case where the yellow coupler and the magenta coupler according to the present invention were used, the degree of color amalgamation during processing did not increase so much even when the amounts of gelatin in the First layer or the third layer was decreased. As described above, the combination use of the couplers of the present invention makes it possible to thin the layers of the light-sensitive material. Accordingly, light-sensitive materials can be provided which are economical and suitable for quick processing.

Example 7

Samples were manufactured which were the same as the samples manufactured in Example 1, excepting that the supports of the respective samples were replaced with a neutral paper support (the total amount of titanium white: 6.9 g/m$^2$) which was composed of an upper layer having a thickness of 2.0 μm and containing titanium white in an amount of 10% by weight, an intermediate layer having a thickness of 15.0 μm and containing titanium white in an amount of 35% by weight, and a lower layer having a thickness of 13.0 μm and containing no titanium white, and which was covered by a waterproof resin. The evaluation tests were carried out in the same manner as in Examples 1 and 2. As a result, it was found that the combination use of the couplers of the present invention reduced the color amalgamation and improved the storability in the case where the above support was used.

Example 8

(scanning exposure):

Samples manufactured in Examples 1 and 2 were evaluated in the same manner as in Example 1, excepting that the following exposure was performed. The results were the same as those in Examples 1 and 2.

(Exposure)

As a light source, there were used a laser beam of 473 nm which was taken out from a YAG solid-state laser including a semiconductor laser GaAlAs (wavelength: 808.5 nm) as a light exciting source and was subjected to wavelength conversion by the SHG crystals of $KNbO_3$, a laser beam of 532 nm which was taken out from a $YVO_4$ solid-state laser including a semiconductor laser GaAlAs (wavelength: 808.7 nm) as a light exciting source and was subjected to wavelength conversion by the SHG crystals of KTP, and a laser beam from AlGaInP (wavelength: about 670 nm, manufactured by Toshiba, type No. TOLD9211). These apparatus operate so that the laser beam is reflected by a rotary polygonal member to successively scans a color printing paper in the direction perpendicular to the moving direction of the color printing paper. Using these apparatus, the relationship D-log E between the density (D) and the amount of exposure (E) was obtained while the amount of exposure was varied. The amounts of the three laser beams having different wave-lengths were modulated by an external modulator to control the amount of exposure. The scan for exposure was carried out at 400 dpi so that the average exposure time for each picture element was about $5\times10^{-8}$ seconds. The temperature of the semiconductor laser was maintained constant by using a Peltier device to reduce variation in the amount of light due to variation in the temperature.

As described above, by using the specific magenta coupler and the specific yellow couple according to the present invention in combination, the color amalgamation during processing can be reduced. Accordingly, it is possible to provide a silver halide color photographic light-sensitive material which is excellent in color reproducing performance, color generating performance, and image stability. Also, the amount of gelatin is reduced by the combination use of the couplers according to the present invention. Thus, it is possible to provide a silver halide color photographic light-sensitive material which is economical and suitable for quick processing.

What is claimed is:

1. A silver halide color photographic light-sensitive material comprising a support having thereon, in any order, at least one yellow color developable light-sensitive silver halide emulsion layer, at least one magenta color developable light-sensitive silver halide emulsion layer, and at least one cyan color developable light-sensitive silver halide emulsion layer, wherein each of these emulsion layers has a different light-sensitive wavelength region, and wherein at least one magenta color developable light-sensitive silver halide emulsion layer contains at least one dye-forming coupler represented by formula (M-I), and at least one yellow color developable light-sensitive silver halide emulsion layer contains at least one dye-forming coupler represented by formula (Y-I),

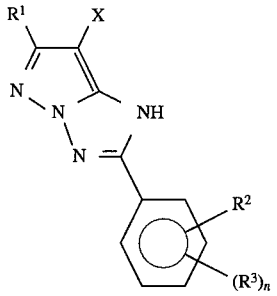

(M-I)

wherein $R^1$ is a group selected from the group consisting of formula (Q-1), (Q-2) and (Q-3):

$$—C(R^4)(R^5)—R^6 \quad (Q\text{-}1)$$

wherein $R^4$ is an alkyl, cycloalkyl, aryl or heterocyclic group, $R^5$ and $R^6$ are independently substituents, and $R^4$, $R^5$ and $R^6$ may be linked to each other to form a single ring having 5–7 members or a condensed ring having 5–7 members, $$—CH(R^7)—R^8 \quad (Q\text{-}2)$$

wherein $R^7$ is an alkyl, cycloalkyl, aryl or heterocyclic group, $R^8$ represents a substituent, and $R^7$ and $R^8$ may be linked to each other to form a single ring having 5–7 members or a condensed ring having 5–7 members,

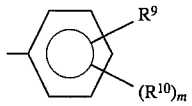

(Q-3)

wherein $R^9$ and $R^{10}$ are independently substituents, and m is an integer of 0–4,provided that a plurality of $R^{10}$ are the same or different when m is not less than 2, $R^2$ and $R^3$ are independently substituents, n is an integer of 0–4, and X is a halogen atom or a group which is removable by a coupling reaction with an oxidized developing agent,

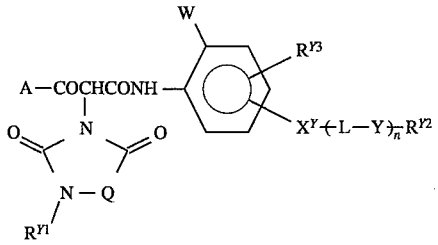

(Y-I)

wherein A is a tertiary alkyl, or a tertiary cycloalkyl, W is a halogen atom, an alkoxy, aryloxy, or alkyl group, $X^Y$ is a group $—NR^{Y11}CO—$ or $—NR^{Y11}SO_2—$, L is an alkylene group, Y is a divalent group selected from the group consisting of —O—, COO, $—SO_2—$ and $—PO(OR^{Y12})O—$, n is 0 or 1, and Q is a divalent group selected from the group consisting of $—CR^{Y4}R^{Y5}$, $—NR^{Y6}—$ and —CO—, wherein $R^{Y1}$ and $R^{Y6}$ are independently hydrogen atoms or alkyl groups, $R^{Y2}$ is an alkyl, cycloalkyl or aryl group, $R^{Y3}$ is a hydrogen atom or a monovalent group which may be substituted on a benzene ring, $R^{Y11}$ and $R^{Y12}$ are independently alkyl, cycloalkyl or aryl groups, $R^{Y4}$ and $R^{Y5}$ are independently hydrogen atoms, alkyl or alkoxy groups, provided that the total sum of the carbon atoms contained in the groups $R^{Y1}$, $R^{Y4}$, $R^{Y5}$ and $R^{Y6}$ is not greater than 4.

2. The silver halide color photographic light-sensitive material according to claim 1, wherein $R^1$ in formula (M-I) is a group represented by formula (Q-1) or (Q-3).

3. The silver halide color photographic light-sensitive material according to claim 2, wherein $R^1$ in formula (M-I) is a group represented by formula (Q-I) wherein $R^4$ is an alkyl group, and $R^5$ and $R^6$ are independently selected from the group consisting of alkyl, cycloalkyl, aryl, hydroxyl, alkoxy, aryloxy, amino, anilino, carbonamide, ureido, sulfonamide, sulfamoylamino, imide, alkylthio, and arylthio groups.

4. The silver halide color photographic light-sensitive material according to claim 3, wherein $R^5$ and $R^6$ are independently selected from the group consisting of alkyl, cycloalkyl, and aryl groups.

5. The silver halide color photographic light-sensitive material according to claim 2, wherein $R^1$ in formula (M-I) is a group represented by formula (Q-3), wherein $R^9$ and $R^{10}$ are independently selected from the group consisting of halogen atoms, alkyl, cycloalkyl, aryl, alkoxy, aryloxy, acyl, alkoxycarbonyl, cycloalkyloxycarbonyl, aryloxycarbonyl, carbamoyl, amino, anilino, carbonamide, alkoxycarbonylamino, aryloxycarbonylamino, ureido, sulfonamide, sulfamoylamino, imide, alkylthio, arylthio, heterocyclic thio, sulfonyl, alkanesulfonyl, arylsulfonyl, sulfamoyl, and phosphonyl groups; and m is 0, 1, 2, or 3.

6. The silver halide color photographic light-sensitive material according to claim 5, wherein $R^9$ and $R^{10}$ are independently selected from the group consisting of halogen atoms, alkyl, cycloalkyl aryl, alkoxy, aryloxy, amino, anilino, carbonamide, ureido, sulfonamide, sulfamoylamino, alkylthio, and arylthio groups.

7. The silver halide color photographic light-sensitive material according to claim 1, wherein in formula (M-1) $R^1$ is a group represented by formula (Q-1) or (Q-3); $R^2$ is selected from the group consisting of alkoxy, aryloxy, acyloxy, alkoxycarbonyloxy, cycloalkyloxycarbonyloxy, aryloxycarbonyloxy, carbamoyloxy, sulfamoyloxy, alkanesulfonyloxy, arylsulfonyloxy, acyl, alkoxycarbonyl, cycloalkyloxycarbonyl, aryloxycarbonyl, carbamoyl, amino, anilino, carbonamide, alkoxycarbonylamino, aryloxycarbonylamino, ureido, sulfonamide, sulfamoylamino, imide, alkylthio, arylthio, heterocyclic thio, alkanesulfonyl, arylsulfonyl, and sulfamoyl groups; $R^3$ is selected from the group consisting of fluorine, chlorine, and bromine atoms, and alkyl, cycloalkyl, aryl, heterocyclic, cyano, hydroxyl, nitro, alkoxy, aryloxy, carboxyl, acyl, alkoxycarbonyl, cycloalkyloxycarbonyl, aryloxycarbonyl, carbamoyl, amino, anilino, carbonamide, alkoxycarbonylamino, aryloxycarbonylamino, ureido, sulfonamide, sulfamoylamino, imide, alkylthio, arylthio, heterocyclic thio, sulfinyl, sulfo, alkanesulfonyl, arylsulfonyl, sulfamoyl, and phosphonyl groups; n is in the range from 0 to 3; and X is selected from hydrogen, chlorine, and bromine atoms, and aryloxy, alkylthio, arylthio, heterocyclic thio, and heterocyclic groups.

8. The silver halide color photographic light-sensitive material according to claim 1, wherein the dye-forming coupler represented by formula (M-I) is a coupler represented by formula (M-III):

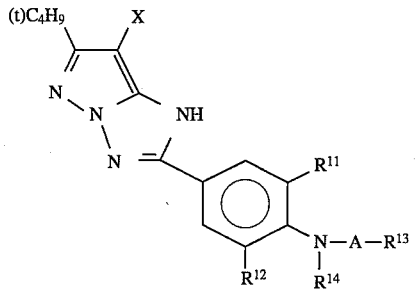

(M-III)

wherein $R^{11}$ and $R^{12}$ are independently hydrogen atoms or substituents, A is —CO— or —$SO_2$—, $R^{13}$ is an alkyl, aryl, alkoxy, alkylamino or anilino group, $R^{14}$ is a hydrogen atom, or an alkyl, aryl, acyl, alkanesulfonyl or arylsulfonyl group, X is a hydrogen atom or a group which is removable by a coupling reaction with an oxidized developing agent, and $R^{13}$ and $R^{14}$ may be linked to each other to form a single ring having 5–7 members or a condensed ring having 5–7 members.

9. The silver halide color photographic light-sensitive material according to claim 1, wherein $R^{Y1}$ in formula (Y-1) is a hydrogen atom, and Q is a methylene group.

10. The silver halide color photographic light-sensitive material according to claim 1, wherein $R^{Y1}$ in formula (Y-I) is hydrogen.

11. The silver halide color photographic light-sensitive material according to claim 1, wherein n is 0, $R^{Y2}$ is a linear alkyl group, and X is a group —$NR^{Y11}CO$—, in formula (Y-I).

12. The silver halide color photographic light-sensitive material according to claim 1, wherein A is a tertiary alkyl having 4–20 carbon or, a tertiary cycloalkyl group having 4–20 carbon atoms, W is a chlorine atom, an alkoxy, or aryloxy group, $X^Y$ is a group —$NR^{Y11}CO$— or a group —$NR^{Y11}SO_2$ wherein $R^{Y11}$ is a hydrogen atom, or an alkyl group, L is a linear or branched alkylene group having 1–20 carbon atoms, Y and n are the same as defined in claim 1, Q is a divalent group —$CR^{Y4}R^{Y5}$— wherein $R^{Y4}$ and $R^{Y5}$ independently represent hydrogen atoms, alkyl, or alkoxy groups, $R^{Y1}$ represents a hydrogen atom or an alkyl group having 4 or less carbon atoms, $R^{Y2}$ is a linear or branched alkyl group which has 1–30 carbon atoms, or a cycloalkyl group having 6–22 carbon atoms or an aryl group having 6–22 carbon atoms, and $R^{Y3}$ is a hydrogen atom, a halogen atom, or an alkoxy group.

13. The silver halide color photographic light-sensitive material according to claim 1, wherein the cyan color developable light-sensitive silver halide emulsion layer contains a dye-forming coupler represented by formula (C-I),

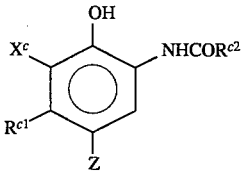

(C-I)

wherein $R^{C1}$ is an alkyl group having 2–4 carbon atoms, $R^{C2}$ is a linear or branched alkyl group having 11–31 carbon atoms, $X^c$ is a hydrogen atom or a group which may be substituted on a benzene ring, and Z is a group which is removable by a coupling reaction with an oxidized developing agent.

14. The silver halide color photographic light-sensitive material according to claim 1, wherein each of said silver halide emulsion layers contain gelatin and the total amount of gelatin in said silver halide color photographic light-sensitive material is not greater than 7.2 g/$m^2$.

15. The silver halide color photographic light-sensitive material according to claim 1, wherein the support is a reflective support.

16. A silver halide color photographic light-sensitive material comprising a support having thereon, in any order, at least one yellow color developable light-sensitive silver halide emulsion layer, at least one magenta color developable light-sensitive silver halide emulsion layer, and at least one cyan color developable light-sensitive silver halide emulsion layer, wherein each of these emulsion layers has a different light-sensitive wavelength region, and wherein at least one magenta color developable light-sensitive silver halide emulsion layer contains at least one dye-forming coupler represented by formula (M-II), and at least one yellow color developable light-sensitive silver halide emulsion layer contains at least one dye-forming coupler represented by formula (Y-1),

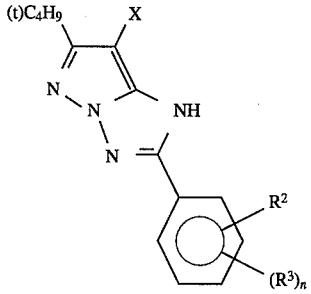

(M-II)

wherein $R^2$ and $R^3$ are independently substituents, n is an integer of 0–4 and X is a halogen atom or a group which is removable by a coupling reaction with an oxidized developing agent:

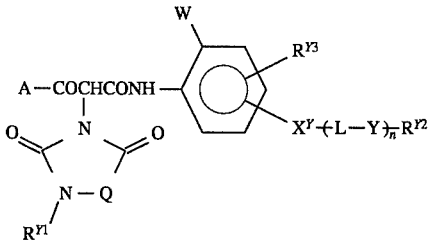

(Y-I)

wherein A is a tertiary alkyl having 4–20 carbon atoms, tertiary cycloalkyl group having 4–20 carbon atoms, or an indoline ring, W is a chlorine atom, an alkoxy group, or an aryloxy group, $X^Y$ is a group —$NR^{Y11}CO$— or a group —$NR^{Y11}SO_2$ wherein $R^{Y11}$ is a hydrogen atom, or an alkyl group, L is a linear or branched alkylene group having 1–20 carbon atoms, Y is a divalent group selected from the group consisting of —O—, —COO—, —$SO_2$ and —$PO(OR^{Y12})O$—, n is 0 or 1, Q is a divalent group —$CR^{Y4}R^{Y5}$— wherein $R^{Y4}$ and $R^{Y5}$ independently represent a hydrogen atom an alkyl group, or an alkoxy group, $R^{Y1}$ represents a hydrogen atom or an alkyl group having 4 or less carbon atoms, $R^{Y2}$ is a linear or branched alkyl group which has 1–30. carbon atoms, or a cycloalkyl group having 6–22 carbon atoms or an aryl group having 6–22 carbon atoms, and $R^{Y3}$ is a hydrogen atom, a halogen atom, or an alkoxy group.

17. The silver halide color photographic light-sensitive material according to claim 16, wherein a cyan sensitive silver halide emulsion layer contains a dye-forming coupler represented by formula (C-I),

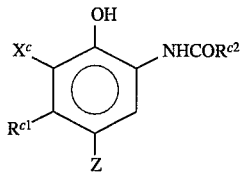

(C-I)

wherein $R^{C1}$ is a alkyl group having 2–4 carbon atoms, $R^{C2}$ is a linear or branched alkyl group having 11–31 carbon atoms, $X^c$ is a hydrogen atom or a group which may be substituted on a benzene ring, and Z is a group which is removable by a coupling reaction with an oxidized developing agent.

18. The silver halide color photographic light-sensitive material according to claim 16, wherein the total amount of gelatin contained in the silver halide color photographic light-sensitive material is not greater than 7.2 g/m$^2$.

19. The silver halide color photographic light-sensitive material according to claim 16, wherein the support is a reflective support.

20. A silver halide color photographic light-sensitive material comprising a support having thereon, in any order, at least one yellow color developable light-sensitive silver halide emulsion layer, at least one magenta color developable light-sensitive silver halide emulsion layer, and at least one cyan color developable light-sensitive silver halide emulsion layer, wherein each of these emulsion layers has a different light-sensitive wavelength region, and wherein at least one magenta color developable light-sensitive silver halide emulsion layer contains at least one dye-forming coupler represented by formula (M-I), and at least one yellow color developable light-sensitive silver halide emulsion layer contains at least one dye-forming coupler represented by formula (Y-I),

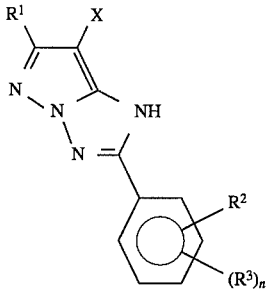

(M-I)

wherein $R^1$ is a group selected from the group consisting of formula (Q-1), (Q-2) and (Q-3):

$$—C(R^4)(R^5)—R^6 \quad \text{(Q-1)}$$

wherein $R^4$ is an alkyl, cycloalkyl, aryl or heterocyclic group, $R^5$ and $R^6$ are independently substituents, and $R^4$, $R^5$ and $R^6$ may be linked to each other to form a single ring having 5–7 members or a condensed ring having 5–7 members, $$—CH(R^7)—R^8 \quad \text{(Q-2)}$$

wherein $R^7$ is an alkyl, cycloalkyl, aryl or heterocyclic group, $R^8$ represents a substituent, and $R^7$ and $R^8$ may be linked to each other to form a single ring having 5–7 members or a condensed ring having 5–7 members,

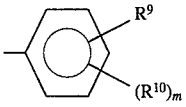

(Q-3)

wherein $R^9$ and $R^{10}$ are independently substituents, and m is an integer of 0–4, provided that a plurality of $R^{10}$ are the same or different when m is not less than 2, $R^2$ and $R^3$ are independently substituents, n is an integer of 0–4, and X is a halogen atom or a group which is removable by a coupling reaction with an oxidized developing agent,

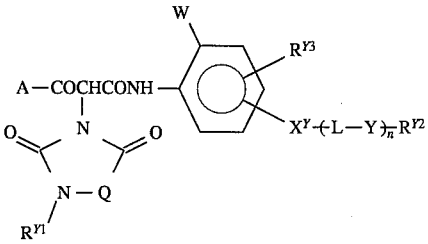

(Y-I)

wherein A is an indolinyl group, W is a halogen atom, an alkoxy, aryloxy or alkyl group, $X^Y$ is a group $—NR^{Y11}CO—$ or $—NR^{Y11}SO_2—$, L is an alkylene group, Y is a divalent group selected from the group consisting of —O—, COO, $—SO_2—$ and $—PO(OR^{12})O—$, n is 0 or 1, and Q is a divalent group selected from the group consisting of $—CR^{Y4}R^{Y5}$, $—NR^{Y6}—$ and —CO—, wherein $R^{Y1}$ is a hydrogen atom, $R^{Y6}$ is a hydrogen atom or an alkyl group, $R^{Y2}$ is an alkyl, cycloalkyl or aryl group, $R^{Y3}$ is a hydrogen atom or a monovalent group which may be substituted on a benzene ring, $R^{Y11}$ and $R^{Y12}$ are independently alkyl, cycloalkyl or aryl groups, $R^{Y4}$ and $R^{Y5}$ are independently hydrogen atoms, alkyl or alkoxy groups, provided that the total sum of the carbon atoms contained in the groups $R^{Y1}$, $R^{Y4}$, $R^{Y5}$ and $R^{Y6}$ is not greater than 4.

* * * * *